US009719303B2

(12) United States Patent
Twardowski et al.

(10) Patent No.: US 9,719,303 B2
(45) Date of Patent: Aug. 1, 2017

(54) SUBSEA DRILLING WITH CASING

(71) Applicant: Weatherford Technology Holdings, LLC, Houston, TX (US)

(72) Inventors: Eric M. Twardowski, Spring, TX (US); Jose A. Trevino, Houston, TX (US); Albert C. Odell, II, Kingwood, TX (US); Tuong Thanh Le, Katy, TX (US); Wei Jake Xu, Houston, TX (US); Guy F. Feasey, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 14/494,230

(22) Filed: Sep. 23, 2014

(65) Prior Publication Data

US 2015/0060078 A1 Mar. 5, 2015

Related U.S. Application Data

(62) Division of application No. 12/620,581, filed on Nov. 17, 2009, now Pat. No. 8,839,880.
(Continued)

(51) Int. Cl.
*E21B 7/20* (2006.01)
*E21B 33/14* (2006.01)
(Continued)

(52) U.S. Cl.
CPC ..... *E21B 7/208* (2013.01); *E21B 3/00* (2013.01); *E21B 7/124* (2013.01); *E21B 7/20* (2013.01);
(Continued)

(58) Field of Classification Search
CPC ..... E21B 17/06; E21B 17/07; E21B 19/002; E21B 33/035; E21B 33/143; E21B 34/04; E21B 3/00; E21B 43/101; E21B 7/20
(Continued)

(56) References Cited

U.S. PATENT DOCUMENTS 1,875,357 A * 9/1932 Simmons ..... 166/105
3,189,095 A * 6/1965 De Rochemont ... E21B 33/1295 166/120
(Continued)

FOREIGN PATENT DOCUMENTS

WO 2007/091054 A1 8/2007

OTHER PUBLICATIONS

PCT Partial Search Report for International Application No. PCT/US20091064875 dated Jun. 8, 2010.
(Continued)

*Primary Examiner* — James G Sayre
(74) *Attorney, Agent, or Firm* — Patterson & Sheridan, LLP

(57) ABSTRACT

A method of forming a wellbore includes providing a drilling assembly comprising one or more lengths of casing and an axially retracting assembly having a first tubular; a second tubular at least partially disposed in the first tubular and axially fixed thereto; and a support member disposed in the second tubular and movable from a first axial position to a second axial position relative to the second tubular, wherein, in the first axial position, the support member maintains the second tubular axially fixed to the first tubular, and in the second axial position, allows the second tubular to move relative to the first tubular; and an earth removal member disposed below the axially retracting assembly. The method also includes rotating the earth removal member to form the wellbore; moving the support member to the second axial position; and reducing a length of the axially retracting assembly.

5 Claims, 64 Drawing Sheets

Related U.S. Application Data

(60) Provisional application No. 61/199,510, filed on Nov. 17, 2008.

(51) Int. Cl.

| | |
|---|---|
| ***E21B 33/035*** | (2006.01) |
| ***E21B 47/06*** | (2012.01) |
| ***E21B 3/00*** | (2006.01) |
| ***E21B 7/124*** | (2006.01) |
| ***E21B 17/06*** | (2006.01) |
| ***E21B 17/07*** | (2006.01) |
| ***E21B 19/00*** | (2006.01) |
| ***E21B 34/04*** | (2006.01) |
| ***E21B 43/10*** | (2006.01) |

(52) U.S. Cl.
CPC ..... *E21B 17/06* (2013.01); *E21B 17/07* (2013.01); *E21B 19/002* (2013.01); *E21B 33/035* (2013.01); *E21B 33/143* (2013.01); *E21B 34/04* (2013.01); *E21B 43/101* (2013.01); *E21B 47/06* (2013.01)

(58) Field of Classification Search
USPC ..... 166/335, 348; 175/5
See application file for complete search history.

(56) References Cited

U.S. PATENT DOCUMENTS

| | | | | |
|---|---|---|---|---|
| 4,154,298 | A | 5/1979 | Gano | |
| 4,423,889 | A | 1/1984 | Weise | |
| 4,671,361 | A * | 6/1987 | Bolin | E21B 17/06 166/144 |
| 5,105,890 | A * | 4/1992 | Duguid | E21B 7/06 166/380 |
| 5,148,875 | A | 9/1992 | Karlsson et al. | |
| 5,168,942 | A | 12/1992 | Wydrinski | |
| 5,551,521 | A | 9/1996 | Vail, III | |
| 5,845,722 | A | 12/1998 | Makohl et al. | |
| 5,984,029 | A | 11/1999 | Griffin et al. | |
| 6,003,607 | A * | 12/1999 | Hagen et al. | 166/381 |
| 6,196,336 | B1 | 3/2001 | Fincher et al. | |
| 6,223,823 | B1 | 5/2001 | Head | |
| 6,412,574 | B1 | 7/2002 | Wardley et al. | |
| 6,450,541 | B1 | 9/2002 | Bakke | |
| 6,725,919 | B2 | 4/2004 | Cook et al. | |
| 6,857,487 | B2 | 2/2005 | Galloway et al. | |
| 6,899,186 | B2 | 5/2005 | Galloway et al. | |
| 7,044,241 | B2 | 5/2006 | Angman | |
| 7,048,050 | B2 | 5/2006 | Vail, III et al. | |
| 7,093,675 | B2 | 8/2006 | Pia | |
| 7,100,710 | B2 | 9/2006 | Vail, III | |
| 7,108,083 | B2 | 9/2006 | Simonds et al. | |
| 7,174,963 | B2 | 2/2007 | Bertelsen | |
| 7,311,148 | B2 | 12/2007 | Giroux et al. | |
| 7,334,650 | B2 * | 2/2008 | Giroux et al. | 175/26 |
| 7,730,965 | B2 | 6/2010 | Jordan et al. | |
| 7,926,578 | B2 * | 4/2011 | Moffitt et al. | 166/380 |
| 7,938,201 | B2 | 5/2011 | Giroux et al. | |
| 2003/0024708 | A1 | 2/2003 | Ring et al. | |
| 2003/0056991 | A1 | 3/2003 | Hahn et al. | |
| 2003/0141111 | A1 | 7/2003 | Pia | |
| 2003/0217850 | A1 * | 11/2003 | Shaw et al. | 166/374 |
| 2004/0011534 | A1 | 1/2004 | Simonds et al. | |
| 2004/0216925 | A1 | 11/2004 | Metcalfe et al. | |
| 2004/0221997 | A1 | 11/2004 | Giroux et al. | |
| 2005/0152749 | A1 | 7/2005 | Anres et al. | |

OTHER PUBLICATIONS

PCT Search Report for International Application No. PCT/US2009/064875 dated Sep. 17, 2010.
Office Action for U.S. Appl. No. 13/104,748 dated Dec. 20, 2011.
Examination Report for Application No. 09806156.7-2315 dated Apr. 11, 2012.
Canadian Office Action dated Sep. 30, 2013, Canadian Application No. 2,744,047.
Australian Patent Examination Report dated Jul. 15, 2016, for Australian Patent Application No. 2015201558.
EPO Office Action dated Oct. 16, 2015, for EPO Application No. 09806156.7.
Canadian Office Action dated Nov. 17, 2015, for Canadian Patent Application No. 2,873,799.
Canadian Office Action dated Oct. 26, 2016, for Canadian Patent Application No. 2,873,799.

* cited by examiner

SUBSEA DRILLING WITH CASING

CROSS-REFERENCE TO RELATED APPLICATIONS

This application is a divisional application of U.S. patent application Ser. No. 12/620,581, filed Nov. 17, 2009, which claims benefit of U.S. Provisional Patent Application Ser. No. 61/199,510, filed Nov. 17, 2008. Each of the applications is incorporated herein by reference in its entirety.

BACKGROUND

Field of the Invention

Embodiments of the present invention generally relate to methods and apparatus for forming and completing a wellbore. Particularly, the present invention relates to methods and apparatus for subsea drilling with casing. More particularly, the present invention relates to methods and apparatus for drilling in a liner or casing and attaching the liner or casing to a casing hanger or wellhead.

Description of the Related Art

In the oil and gas producing industry, the process of cementing casing into the wellbore of an oil or gas well generally comprises several steps. For example, a conductor pipe is positioned in the hole or wellbore and may be supported by the formation and/or cemented. Next, a section of a hole or wellbore is drilled with a drill bit which is slightly larger than the outside diameter of the casing which will be run into the well.

Thereafter, a string of casing is run into the wellbore to the required depth where the casing lands in and is supported by a well head in the conductor. Next, cement slurry is pumped into the casing to fill the annulus between the casing and the wellbore. The cement serves to secure the casing in position and prevent migration of fluids between formations through which the casing has passed. Once the cement hardens, a smaller drill bit is used to drill through the cement in the shoe joint and further into the formation.

Typically, when the casing string is suspended in a subsea wellhead or casing hanger, the length of the casing string is shorter than the drilled open hole section, allowing the casing hanger or high pressure wellhead housing to land into the wellhead prior to reaching the bottom of the open hole. Should the casing reach the bottom of the hole prior to landing the casing hanger or high pressure wellhead housing, the system would fail to seal and the casing would have to be retrieved or remedial action taken.

The difficulty in positioning the casing at the proper depth is magnified in operations where casing is used as the drill string. In general, drilling with casing allows the drilling and positioning of a casing string in a wellbore in a single trip. However, drilling with casing techniques may be unsuitable in the instance where the casing string must land in a wellhead. To reach proper depth to land a casing hanger or high pressure wellhead housing in the wellhead, the casing string must continue to drill to the proper depth. However, continued rotation while the casing hanger or high pressure wellhead housing is near, or in, the wellhead may damage the wellhead and/or it's sealing surfaces. Thus, the casing string may be prematurely stopped to avoid damaging the wellhead.

There is a need, therefore, for improved apparatus and methods of completing a wellbore using drilling with casing techniques. There is also a need for apparatus and methods for drilling with a casing and landing the casing in a wellhead.

SUMMARY OF THE INVENTION

Embodiments of the present invention relate to a retractable tubular assembly having a first tubular; a second tubular at least partially disposed in the first tubular; an engagement member for coupling the first tubular to the second tubular, the engagement member having an engaged position to lock the first tubular to the second tubular and a disengaged position to release the first tubular from the second tubular; and a selectively releasable support member disposed in the second tubular for maintaining the engagement member in the engaged position.

In another embodiment, a tubular conveying apparatus includes a tubular body having a plurality of windows; one or more gripping members radially movable between an engaged position and a disengaged position in the windows; and a mandrel disposed in the tubular body and selectively movable from a first position, wherein the gripping member is in the engaged position, to a second position, to allow the gripping member to move to the disengaged position.

In yet another embodiment, a method of forming a wellbore includes providing a drilling assembly comprising one or more lengths of casing and an axially retracting assembly having a first tubular; a second tubular at least partially disposed in the first tubular and axially fixed thereto; and a support member disposed in the second tubular and movable from a first axial position to a second axial position relative to the second tubular, wherein, in the first axial position, the support member maintains the second tubular axially fixed to the first tubular, and in the second axial position, allows the second tubular to move relative to the first tubular; and an earth removal member disposed below the axially retracting assembly. The method also includes rotating the earth removal member to form the wellbore; moving the support member to the second axial position; and reducing a length of the axially retracting assembly.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIGS. 13-18 show different views of the retractable joint of FIG. 12. FIG. 13 is an enlarged view of the telescoping portion. FIG. 14 is a bottom view of the telescoping portion.

FIG. 15 is a cross-sectional view of the telescoping portion of the retractable joint of FIG. 12.

FIG. 17 is a partial perspective view of the upper telescoping casing in the unactivated position.

FIG. 18 is a partial cross-sectional view of the telescoping portion after activation.

FIG. 34C is an enlarged view showing an exemplary vent system.

DETAILED DESCRIPTION OF THE PREFERRED EMBODIMENT

In one embodiment, a method for drilling and casing a subsea wellbore involves drilling the wellbore and installing casing in the same trip. The method may involve drilling or jetting a conductor casing string, to which a low pressure wellhead is attached, into place in the sea bed. Thereafter, a casing string having an earth removal member at its lower end and a high pressure subsea wellhead at its upper end may be drilled into place, such that the drilling extends the depth of the wellbore.

Figure 1A:
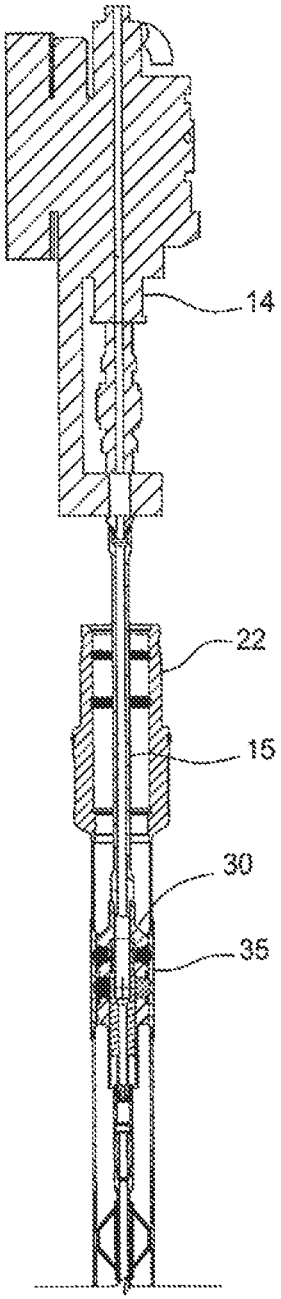
FIGS. 1A-1B show an exemplary drilling system suitable for drilling a subsea wellbore.
Figure 1B:
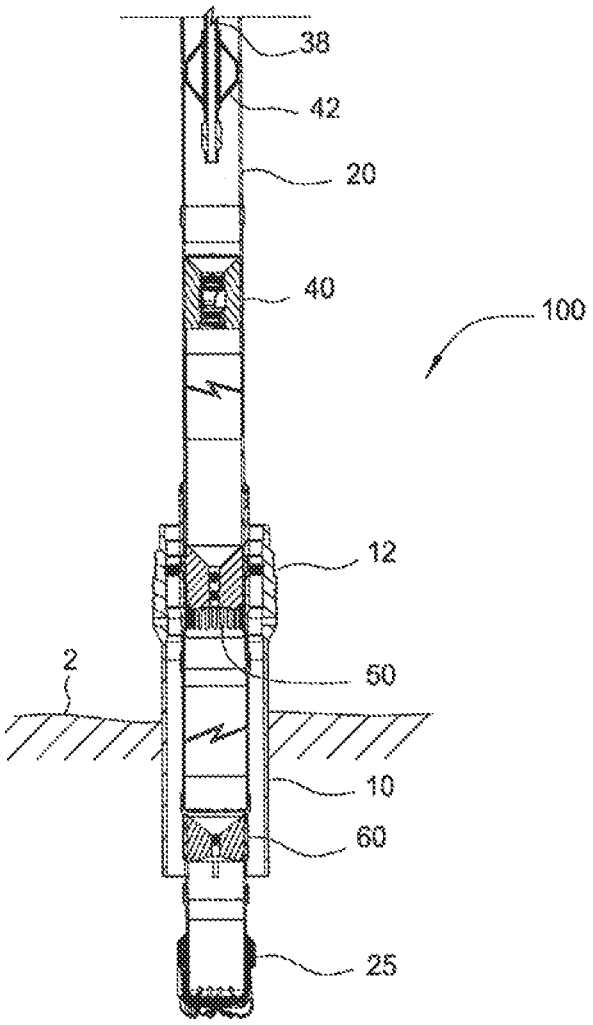

FIGS. 1A-1B show an exemplary drilling system 100 suitable for drilling a subsea wellbore. The drilling system is shown partially inserted in a pre-existing conductor casing 10 positioned on the sea floor 2. The conductor casing 10 is equipped with a low pressure wellhead 12. In another embodiment, the conductor casing 10 may be releasably attached to the drilling system 100 such that the conductor casing 10 and the drilling system 100 may be run-in in a single trip.

The drilling system 100 includes casing 20 having a high pressure wellhead 22 at its upper end and an earth removal member 25, such as a drill bit, at its lower end. A drill string 15 is releasably connected to a casing 20 using a running tool 30. The drill string 15 may extend from a top drive 14 and operatively connects the casing string 20 to a drilling unit, such as a floating drilling vessel or a semi-submersible drilling rig. The running tool 30 is shown connected to a setting sleeve 35 positioned in the casing 20. Alternatively, the running tool 30 may be connected to the high pressure wellhead 22. The running tool 30 may have an inner string 38 attached to a lower end thereof. The drilling system 100 may also include a float sub 40 to facilitate the cementing operation. As shown, the inner string 38 is above the float sub 40. Alternatively, the inner string 38 may be connected to the float sub 40. One or more centralizers 42 may be used to centralize the inner string 38 in the casing 20. In another embodiment, the drilling system 100 may use a jetting member instead of or in addition to an earth removal member.

Figure 2:
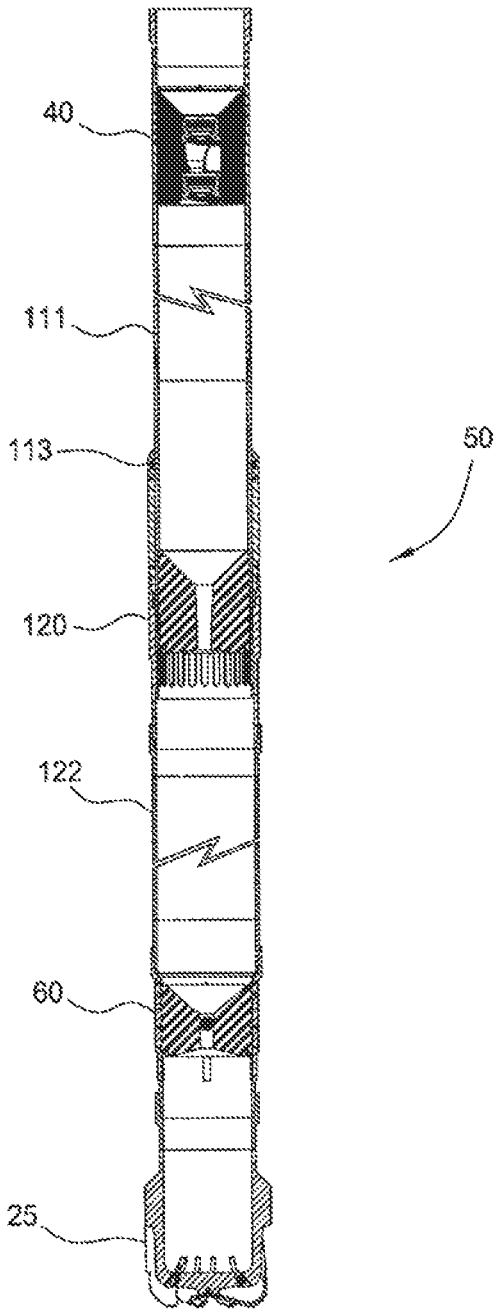
FIG. 2 illustrates an embodiment of a retractable joint suitable for use with the drilling system of FIGS. 1A-1B.

A retractable joint 50 is used to couple the earth removal member 25 to the casing 20. The retractable joint 50 may be operated to effectively reduce the length of the casing 20. To that end, the retractable joint 50 includes a telescoping portion and optionally, a circulation sub 60. FIG. 2 illustrates an embodiment of a retractable joint 50 suitable for use with the drilling system of FIGS. 1A-1B. The telescoping portion includes an upper telescoping casing 111 partially disposed in a larger diameter retraction sub 120. A seal 113 is provided on the retraction sub 120 for sealing engagement with the perimeter of the upper telescoping casing 111. The retraction sub 120 is connected to a lower telescoping casing 122, which may be optionally connected to a circulation sub 60. In turn, the circulation sub 60 is connected to the earth removal member 25.

Figure 3A:
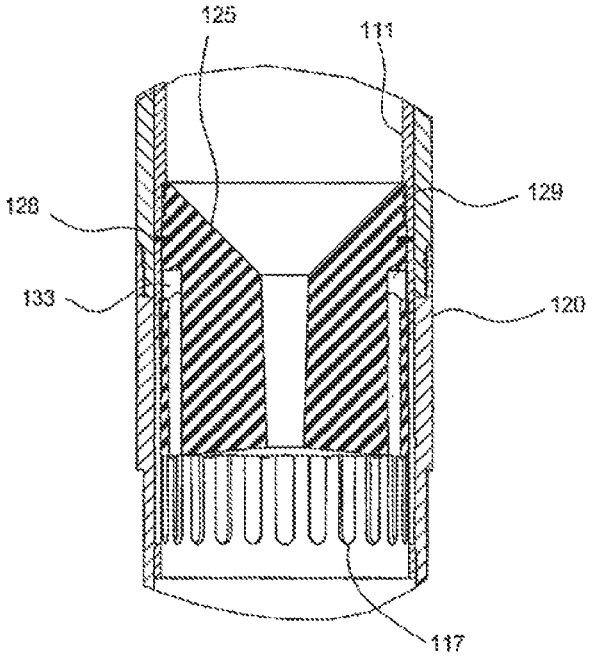
FIGS. 3A-B are different cross-sectional views of the telescoping portion in the unactivated position.
Figure 3B:
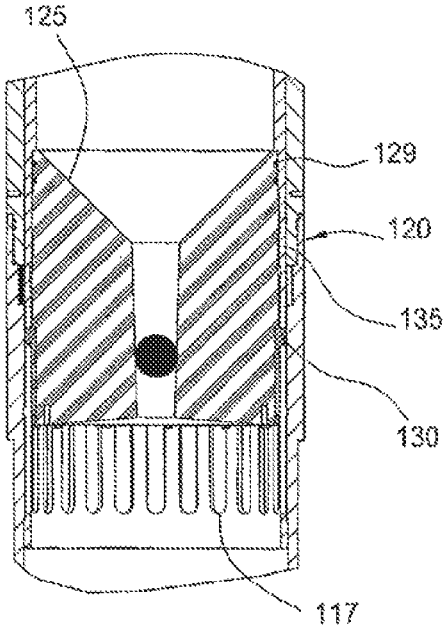

FIGS. 3A-B are partial cross-sectional views of the telescoping portion in the unactivated position. The upper telescoping casing 111 has elongated axial grooves 117 circumferentially spaced around its lower end overlapping the retraction sub 120. A shear sleeve 125 is disposed in and releasably connected to the upper telescoping casing 111 using one or more shearable connections 128, for example, shear pins. One or more seals 129 such as o-rings may be positioned between the shear sleeve 125 and the upper telescoping casing 111. The shear sleeve 125 is equipped with one or more keys 130 adapted to move in a respective axial groove 117 of the upper telescoping casing 111. The keys 130 prevent the shear sleeve 125 from rotating relative to the upper telescoping casing 111, which facilitates the drill out of the shear sleeve 125. One or more channels 133 are formed in the shear sleeve 125 to assist in re-establishing fluid communication during its operation, as will be described below. The channels 133 have one end terminating in a sidewall of the shear sleeve 125 and another end terminating in at the bottom of the shear sleeve 125.

Figure 4:
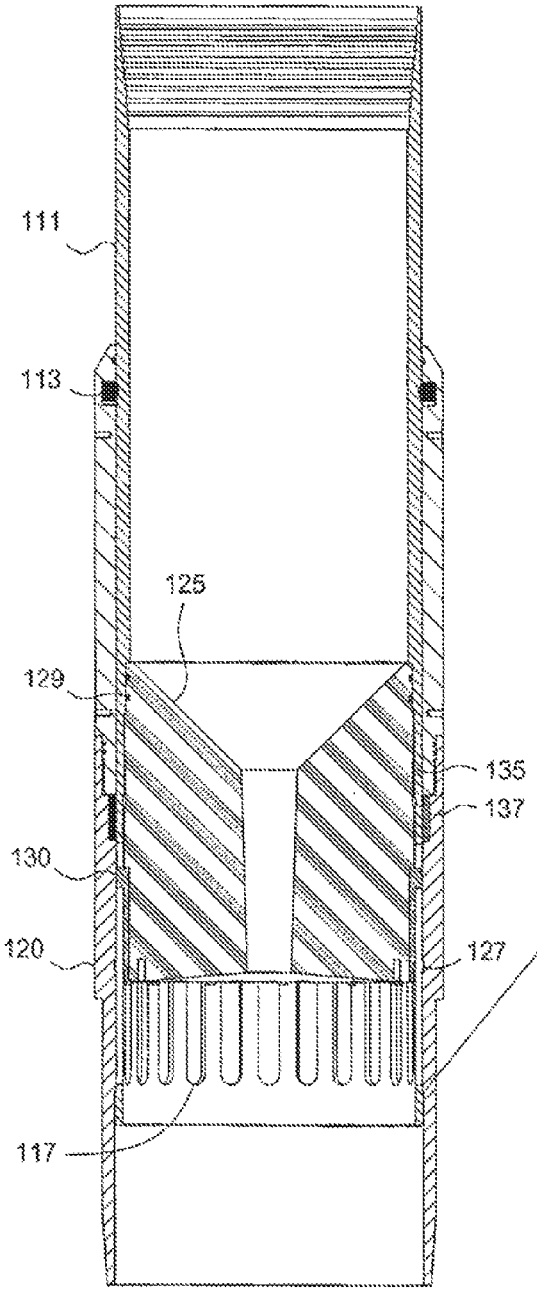
FIGS. 4 and 5 are partial views of the telescoping portion of the retractable joint.
Figure 6:
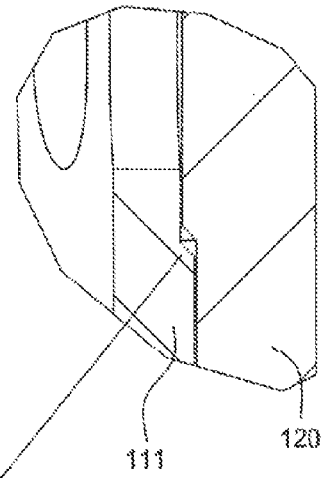
FIG. 6 is an enlarged partial view of FIG. 4.
Figure 4A:
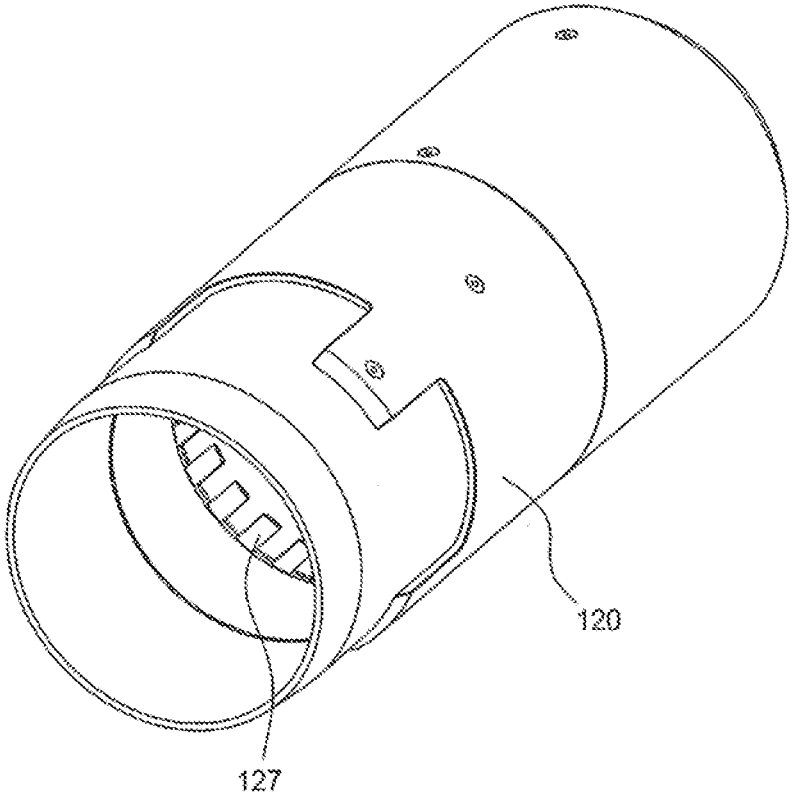
FIG. 4A is a perspective view of the retraction sub.
Figure 5:
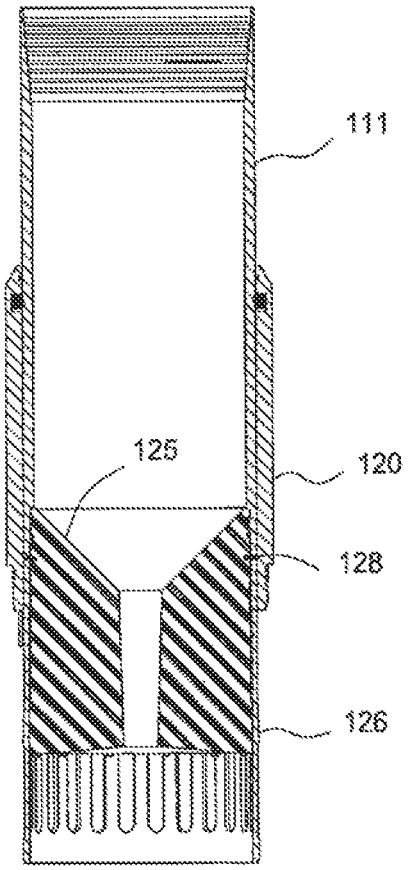
Figure 5A:
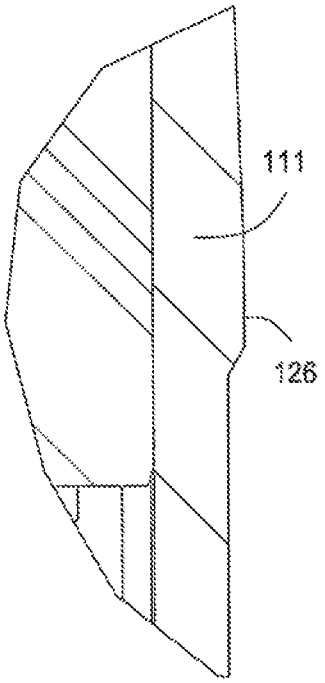
FIG. 5A is an enlarged partial view of FIG. 5.

FIGS. 4-6 show the transfer of torque and axial load between the upper telescoping casing 111 and the retraction sub 120. As shown in FIGS. 4, 4A, and 5, the upper telescoping casing 111 has raised tabs 126 formed on its outer surface which interact with corresponding pockets 127 in the inner surface of the retraction sub 120. The tabs 126 and the pockets 127 have mating shoulders such that axial load may be transferred therebetween. FIG. 5A is an enlarged view of the tab 126 with the shoulder for engagement with the retraction sub 20. In addition, the raised tabs 126 disposed in the pockets 127 allow transfer of torque in a manner similar to a spline assembly concept. In the run-in position, the shear sleeve 125 presses against the tabs 126 to prevent their disengagement from the pockets 127. To release the tabs 126, the shear sleeve 125 must be moved downward such that a circumferential recess 135 formed on the outer surface is positioned adjacent the tabs 126, thereby allowing the tabs 126 to deflect inward to disengage from the pockets 127. FIG. 6 is an enlarged view of the lower end of the upper telescoping casing 111. As shown, the upper telescoping casing 111 has an upwardly facing shoulder adapted to engage a downward facing shoulder of the retraction sub 120 when the assembly is subjected to tensile axial loading.

Figure 7:
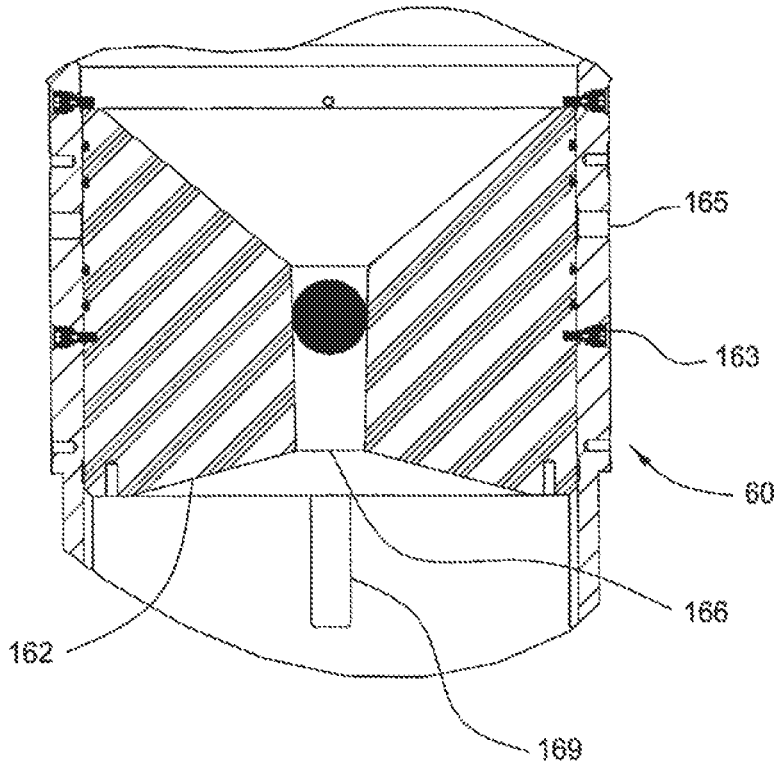
FIG. 7 shows an exemplary circulation sub suitable for use with the retractable joint in the unactivated position.

FIG. 7 shows an exemplary circulation sub 60 suitable for use with the retractable joint 50. The circulation sub 60 includes a circulation plug 162 releasably connected thereto using a shearable connection 163 such as a shear pin. In the run-in position, the circulation plug 162 blocks fluid communication through one or more ports 165 formed in the wall of the circulation sub 60. The circulation plug 162 may include a central bore having a seat 166 for receiving an activating device such as a ball. It must be noted that inclusion of the circulation sub 60 is optional.

Figure 8:
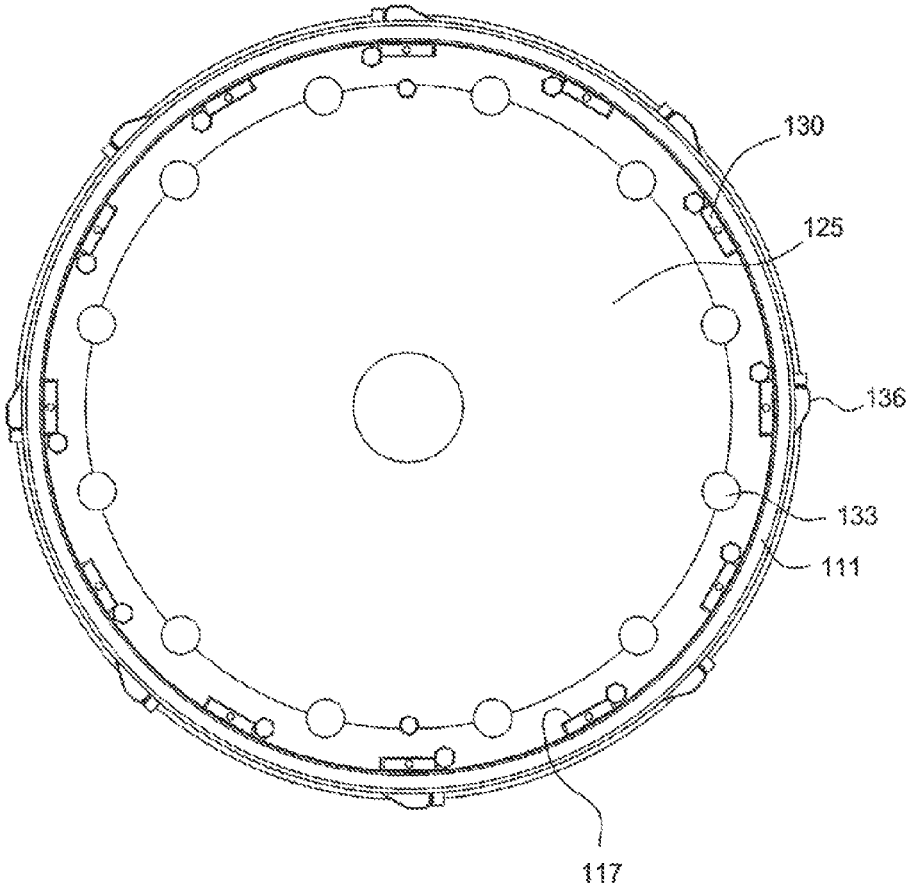
FIG. 8 is a bottom view of the shear sleeve and the upper telescoping casing.
Figure 9B:
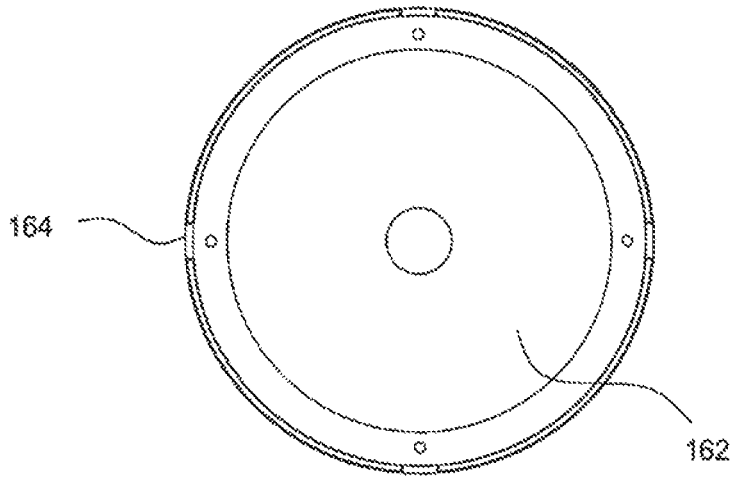
FIG. 9B is a bottom view of the circulation plug.
Figure 9A:
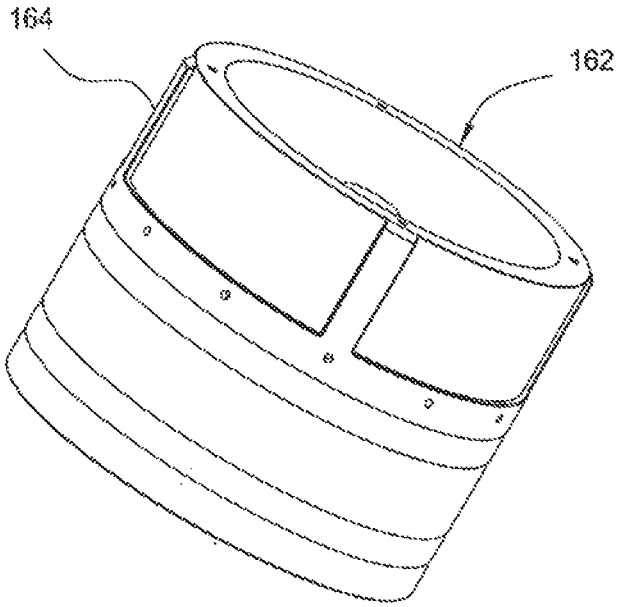
FIG. 9A is a perspective view of the circulation plug of the circulation sub.

The retractable joint may include features adapted to facilitate drill out of the shear sleeve 125, and if used, the circulation plug 162. FIG. 8 is a partial bottom view of the shear sleeve 125 and the upper telescoping casing 111. As discussed above, one or more keys 130 may be used to couple the two components 125, 111 and prevent relative rotation therebetween. As shown, keys 130 are disposed in a respective axial groove 117. It must be noted that any suitable number of keys may be used, for example, two, four, or six. Slips 136 may be used to provide anti-rotation between the upper telescoping casing 111 and the retraction sub 120. The slips 136 may be positioned in slip pockets 137 formed in the retraction sub 120, as shown in FIG. 4. Referring to FIGS. 9A-B, the circulation sub 60 uses keys to provide anti-rotation. The circulation plug 162 may includes keys 164 adapted to engage corresponding grooves 169 in the circulation sub 60. The grooves 169 are illustrated in FIG. 7. In this embodiment, the circulation sub uses four keys; however, any suitable number of keys may be used.

Figure 10:
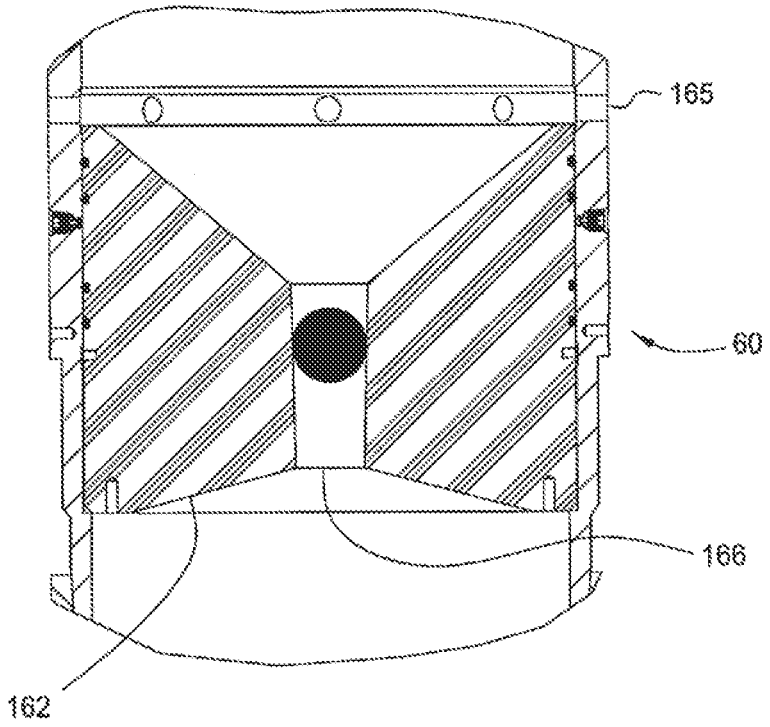
FIG. 10 shows the circulation sub of FIG. 7 in the activated position.

In operation, the retractable joint 50 with the optional circulation sub 60 may be activated using two activating devices, in this case, two balls. Initially, after the proper depth has been reached, the retractable joint 50 and earth removal member 25 are lifted off the bottom of the hole. A first ball is dropped and allowed to pass through the retraction sub 120 and land in the circulation plug 162, thereby closing the circulation path. Pressure is increased until the shear pins 163 are broken and the circulation plug 162 is freed to move downward to expose the circulation ports 165, as illustrated in FIG. 10.

Figure 11A:
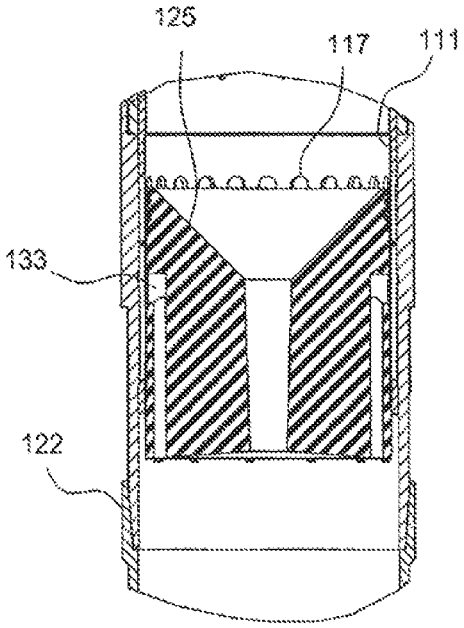
FIGS. 11A-B are different cross-sectional views of the telescoping portion in the activated position.
Figure 11B:
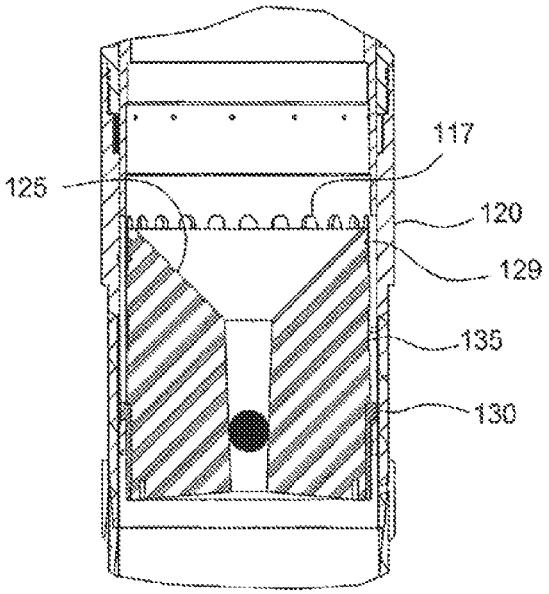
Figure 11C:
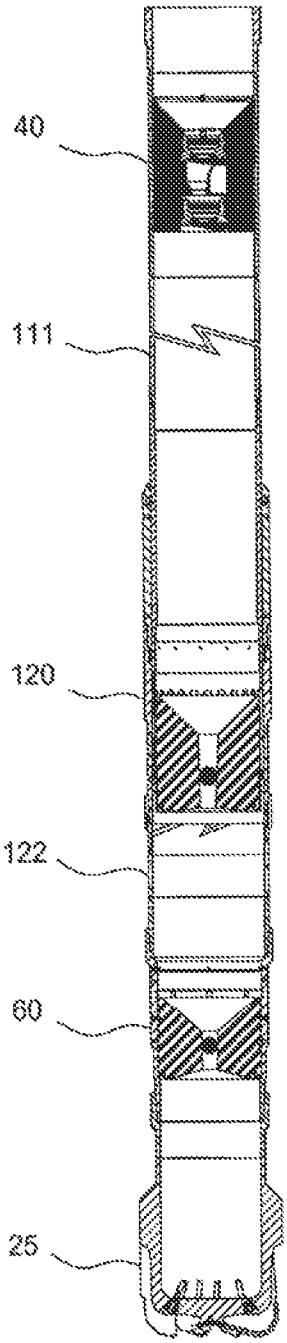
FIG. 11C shows the retractable joint in the retracted position.

A second, larger ball is dropped and allowed to land in the ball seat of the shear sleeve 125, which closes the circulation path. Pressure is increased until the shear pins 128 are broken and the shear sleeve 125 is freed to move downward relative to the upper telescoping casing 111. FIGS. 11A-B are different cross-sectional views of the telescoping portion in the activated position. Movement of the shear sleeve 125 is guided by the keys 130 traveling in the axial grooves 117 of the upper telescoping casing 111. The shear sleeve 125 moves downward until its top end is below the top of the axial grooves. Fluid may be circulated around the shear sleeve 125 by flowing into the axial grooves 117, then into the channels 133, and out of the bottom of the shear sleeve 125. Thereafter, the earth removal member 25 is returned to total depth and weight on bit is applied to retract the retractable joint 50. FIG. 11C shows the upper telescoping casing 111 retracted relative to the lower telescoping casing 122 and the retraction sub 120.

Figure 12:
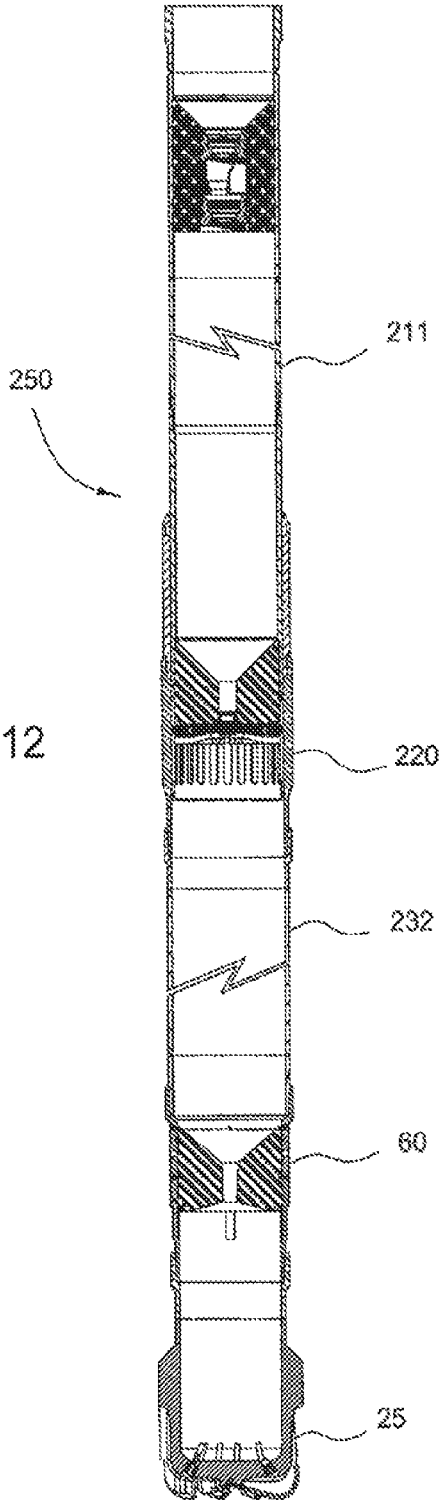
FIG. 12 illustrates another embodiment of a retractable joint.

FIG. 12 illustrates another embodiment of a retractable joint 250. The retractable joint 250 includes a telescoping portion and optionally, a circulation sub 60. The telescoping portion includes an upper telescoping casing 211 partially disposed in a larger diameter retraction sub 220. The retraction sub 220 is connected to a lower telescoping casing 232, which may be optionally connected to a circulation sub 60. In turn, the circulation sub 60 is connected to the earth removal member 25.

Figure 13:
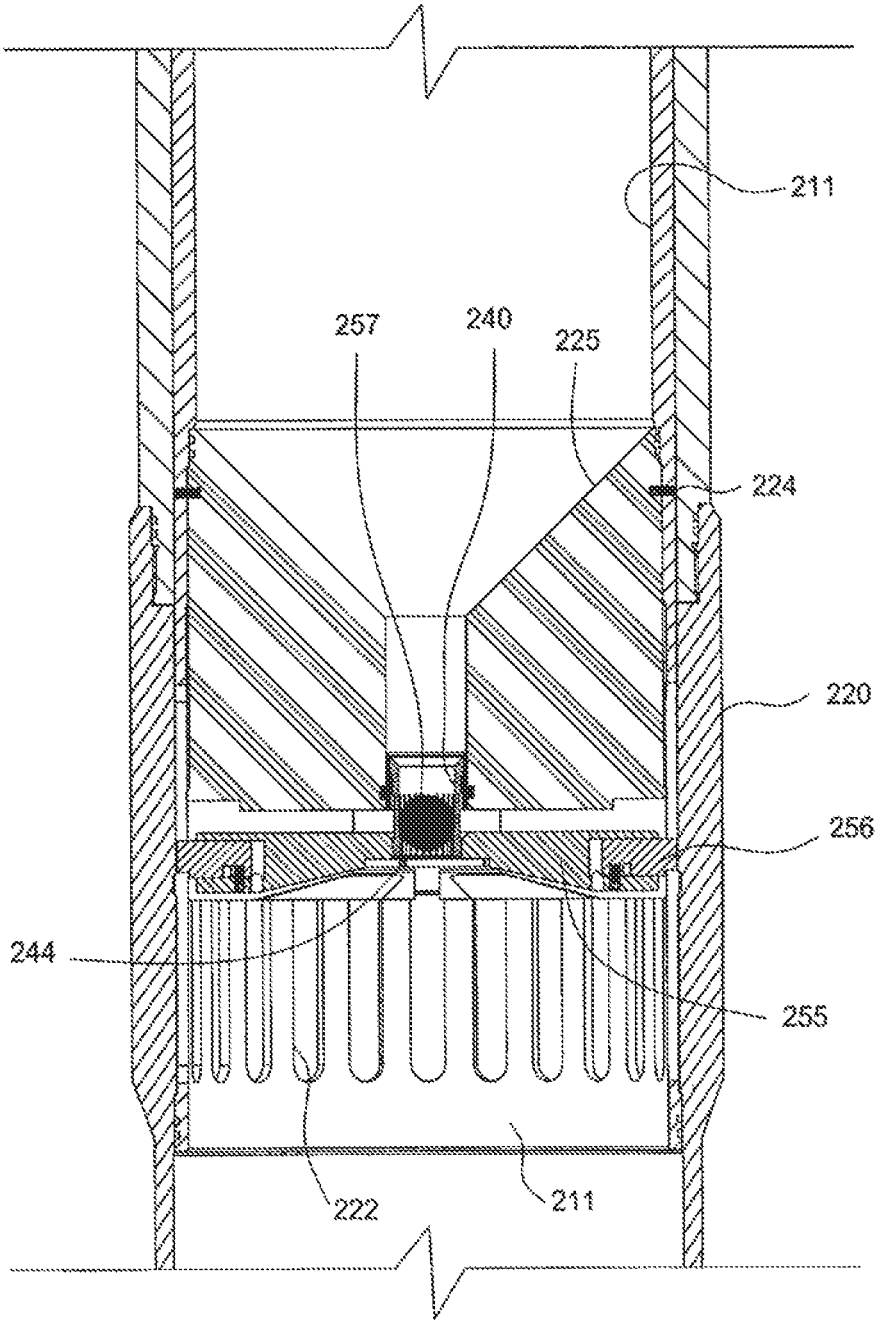
Figure 14:
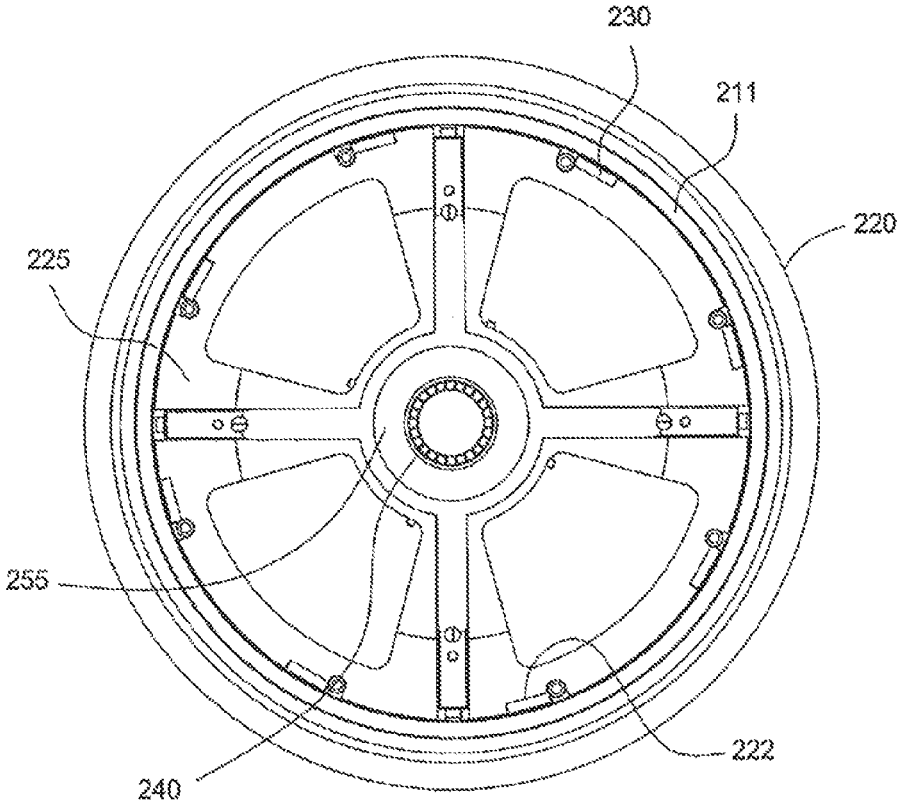

FIGS. 13-18 show different views of the retractable joint 250. FIG. 13 is an enlarged partial view of the telescoping portion. FIG. 14 is a bottom view of the telescoping portion. In this embodiment, the upper telescoping casing 211 has elongated axial grooves 222 circumferentially spaced around its lower end overlapping the retraction sub 220. A shear sleeve 225 is disposed in and releasably connected to the upper telescoping casing 211 using one or more shearable connections 224 (see FIG. 16), for example, shear pins. The shear sleeve 225 is equipped with one or more keys 230 (see FIG. 17) adapted to move in a respective axial groove 222 of the upper telescoping casing 211 The keys 230 prevent the shear sleeve 225 from rotating relative to the upper telescoping casing 211, which facilitates the drill out of the shear sleeve 225. The shear sleeve 225 includes a collet 240 for receiving a ball 257 or a segmented ball seat. The fingers of the collet 240 are retained using a collet retainer 255. A second set of shear pins 244 releasably connect the collet 240 to the collet retainer 255. The collet retainer 255 includes a hole for receiving the collet fingers and sized to prevent radial expansion thereof. The collet retainer 255 has extension members 256 that travel in the axial grooves 222.

Figure 15:
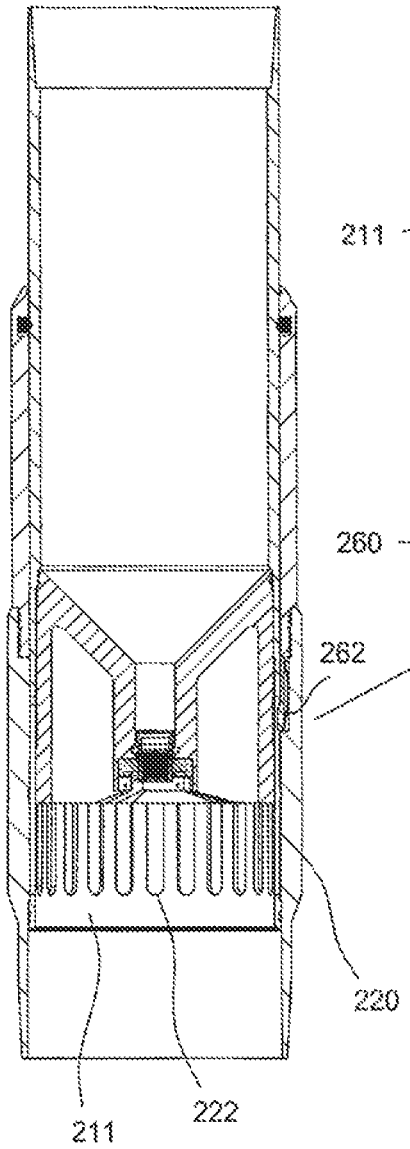
Figure 15A:
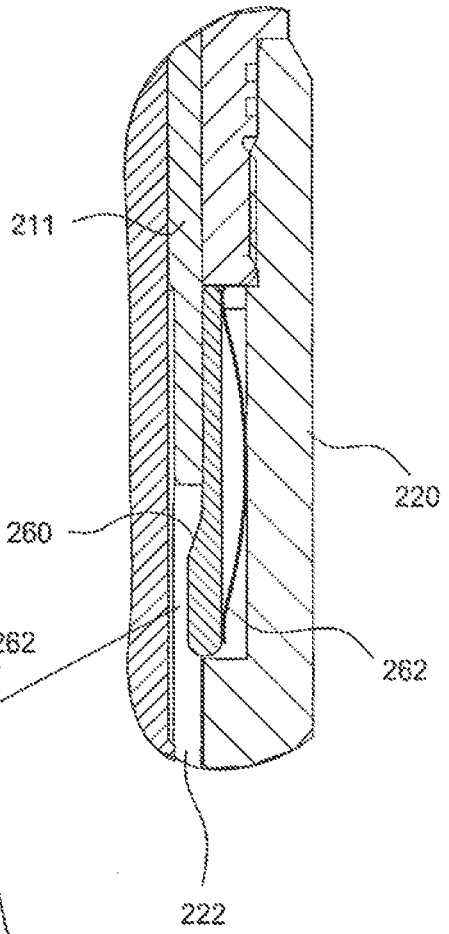
FIGS. 15A-C are different views of the telescoping portion showing the features for transferring torque.
Figures 15B, 15C:
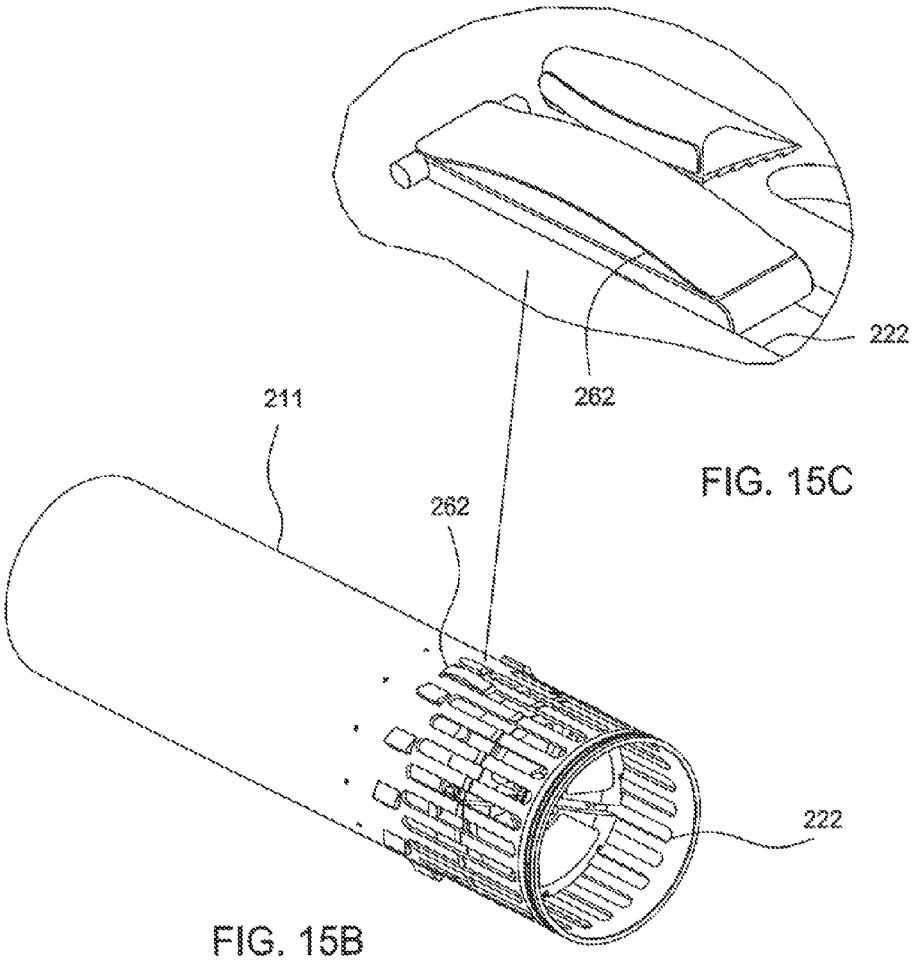
Figures 16A, 16B:
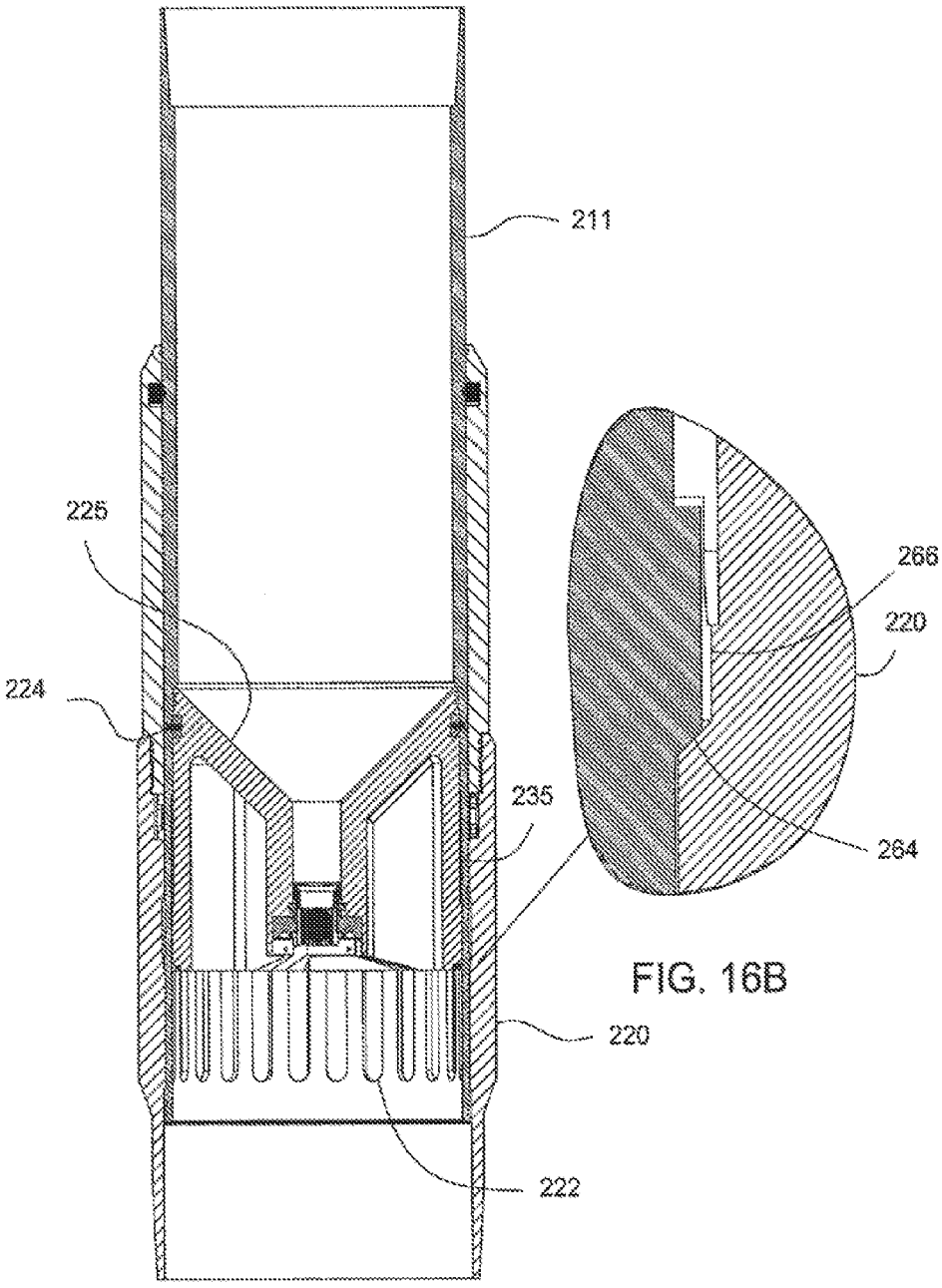
FIGS. 16A-B are different views of the telescoping portion showing the features for transferring axial load.
Figure 17:
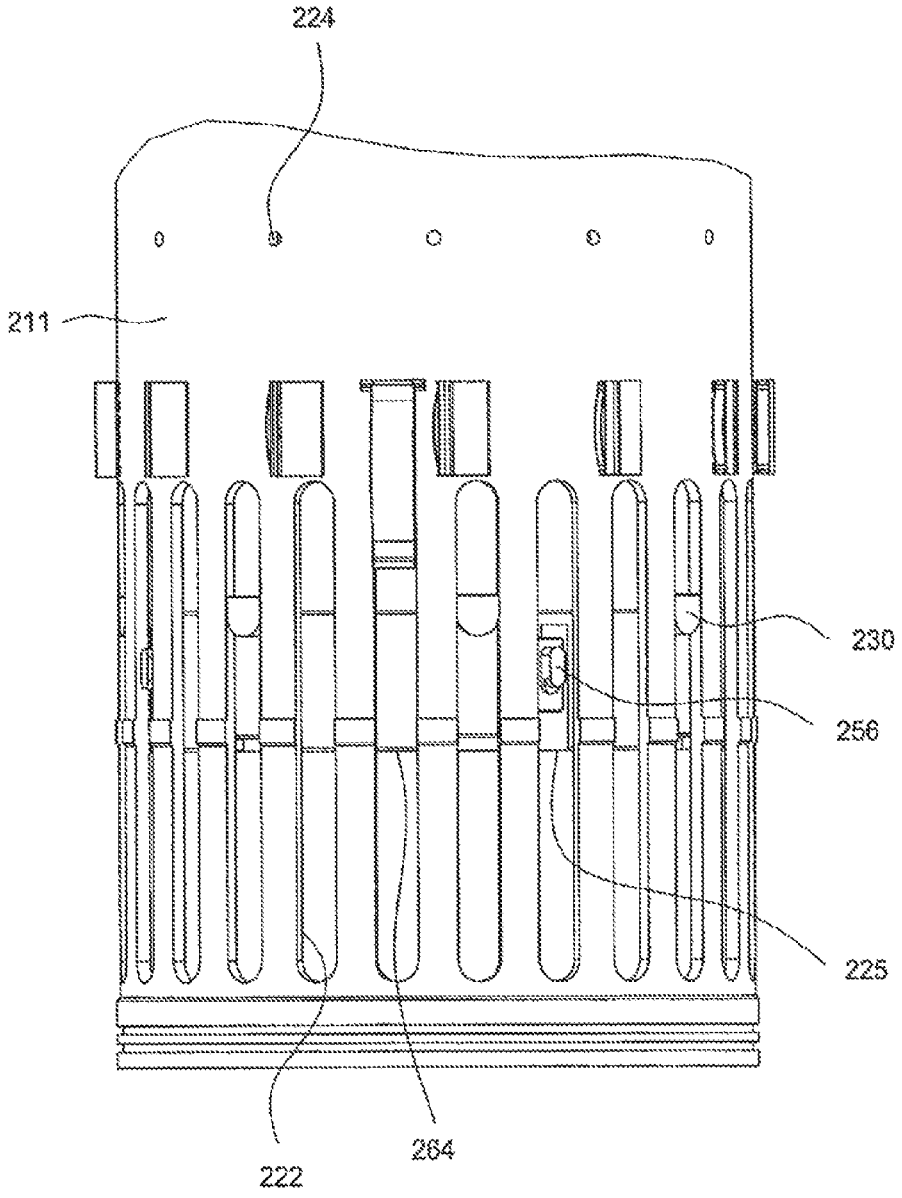

FIGS. 15-17 show the transfer of torque and axial load between the upper telescoping casing 211 and the retraction sub 220. As shown in the enlarged view of FIGS. 15A-B, the upper telescoping casing 211 has torque keys 260 positioned between the upper telescoping casing 211 and the retraction sub 220. The torque keys 260 may include a biasing member 262 biased against the retraction sub 220. To transfer axial load, the upper telescoping casing 211 includes a shoulder 264 engageable with a circumferential groove 266 in the retraction sub 220, as illustrated in FIG. 16. In the run-in position, the shear sleeve 225 presses against the tabs on the upper telescoping casing 211 to prevent disengagement from the groove 266. To release the shoulder 264, the shear sleeve 225 must be moved downward such that a circumferential recess 235 formed on the outer surface is positioned adjacent the shoulder 264, thereby allowing the shoulder to deflect inward to disengage from the groove 266. The upper telescoping casing 211 may have an upwardly facing shoulder adapted to engage a downward facing shoulder of the retraction sub during tensile axial loading. The retractable joint 250 may further include anti-rotation features including one or more slips as described in the embodiment shown in FIG. 2.

Figure 18:
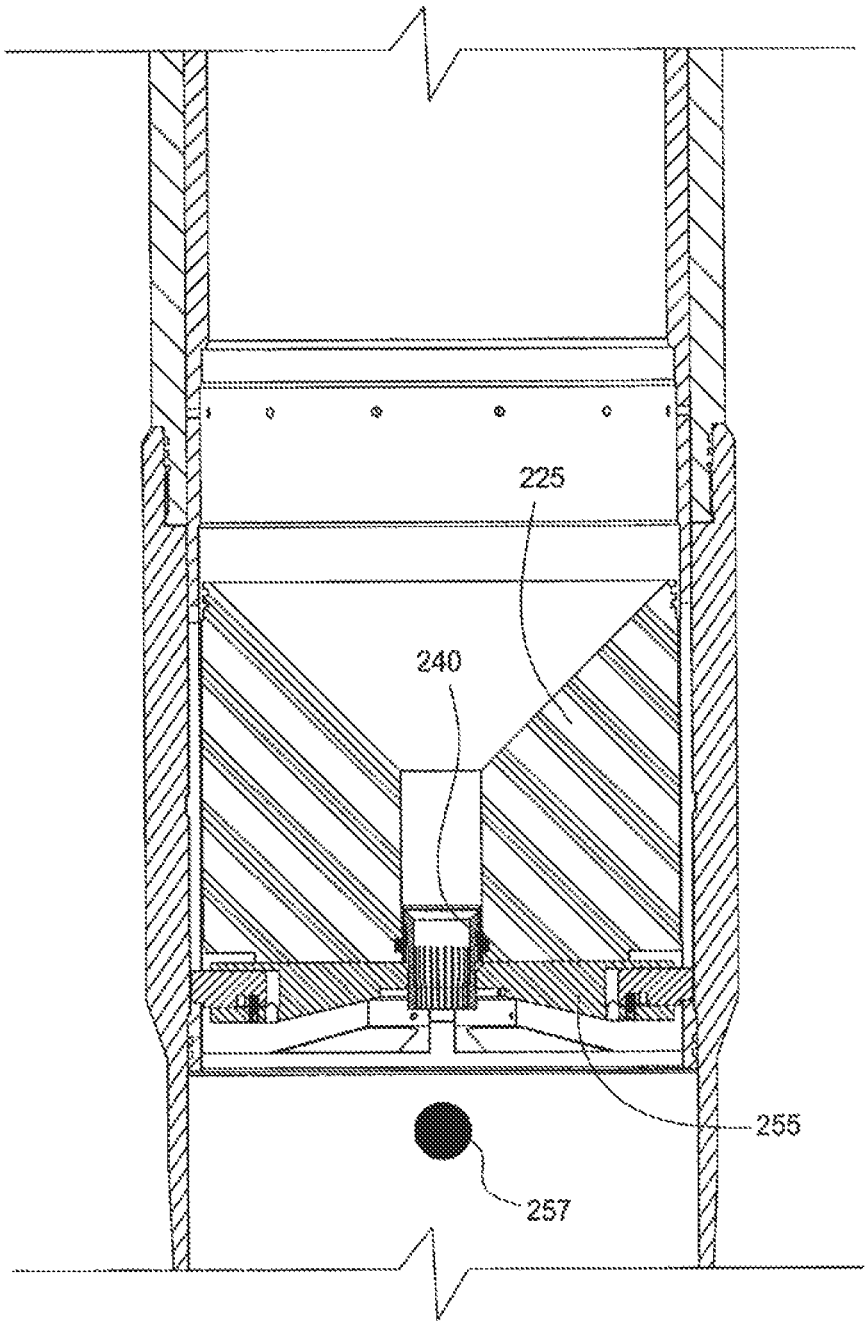

FIG. 17 is a partial perspective view of the upper telescoping casing 211, prior to activation. In operation, a pressure activating device such as a ball 257 is dropped from the surface and initially lands in the collet 240, thereby closing the fluid path. Pressure is increased until the shear pins 224 are broken and the shear sleeve 225 is free to move downward. The shear sleeve 225 travels downward until the keys 230 reach the end of the grooves 222. Continued pressure causes the shear pins holding the collet 240 to break, thereby allowing the collet retainer 255 to move upward relative to the collet fingers, as shown in FIG. 18. In this respect, the collet fingers are allowed to expand, thereby releasing ball 257 from the collet 240. The ball 257 then lands in the circulation sub 60 and the circulation sub 60 may be activated as described above. After circulation is re-established, the earth removal member 25 is returned to total depth and weight on bit is applied to retract the retractable joint 250.

Figure 19A:
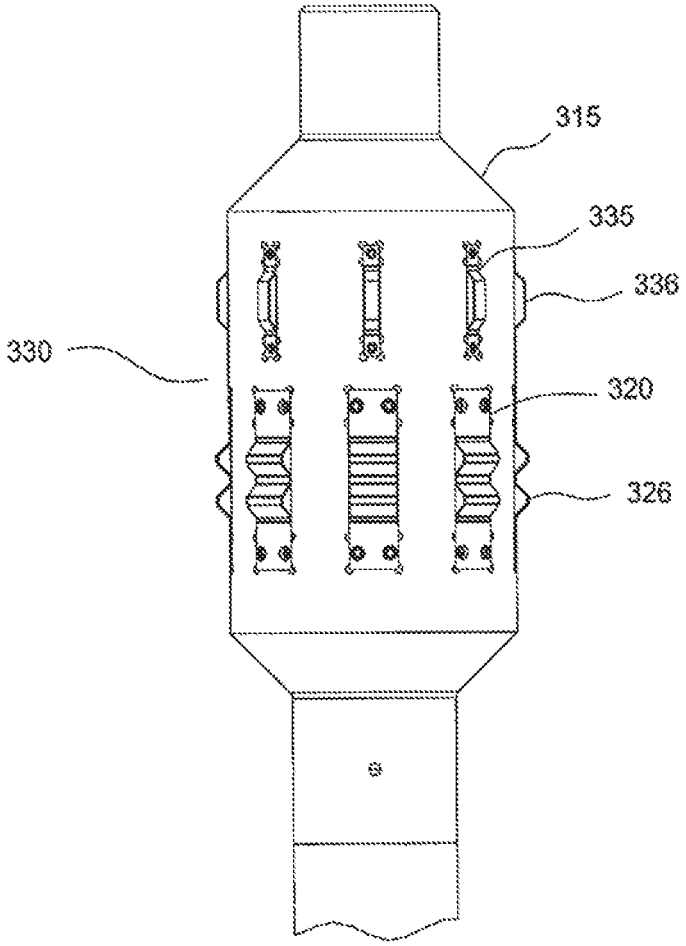
FIGS. 19A-C show an exemplary embodiment of a running tool and setting sleeve suitable for use with the drilling system.
Figure 19B:
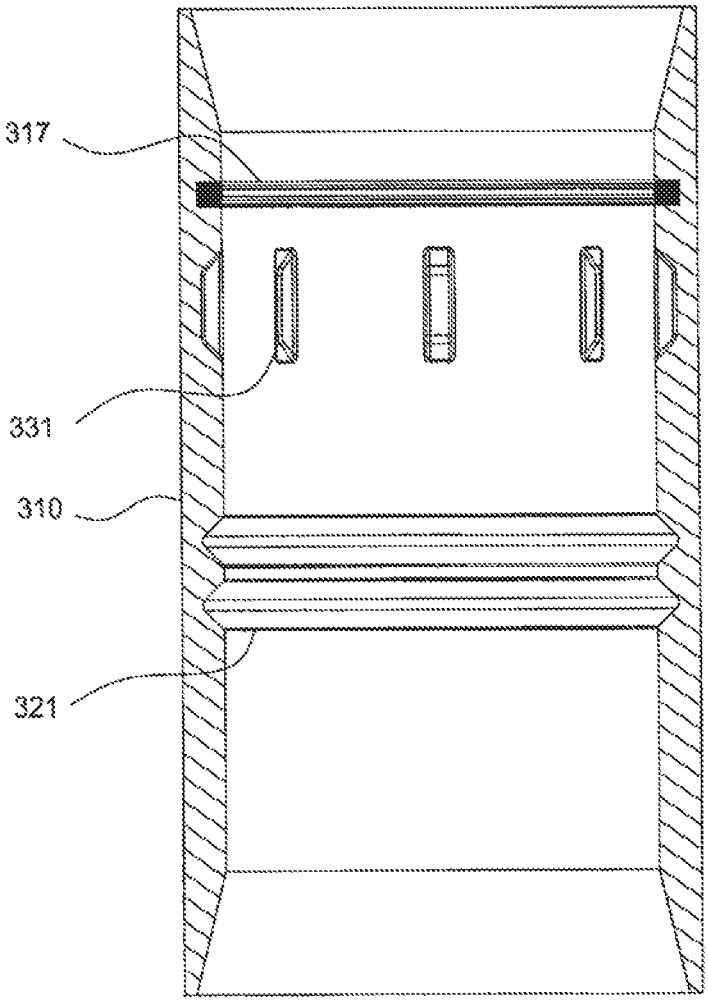
Figure 19C:
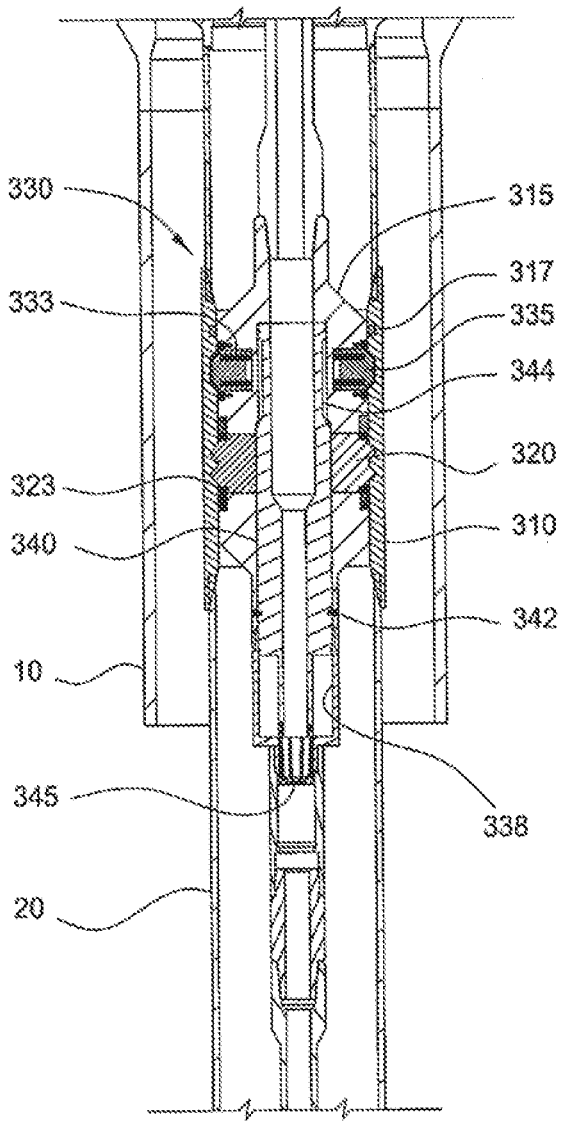

FIGS. 19A-C show an exemplary embodiment of a running tool 330 suitable for use with the drilling system 100. The running tool 330 is adapted to releasably engage a setting sleeve 310 connected to the casing string 20. One or more seals 317 may be positioned between the setting sleeve 310 and the running tool 330 to seal off the interface. In this embodiment, the seal 317 is located on the setting sleeve 310. The running tool 330 includes a running tool body 315 having one or more engagement members such dogs, clutch, or tabs. In one embodiment, the running tool 330 includes axial dogs 320 spaced circumferentially in the running tool body 315 for transferring axial forces to the setting sleeve 310. The axial dogs 320 may include one or more horizontally aligned teeth 326 that are adapted to engage an axial profile 321 such as a circular groove in the setting sleeve 310. The axial dogs 320 may be biased inwardly using a biasing member 323 such as a spring. The axial dogs 320 are retained in the locked position using an inner mandrel 340 disposed in the bore 338 of the running tool body 315. The running tool 330 may optionally include one or more torque dogs 335 spaced circumferentially in the running tool body 315 for transferring torque to the setting sleeve 310. The torque dogs 335 may include one or more axially aligned teeth 336 that are adapted to engage corresponding torque profiles 331 in the setting sleeve 310. The torque dogs 335 may be biased outwardly using a biasing member 333 such as a spring. It must be noted that the axial and torque dogs may be configured to be biased inwardly or outwardly. In one embodiment, the profiles of the teeth 326, 336 of the dogs 320, 335 may be configured to facilitate retraction. In one embodiment, the upper and lower ends of the teeth 326, 336 may be angled to facilitate retraction as the running tool 330 is moved axially. In the embodiment shown, the torque dogs 335 are positioned above the axial dogs 320. However, it must be noted that the axial dogs 320 may be positioned above the torque dogs 335; interspaced between one or more torque dogs; or positioned in any other suitable arrangement.

FIG. 19C shows the running tool 330 engaged with the setting sleeve 310. In this position, the inner mandrel 340 is positioned behind the axial dogs 320 to maintain engagement of the axial dogs to the axial profiles 321. The inner mandrel 340 is releasably connected to the running tool body 315 using a shearable connection such as shear pins 342. The upper end of the inner mandrel 340 has a recessed dog seat 344 formed around its outer surface. The lower end of the inner mandrel 340 has a collet 345 for receiving a ball or other activating device such as a dart or standing valve. In another embodiment, the lower end may include a ball seat or other suitable pressure activating device. In one example, the ball seat may be an expandable ball seat or a seat for an extrudable ball for passing the ball after activation.

Figure 20:
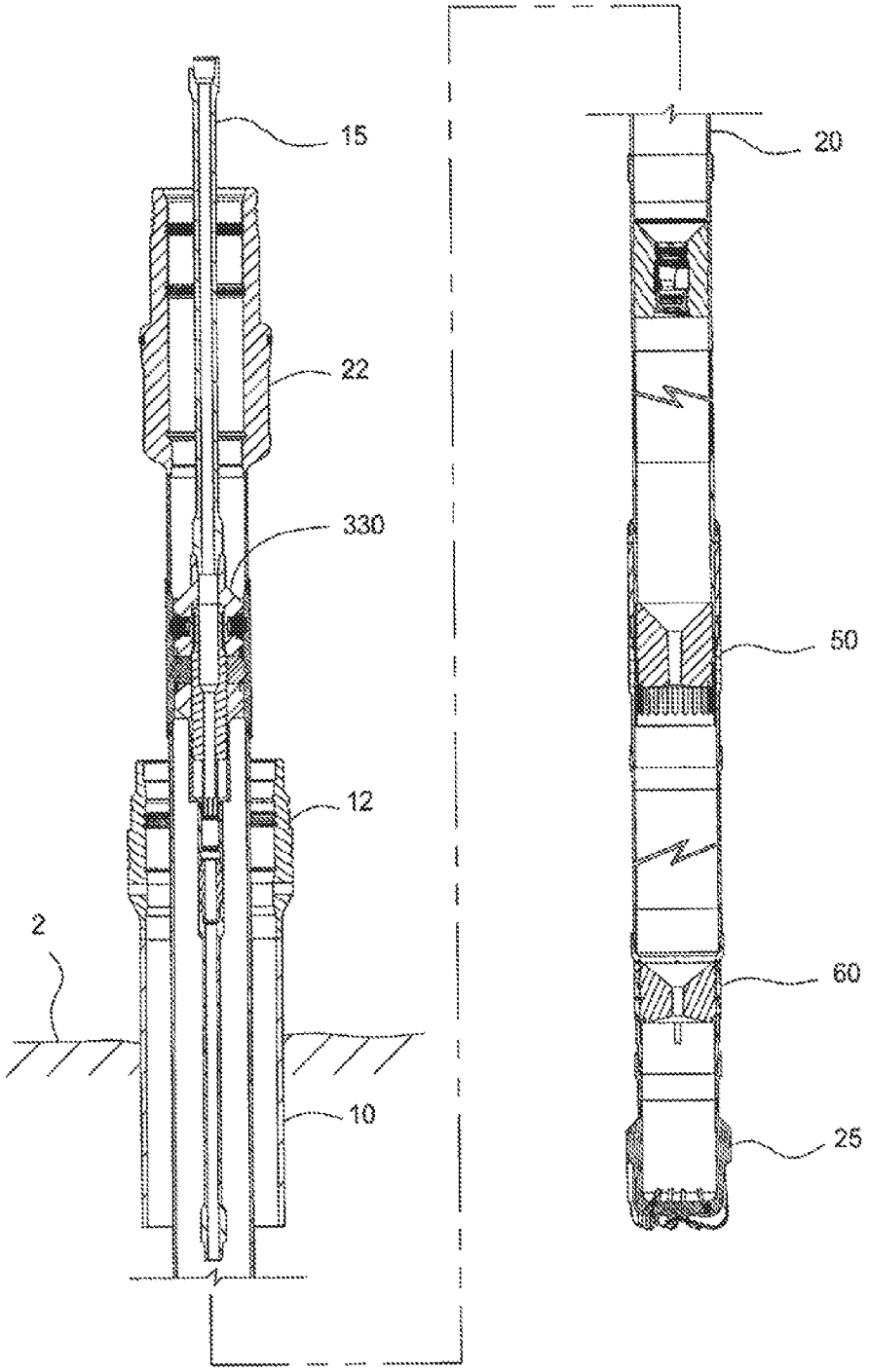
FIG. 20 shows an exemplary drilling system.

In operation, the running tool 330 may be used to convey a casing string 20 into the wellbore by engagement of the running tool 330 to the setting sleeve 310. The casing string 20 may include a retractable joint 50 and a circulation sub 60 as described above. Initially, a conductor pipe 10 equipped with a low pressure wellhead 12 is landed on the sea floor 2. A guide base may be used to support the conductor pipe 10 on the sea floor. The conductor pipe 10 is jetted and/or drilled into the sea floor to the desired depth. The conductor pipe 10 is allowed to "soak" or remain stationary until the formation re-settles around the conductor pipe 10 to support the conductor pipe 10 in position. Alternatively, the conductor pipe 10 may be cemented in position. Thereafter, the casing string 20 is coupled to the running tool 330 and conveyed into the conductor pipe 10 using a drill string 15, as shown in FIG. 20. The casing string 20 and the earth removal member 25 are then rotated to extend the wellbore.

Figure 21:
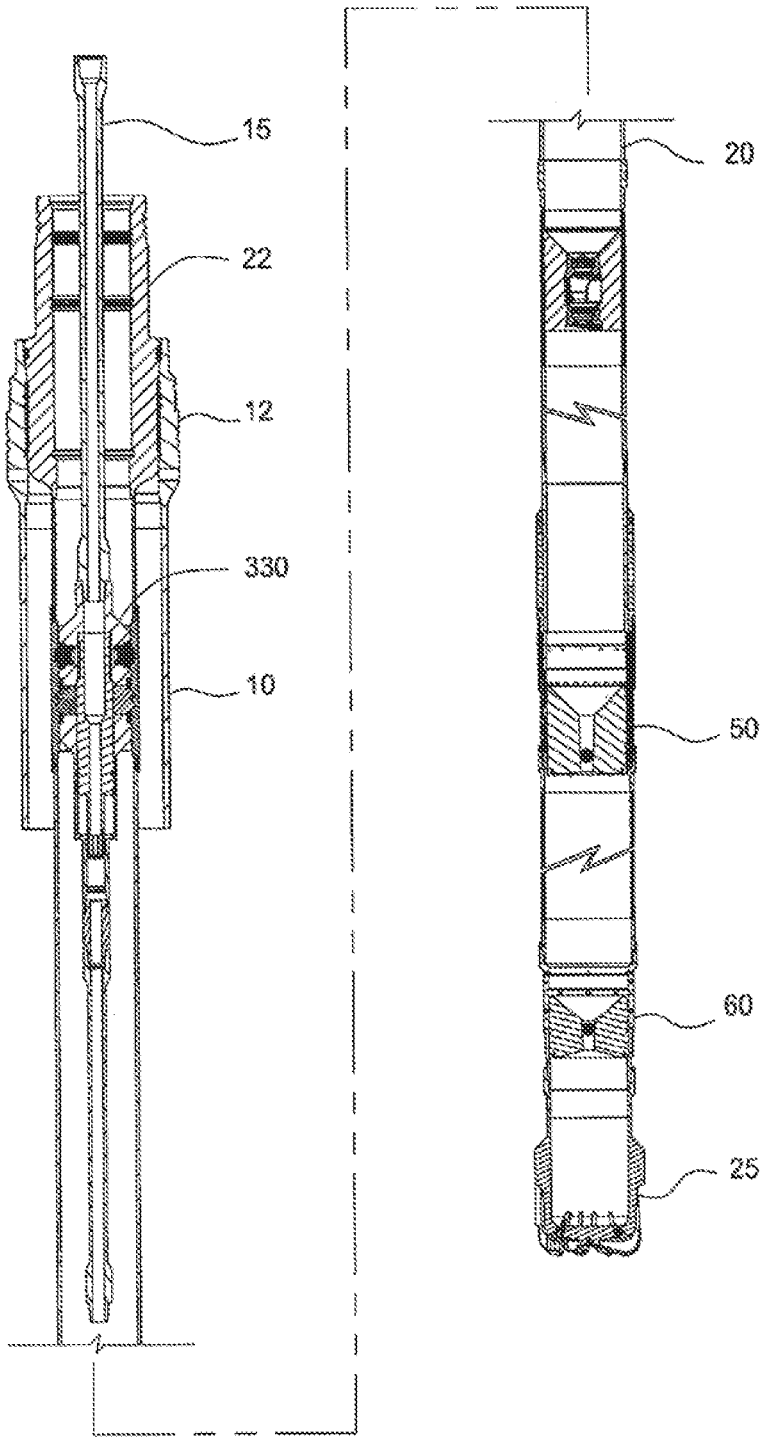
FIG. 21 shows the drilling system of FIG. 20 after the high pressure wellhead is landed in the low pressure wellhead.

In another embodiment, the conductor pipe 10 may be releasably attached to the casing string 20 and simultaneously positioned into the sea floor. After jetting the conductor pipe 10 into position, the formation is allowed to re-settle and support the conductor pipe 10. The casing string 20 is then released from the conductor pipe 10 and rotated to extend the wellbore. After drilling to the desired depth, a first ball is dropped to activate the circulation sub 60 and establish a fluid path through a side port in the circulation sub 60, as described previously with respect to FIG. 10. Then, a second ball is dropped to activate the retractable joint 50, as described previously with respect to FIGS. 3 and 11. An axial compressive load is applied to shorten the length of the casing string 20 through telescopic motion of the upper telescoping casing 211 and the lower telescoping casing 232 of the retractable joint 50 until the high pressure wellhead 22 has landed in the low pressure wellhead 12. FIG. 21 shows the lower portion of the casing string wherein the retractable joint has retracted and the side ports in the circulation sub 60 opened for fluid communication. FIG. 21 also shows the high pressure wellhead 22 landed in the low pressure wellhead 12.

Figure 22A:
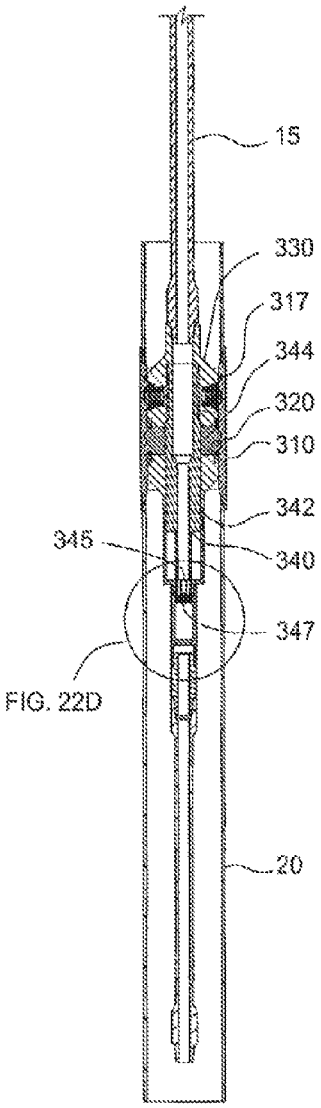
FIGS. 22A-F shows the sequential operation of the running tool in the drilling system of FIG. 20.
Figure 22D:
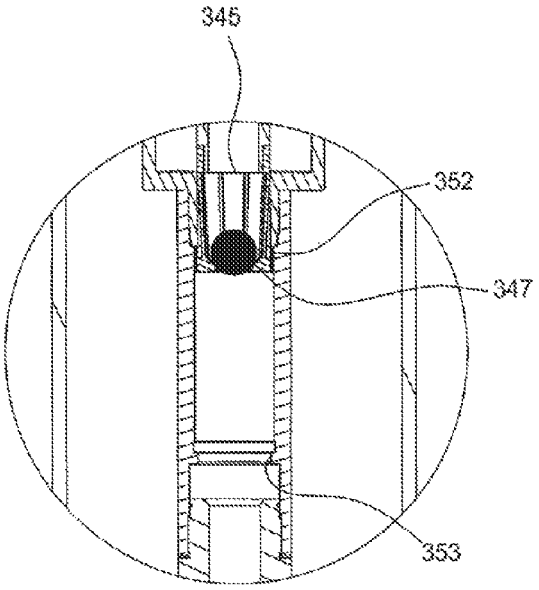
Figure 22B:
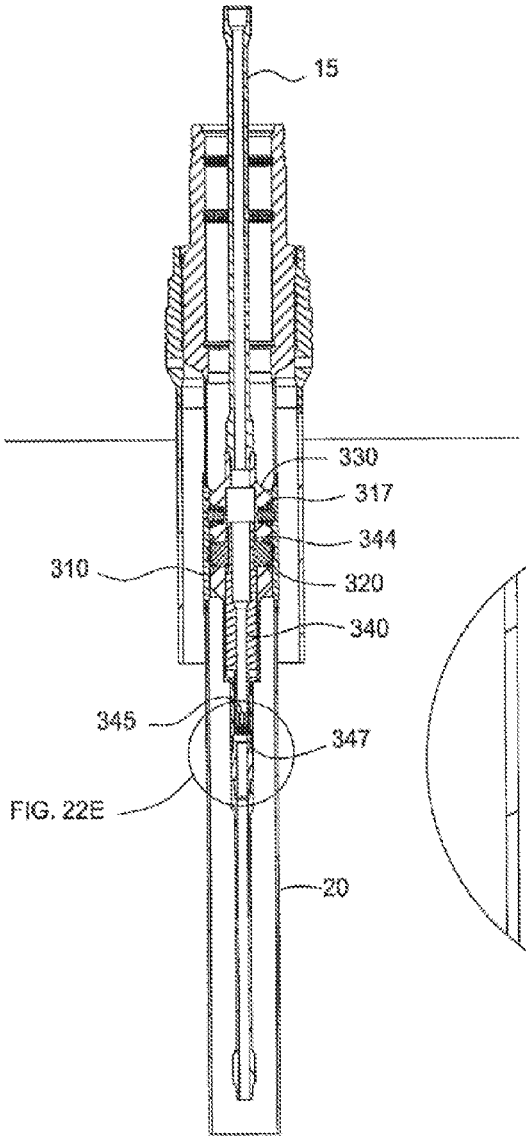
Figure 22E:
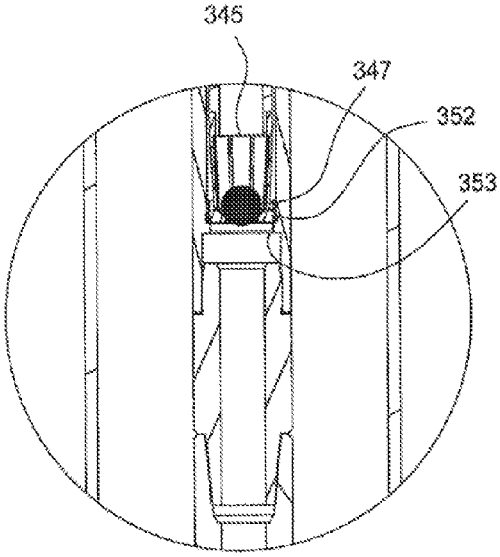
Figure 22C:
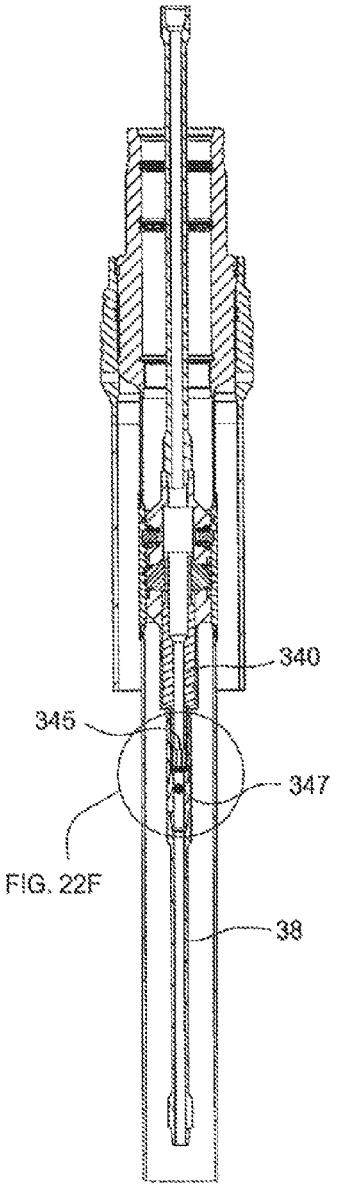
Figure 22F:
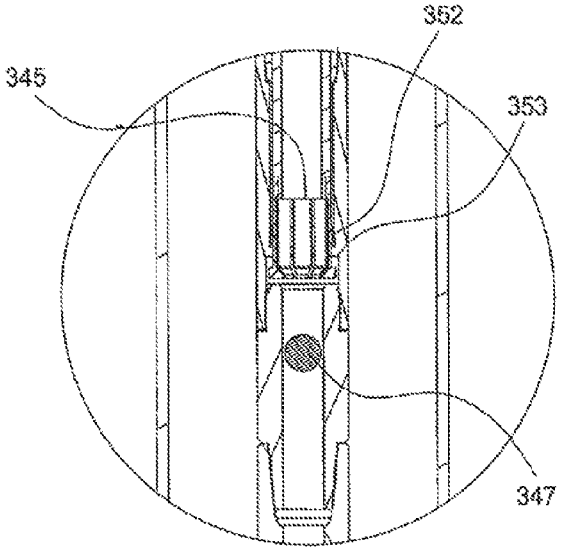
Figure 22G:
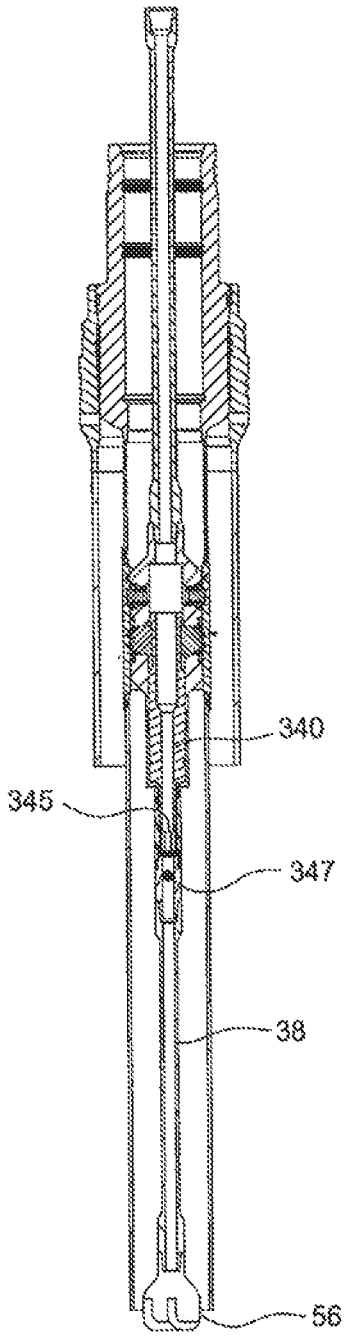
FIG. 22G shows another embodiment of a drilling system equipped with an earth removal member attached to an inner string.
Figure 23:
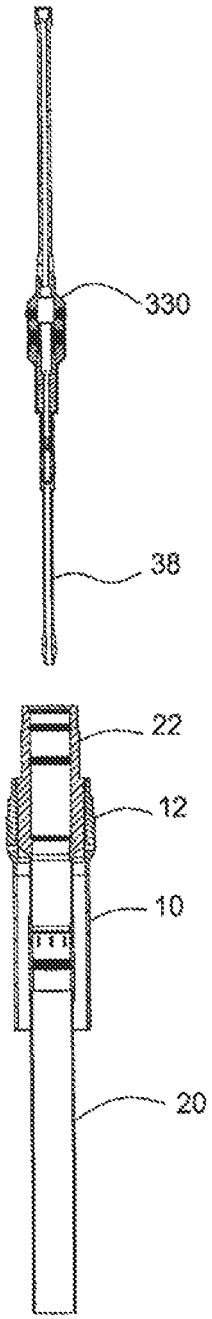
FIG. 23 shows the running tool pulled out of the casing string.

After landing the high pressure wellhead 22, the running tool 330 may be released from engagement with the casing string 20. Referring now to FIG. 22A, a ball 347 or other pressure activating device is dropped to land into the collet 345, ball seat or other pressure activating device to close the fluid path. In one embodiment, the collet 345 is disposed in a collet cap 352, as illustrated in FIG. 22D. The collet cap 352 has low friction exterior surfaces to facilitate movement along the inner surface of the bore. Pressure is increased to shear the pins 342 and allow the inner mandrel 340 to shift downward. The inner mandrel 340 moves downward until the recessed dog seats 344 are adjacent the axial dogs 320, thereby allowing the axial dogs 320 to disengage from the setting sleeve 310, as shown in FIG. 22B. The collet 345 and collet cap 352 are moved downward by the inner mandrel 340 until the collet cap 352 abuts a restriction 353 in the bore, as shown in FIG. 22E. Continued pressure causes the collet 345 to move out of the collet cap 352 and slide past the restriction 353 into an enlarged bore section. As shown in FIGS. 22C and 22F, the enlarged bore section allows the collet fingers to expand, thereby releasing the ball 347 from the collet 345. After disengagement, the running tool 330, along with any connected components such as an inner string, may be retrieved to surface. The casing string 20 may be cemented before or after the running tool 330 is retrieved. The cement may be supplied through the inner string 38. Alternatively, subsea release plugs, such as those described in U.S. Pat. No. 5,553,667, which is incorporated herein by reference, may be used for cementing with or without the inner string 38. FIG. 23 shows the running tool 330 and the attached inner string pulled out of the casing string 20. In addition, the casing string 20 has been disposed inside the conductor casing 10 and the high pressure wellhead 22 has landed in the low pressure wellhead 12. In another embodiment, the inner string 38 may be equipped with an earth removal member 56 prior to run-in, as illustrated in FIG. 22G. After releasing the running tool 330, the drill string 15 may be used to drill ahead by rotating the earth removal member 56.

Figure 24A:
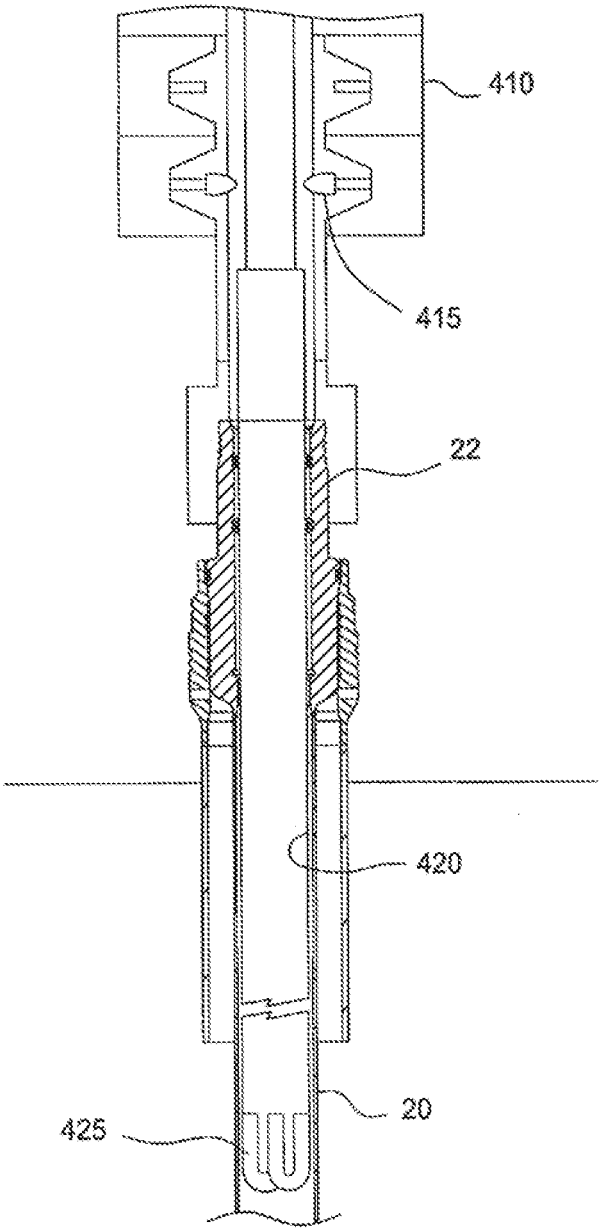
FIGS. 24A-C show a sequential process of drilling through a surface casing string.
Figure 24B:
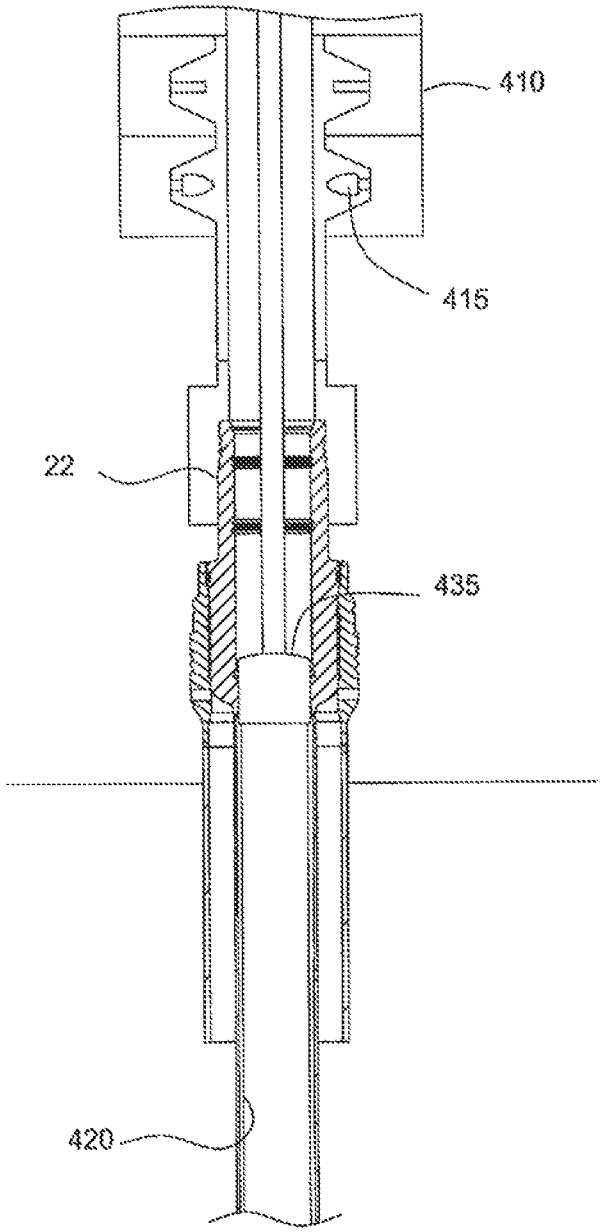
Figure 24C:
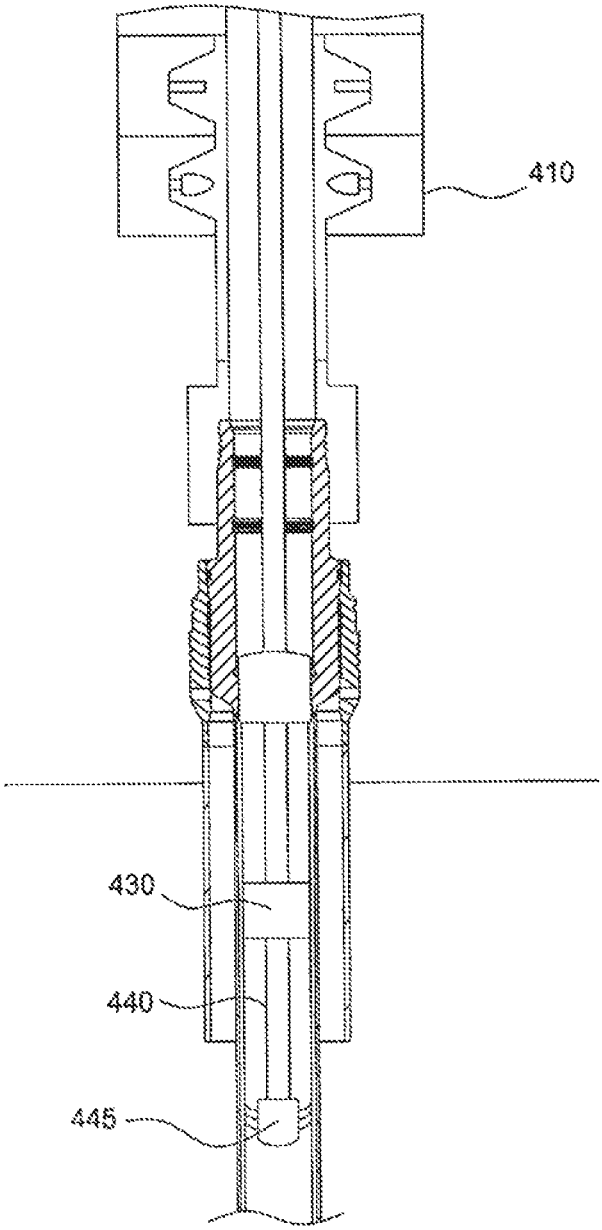

In another embodiment, a second casing string 420 may be used to extend the wellbore beyond casing string 20. Referring to FIG. 24, after the running tool 330 has been retrieved, a blowout preventer 410 is connected to the high pressure wellhead 22. The second casing string 420 may include an earth removal member 425, a retractable joint, a circulation sub, a float collar, and a running tool for coupling the second casing string 420 to a drill string. In one embodiment, the second casing string 420 may include a hanger 435 at its upper end for landing in the wellhead 22. In another embodiment, the second casing string 420 may include a liner hanger at its upper end for gripping a lower portion of the first casing string 20. During run-in or drilling, one or more rams 415 of the blow out preventor 410 may be used in a centralizing manner to prevent the second casing string 420 from contacting or damaging the inner surface of the wellhead 22 and/or the inner diameter of the blowout preventer stack and associated components. Prior to landing in the wellhead 22, drilling is stopped and the rams 415 are opened. In one example, the earth removal member 425 may have displaceable blades to facilitate drill out. Balls may then be dropped to sequentially activate the circulation sub and the retractable joint. In another embodiment, the upper telescoping casing and the lower telescoping casing may be coupled using shearable pins. An axial compressive load is applied to shorten the length of the second casing string 420 via a retractable joint until the casing hanger 435 at the upper end of the second casing string 420 has landed in the high pressure wellhead 22, as illustrated in FIG. 24B. Thereafter, the running tool 430 is released by dropping a ball or other activating device and increasing pressure to shift the inner mandrel to unlock the axial and/or torque dogs. FIG. 24C is a partial schematic view showing a running tool 430 disposed inside the second casing string 420. In one embodiment, the running tool 430 is released before cementing. To facilitate the cementing operation, the inner string 440 below the running tool 430 may include a subsea release plug 445. After supplying the cement to the wellbore, a dart is released to land in the subsea plug 445 to cause the release thereof. Thereafter, the drill string and the running tool 440 are retrieved.

Figure 25A:
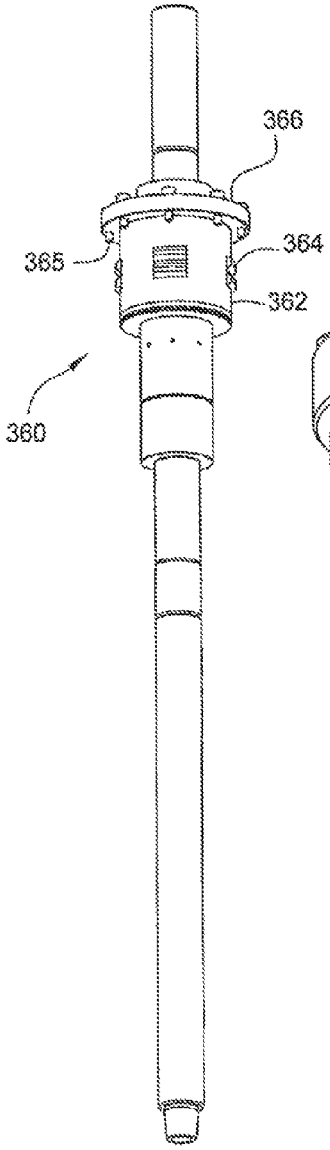
FIGS. 25A-B illustrate another embodiment of a running tool.
Figure 25B:
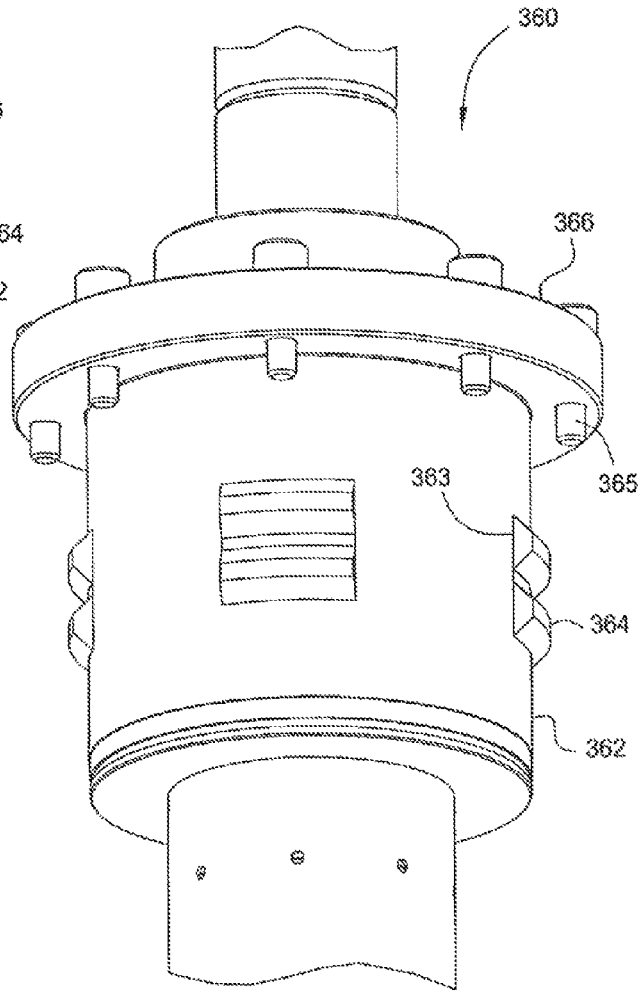

FIGS. 25A-B illustrate another embodiment of a running tool 360. In this embodiment, the running tool 360 is adapted to engage a wellhead, for example, a high pressure wellhead. FIG. 25B is a partial enlarged view of FIG. 25A. The running tool 360 includes a tubular body 362 having one or more engagement members disposed in a window 363 in the tubular body 362. As shown, axial dogs 364 protrude out of the windows 363 and are circumferentially spaced around the tubular body 362. In this example, four axial dogs 364 are used. One or more torque pins 365 extend below a flange 366 at an upper portion of the running tool 360. The torque pins 365 can be inserted into an aperture 367 formed on top of the wellhead 370, as shown in FIG. 26A. In another embodiment, the flange 366 may be coupled to the wellhead 370 using corresponding splines, castellations, or other suitable torque carrying geometric features.

Figure 26B:
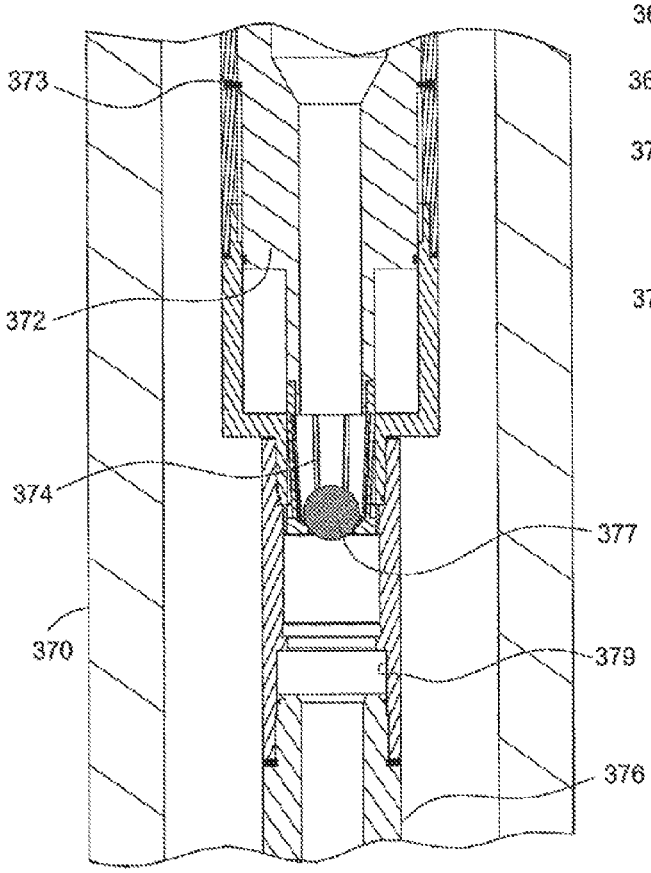
FIGS. 26A-B are cross-sectional views of the running tool of FIG. 25 in the engaged position.
Figure 26A:
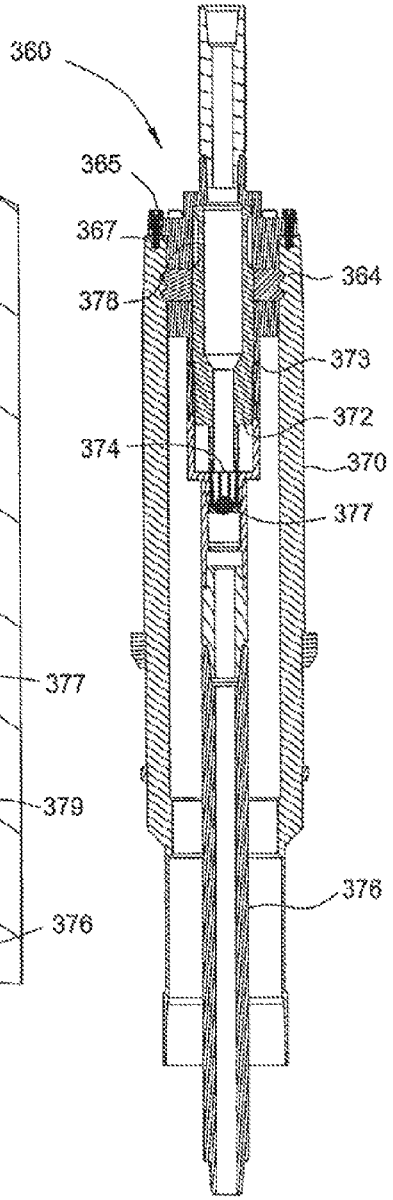

FIGS. 26A-B are cross-sectional views of the running tool 360 in the engaged position. An inner mandrel 372 is disposed inside the bore of the running tool 360 and is adapted to keep the axial dogs 364 engaged with the axial profile in the wellhead 370. The inner mandrel 372 is releasably connected to the running tool body 362 using a shearable connection such as shear pins 373. The upper end of the inner mandrel 372 has a recessed dog seat 378 formed around its outer surface. The lower end of the inner mandrel 372 has a collet 374 for receiving a ball 377 or other activating device. An enlarged bore section 379 is provided below the collet 374. Attached below the enlarged bore section 379 is an inner string 376.

Figure 27A:
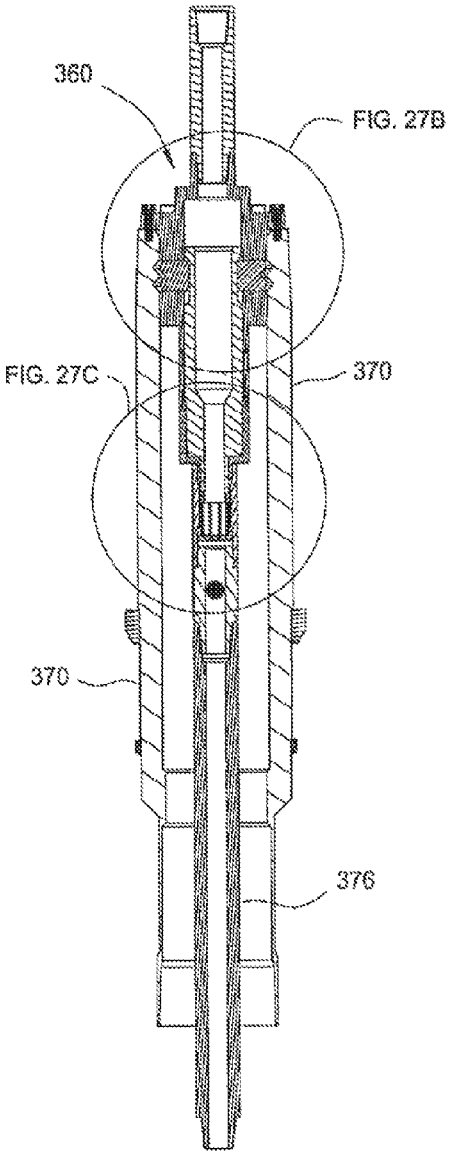
FIGS. 27A-C are cross-sectional views of the running tool of FIG. 25 in the disengaged position.
Figure 27B:
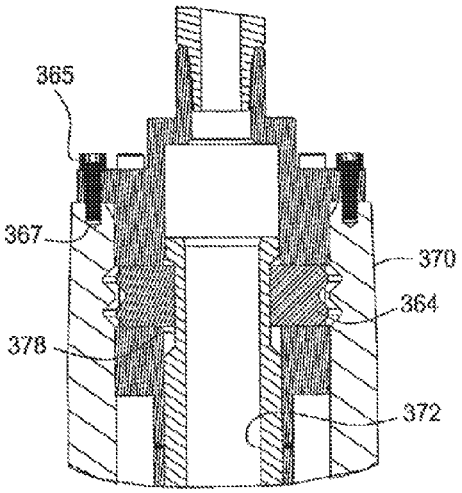
Figure 27C:
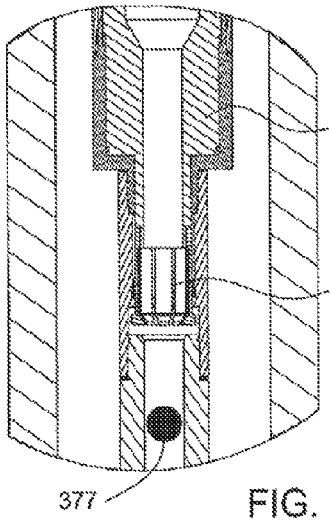

In operation, a ball 377 is dropped into the drill string and lands in the collet 374. Pressure is increased to shear the pins 373 and cause the inner mandrel 372 to shift downward. The inner mandrel 372 is shifted until the recessed dog seats 378 are adjacent the axial dogs 364, thereby allowing the axial dogs 364 to disengage from the wellhead 370, as shown in FIGS. 27A-C. In addition, the collet 374 has shifted to a position adjacent an enlarged bore section 379. In this respect, the collet fingers are allowed to expand and release the ball 377 from the collet 374. After disengagement, the running tool 360, along with any connected components, may be retrieved to surface.

Figure 27D:
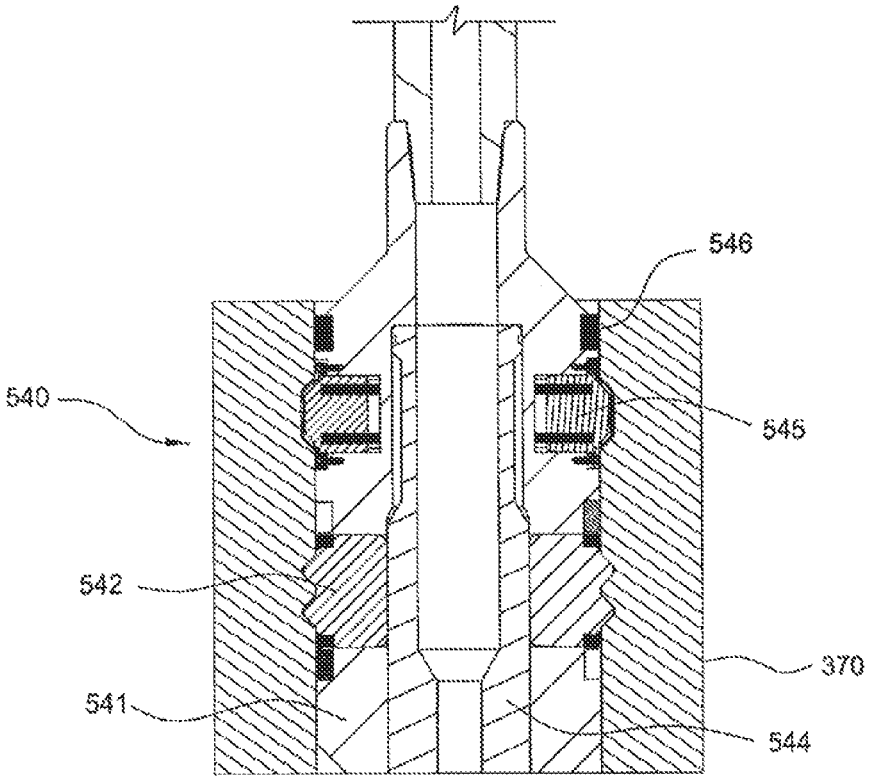
FIG. 27D is a cross-sectional view of another embodiment of a running tool adapted to engage the wellhead.

FIG. 27D is a cross-sectional view of another embodiment of a running tool 540 adapted to engage the wellhead 370. One or more seals 546 may be positioned between the running tool 540 and the wellhead 370. The running tool 540 includes a running tool body 541 having one or more engagement members such dogs, clutch, or tabs. The running tool 540 includes axial dogs 542 for engaging an axial profile in the wellhead 370. The axial dogs 542 may be biased inwardly using a biasing member such as a spring. The axial dogs 542 are retained in the locked position using an inner mandrel 544 disposed in the bore of the running tool body 541. The running tool 540 also includes one or more torque dogs 545 for engaging a corresponding torque profile in the wellhead 370. In this respect, axial and torsional forces may be transferred between the running tool 540 and the wellhead 370. The torque dogs 545 may be biased outwardly using a biasing member such as a spring. It must be noted that the axial and torque dogs may be configured to be biased inwardly or outwardly to facilitate retraction. In the embodiment shown, the torque dogs 545 are positioned above the axial dogs 542. However, it must be noted that the axial dogs 542 may be positioned above the torque dogs 545; interspaced between one or more torque dogs; or positioned any other suitable arrangement. It is further noted that the same axial dog or torque dog may provide both axial and torque load transfer. To that end, it is further contemplated that one or more profiles in the high pressure wellhead may transmit both axial and torque loading.

It is contemplated that torque dogs and axial dogs or other suitable axial load and torque carrying geometric features may be adapted to engage the inner surface, outer surface, and/or the top of the wellhead 370 to transfer torque and axial load therebetween. In another embodiment, a wellhead retrieval tool, which engages the inner and/or outer surface of the wellhead may be adapted to perform this role as a running tool.

To release the running tool 540, a ball is dropped to close the fluid path through the running tool 540. Pressure is increased to cause the inner mandrel 544 to shift downward. The inner mandrel 544 moves downward until the recessed dog seats are adjacent the axial dogs 542, thereby allowing the axial dogs 542 to disengage from the wellhead 370. The torque dogs 542 release upon application of axial forces, such as during retrieval of the running tool 540.

Figure 28:
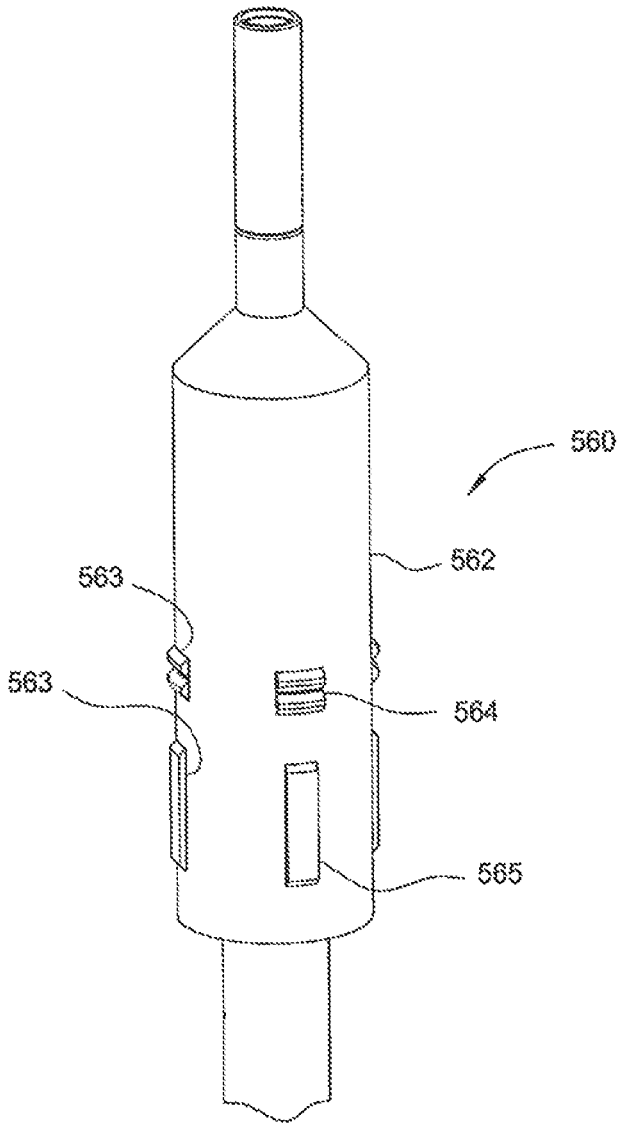
FIG. 28 shows another embodiment of a running tool suitable for use with the drilling system.

FIG. 28 is a perspective view of another embodiment of a running tool suitable for use with the drilling system 100. In this embodiment, the running tool 560 is adapted to engage a setting sleeve. The running tool 560 includes a tubular body 562 having one or more engagement members disposed in a window 563 in the tubular body 562. As shown, axial dogs 564 protrude out of the windows 563 and are circumferentially spaced around the tubular body 562. In this example, four axial dogs 564 are used. One or more torque dogs 565 protrude out of windows 563 and are circumferentially spaced around the tubular body 562. In must be noted any suitable number of axial dogs and torque dogs may be employed, for example, one, two, three, or more of each of axial dogs or torque dogs or combinations thereof.

Figure 29B:
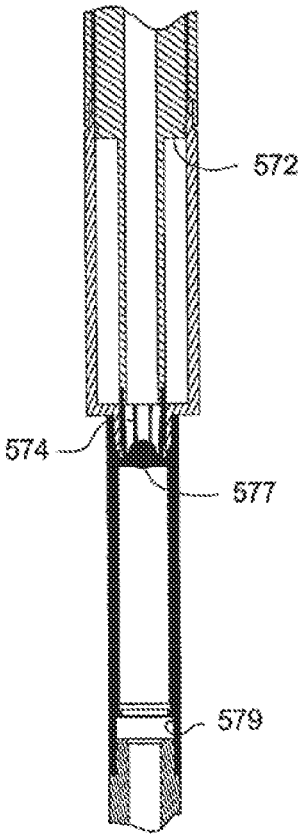
FIGS. 29A-B are cross-sectional views of the running tool of FIG. 28 in the engaged position.
Figure 29A:
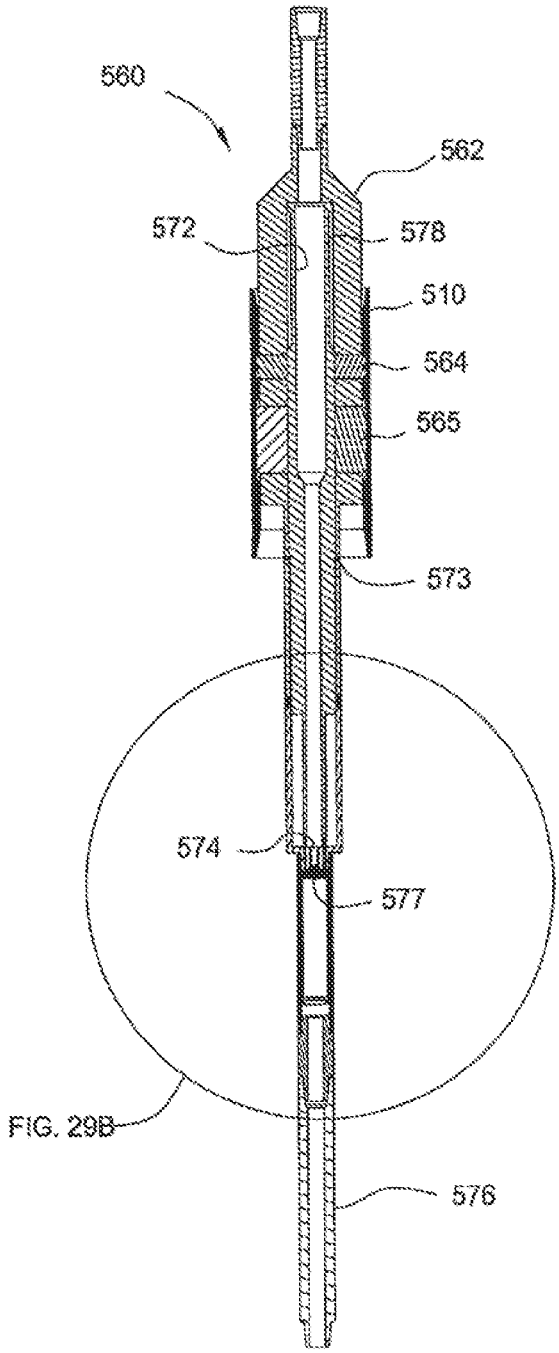

FIGS. 29A-B are cross-sectional views of the running tool 560 in the engaged position. FIG. 29B is a partial enlarged view of FIG. 29A. In FIG. 29A, the running tool 560 is engaged with the setting sleeve 510. The axial dogs 564 and torque dogs 565 engage with corresponding profiles in the setting sleeve 510. The setting sleeve 510 may be disposed between two casing sections. An inner mandrel 572 is disposed inside the bore of the running tool 560 and is adapted to keep the axial dogs 564 and the torque dogs 565 engaged with their corresponding profiles in the setting sleeve 510. The inner mandrel 572 is releasably connected to the running tool body 562 using a shearable connection such as shear pins 573. The upper end of the inner mandrel 572 has a recessed dog seat 578 formed around its outer surface. The recessed dog seat 578 has sufficient length to receive both dogs 564, 565. The lower end of the inner mandrel 572 has a collet 574 for receiving a ball 577 or other activating device. An enlarged bore section 579 is provided below the collet 574. Attached below the enlarged bore section 579 is an inner string 576.

Figure 30A:
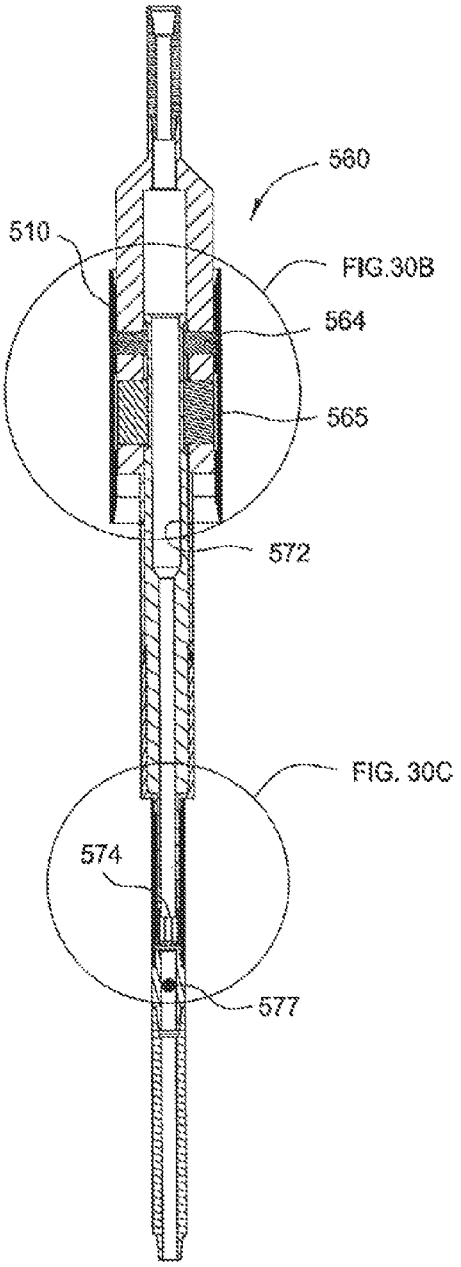
FIGS. 30A-C are cross-sectional views of the running tool of FIG. 28 in the disengaged position.
Figure 30B:
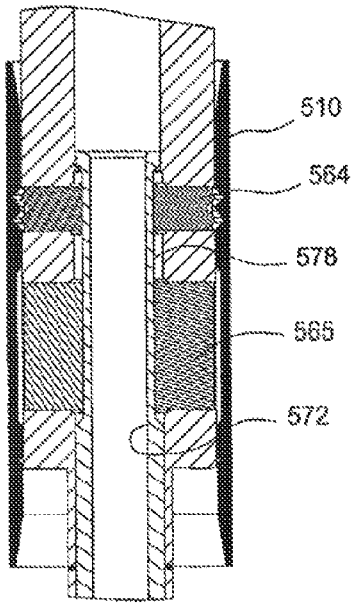
Figure 30C:
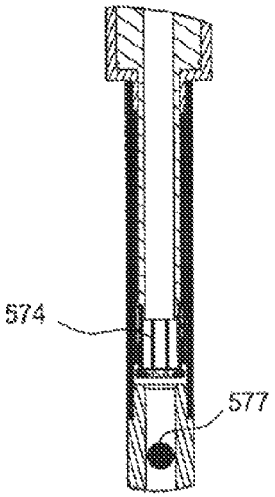

In operation, a ball 577 is dropped into the drill string and lands in the collet 574. Pressure is increased to shear the pins 573 and allow the inner mandrel 572 to shift downward. The inner mandrel 572 is shifted until the recessed dog seat 578 is adjacent the axial dogs 564 and the torque dogs 565, thereby allowing the dogs 564, 565 to disengage from the setting sleeve 510, as shown in FIGS. 30A-C. In addition, the collet 574 has shifted to a position adjacent an enlarged bore section 579. In this respect, the collet fingers are allowed to expand and release the ball 577 from the collet 574. After disengagement, the running tool 560, along with any connected components, may be retrieved to surface.

Figure 31:
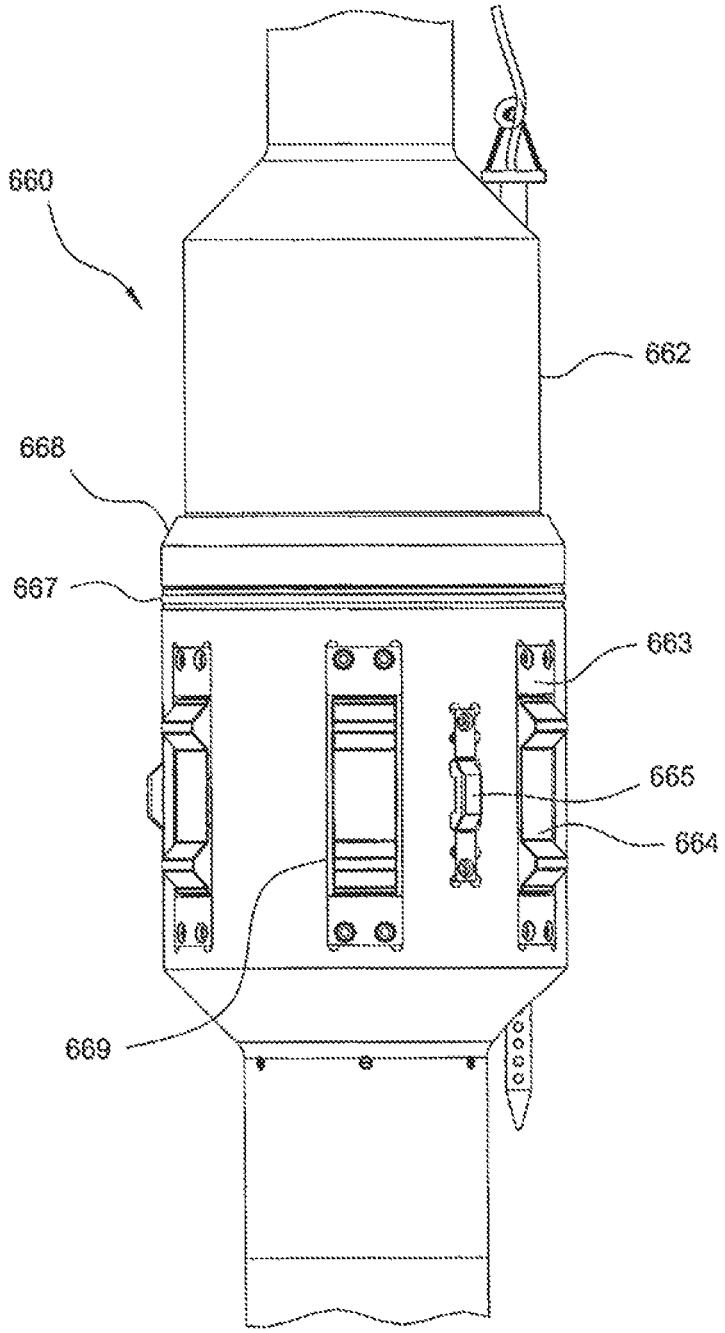
FIG. 31 is a perspective view of another embodiment of a running tool suitable for use with the drilling system.
Figure 32:
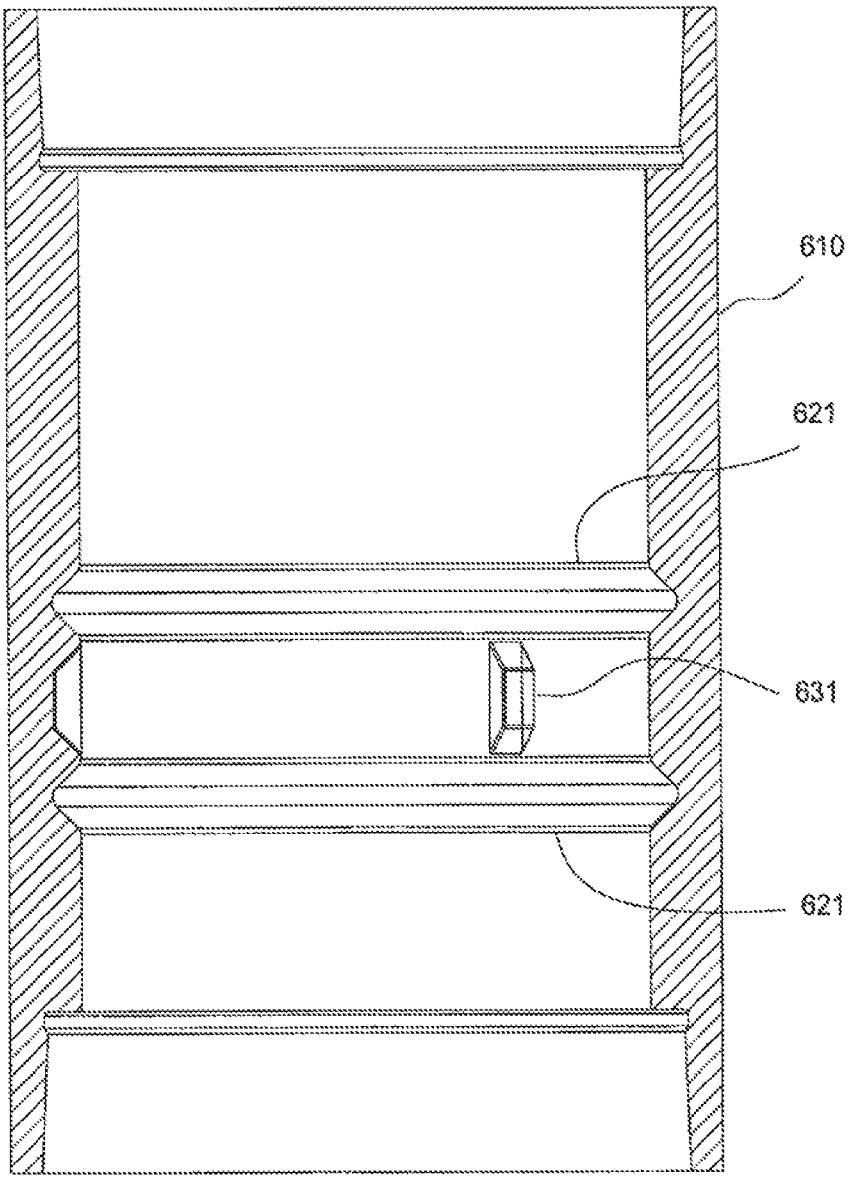
FIG. 32 is a cross-sectional view of an exemplary setting sleeve.

FIG. 31 is a perspective view of another embodiment of a running tool suitable for use with the drilling system 100. In this embodiment, the running tool 660 is adapted to engage a setting sleeve 610, as shown in FIG. 32. The running tool 660 includes a tubular body 662 having one or more engagement members disposed in a window 663 in the tubular body 662. As shown, axial dogs 664 protrude out of the windows 663 and are circumferentially spaced around the tubular body 662. In this example, six axial dogs 664 are used. One or more torque dogs 665 protrude out of windows 663 and are circumferentially spaced around the tubular body 662. As shown, each torque dog 665 is positioned between two consecutive axial dogs 664. In FIG. 32, the torque profiles 631 in the setting sleeve 610 for receiving the torque dogs 665 are positioned between the axial profiles 621 for receiving the axial dogs 664. In this arrangement, the axial length of the running tool body 662 may be reduced. It must be noted any suitable number of axial dogs and torque dogs may be employed, for example, one, two, three, or more of each of axial dogs or torque dogs or combinations thereof. The windows 663 supporting the dogs 664, 665 may have a relief around at least a portion of its perimeter to facilitate movement of the dogs 664, 665 in and out of the windows 663. In one embodiment, the upper surface of a portion of the windows 663, such as longitudinal sides 669 of the axial dog windows, may be slightly wider and recessed. One or more casing seals 667 may be positioned on the exterior of the running tool body 662 for sealing engagement with the setting sleeve 610. It is contemplated that the casing seal may be positioned in the setting sleeve 610 and/or the running tool body 662. A seal cap 668 may be mounted on running tool body 662 to retain the casing seal 667.

Figure 33B:
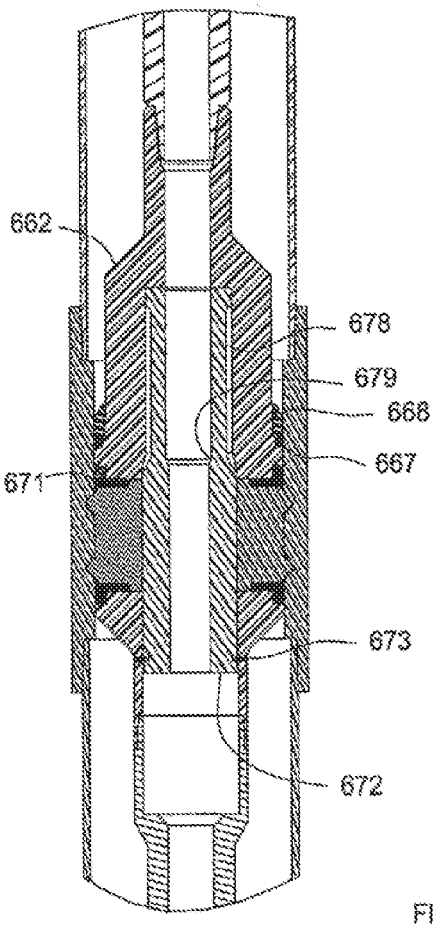
FIGS. 33A-B are cross-sectional views of the running tool of FIG. 31 in the engaged position.
Figure 33A:
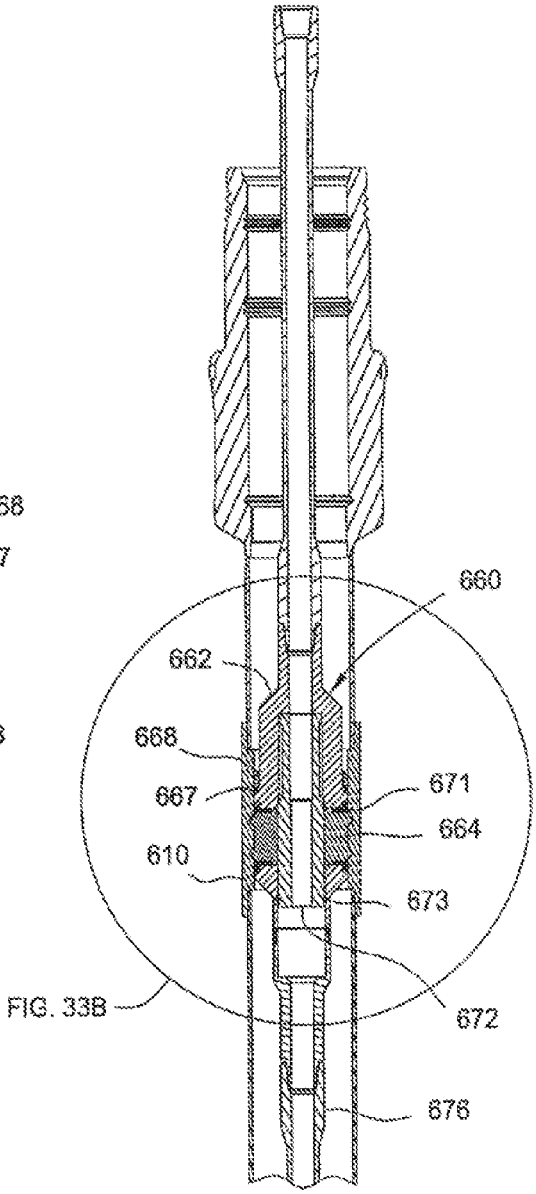

FIGS. 33A-B are cross-sectional views of the running tool 660 in the engaged position. FIG. 33B is a partial enlarged view of FIG. 33A, and the views only show the axial dogs 664. In FIG. 33A, the running tool 660 is engaged with the setting sleeve 610, and the axial dogs 664 are engaged with corresponding profiles in the setting sleeve 610. The setting sleeve 610 may be disposed between two casing sections. In this embodiment, both of the dogs 664 and 665 are biased inwardly using a biasing member 671 such as a spring. An inner mandrel 672 is disposed inside the bore of the running tool 660 and is adapted to urge the axial dogs 664 and the torque dogs 665 outwardly into engagement with their corresponding profiles 621, 631 in the setting sleeve 610. The inner mandrel 672 is releasably connected to the running tool body 662 using a shearable connection such as shear pins 673. The bore of the inner mandrel 672 has a narrower seat portion 679 for receiving an activating device such as a standing valve, a ball, or a dart. The upper end of the inner mandrel 672 has a recessed dog seat 678 formed around its outer surface. The recessed dog seat 678 has sufficient length to receive both dogs 664, 665. An inner string 676 is optionally attached below the running tool 660. In another embodiment, subsea release plugs may be attached below the running tool with or without the inner string 676.

Figure 34B:
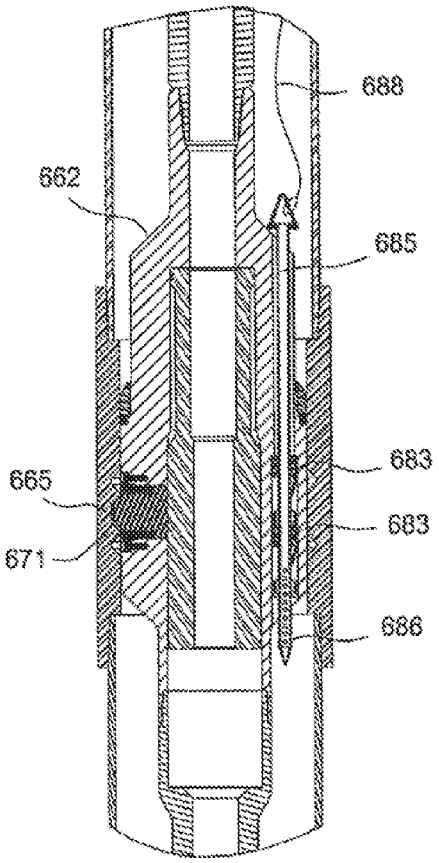
FIGS. 34A-C are cross-sectional views of the running tool of FIG. 31 in the engaged position.
Figure 34A:
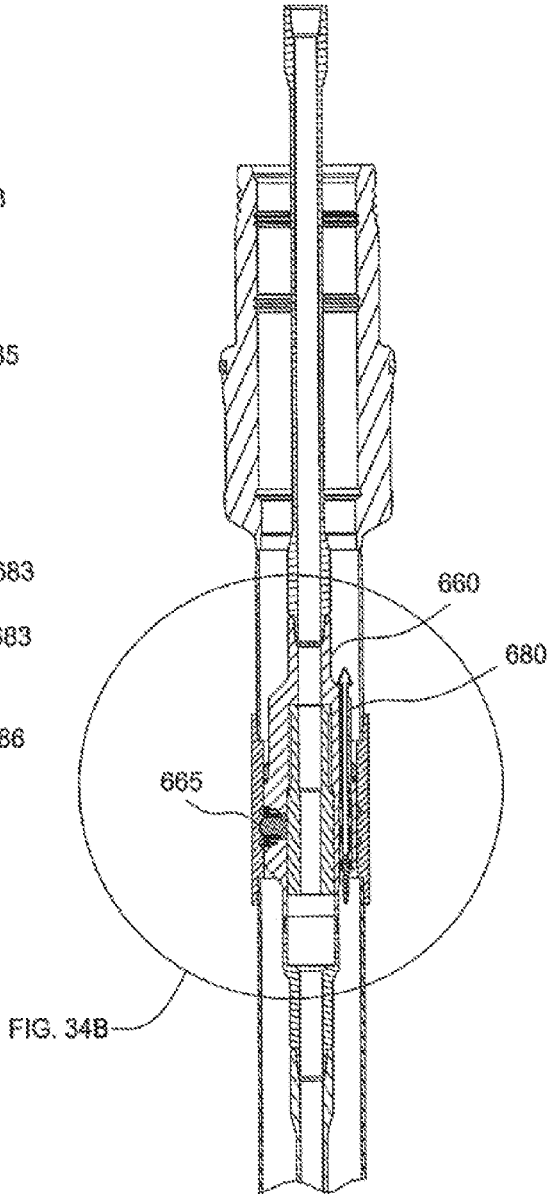
Figure 34C:
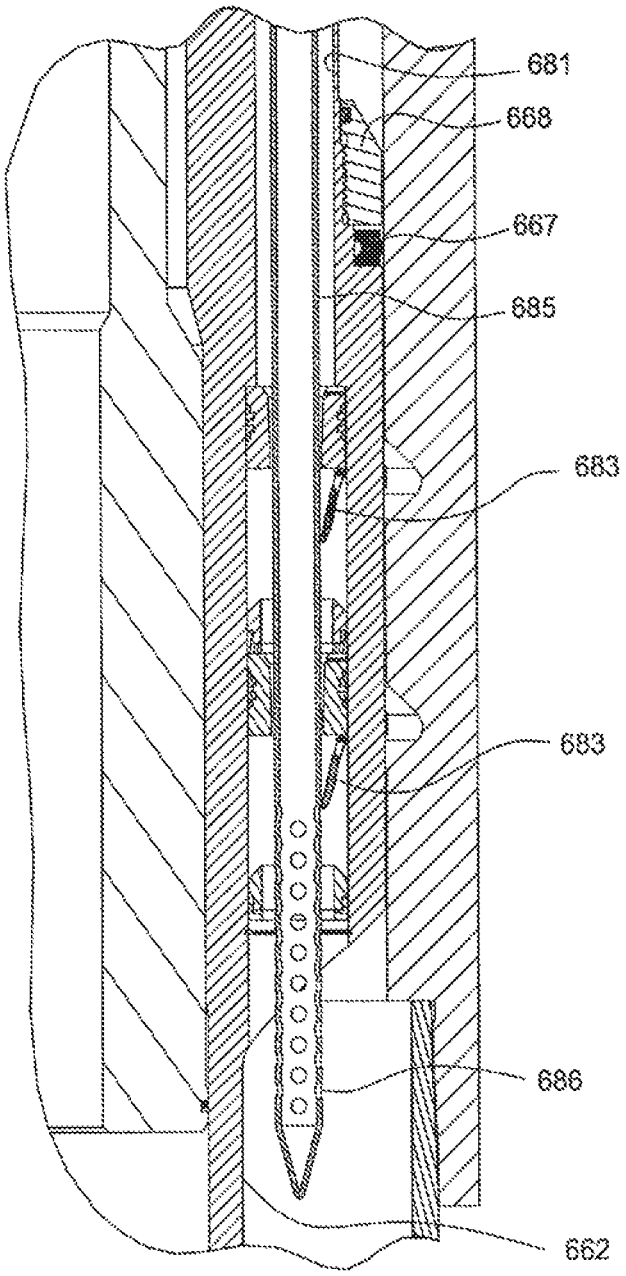

FIGS. 34A-C are cross-sectional views of the running tool 660 in the engaged position taken across a torque dog 665 and a vent system 680. FIG. 34B is a partial enlarged view of the running tool 660, and FIG. 34C is a partial enlarged view of the vent system 680. It is contemplated that the vent system may be used with one or more embodiments of the running tool described herein. In one embodiment, a longitudinal channel 681 may extend through the running tool body 662. One or more valves 683 may be disposed in the longitudinal channel 681 to control fluid flow through the channel 681. In this embodiment, two flapper valves 683 are used. A flow tube 685 is inserted in the channel 681 and through the flapper valves 683. As shown, the flow tube 685 has an opening above the upper valve 683 and an opening 686 below lower valve 683, thereby providing fluid communication above and below the running tool 660. In one embodiment, the opening 686 below the lower valve may include one or more openings, preferably a plurality of openings, formed in the wall of the flow tube 685. The flow tube 685 prohibits the flappers of the flapper valves 683 from closing. The flow tube 685 provides a venting flow path to relieve air or fluid below the running tool 660, such as during inserting of the casing string. In some instances, the venting process may begin as soon as the running tool 660 and the wellhead enter the water. A string 688 such as a cable or rope may be used to remove the flow tube 685 and allow the flapper valves 683 to close after venting trapped air below the seal. Alternatively, the flow tube 685 may be removed manually, or by an ROV ("remote operated vehicle"), or by buoyancy from a floating member such as a buoy. In another embodiment, one-way check valves may be used instead of, or in addition to the flapper valve and flow tube combination. The one-way check valve may be adapted to open at a predetermined pressure to relieve the pressure.

Figure 35B:
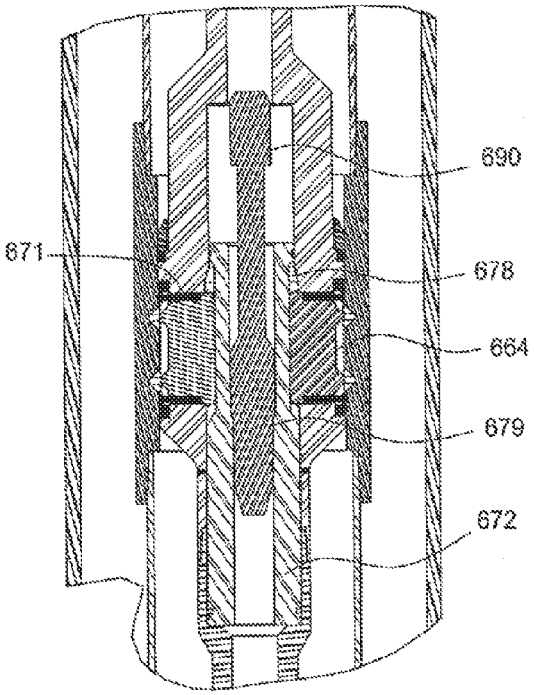
FIGS. 35A-B are cross-sectional views of the running tool of FIG. 31 in the disengaged position.
Figure 35A:
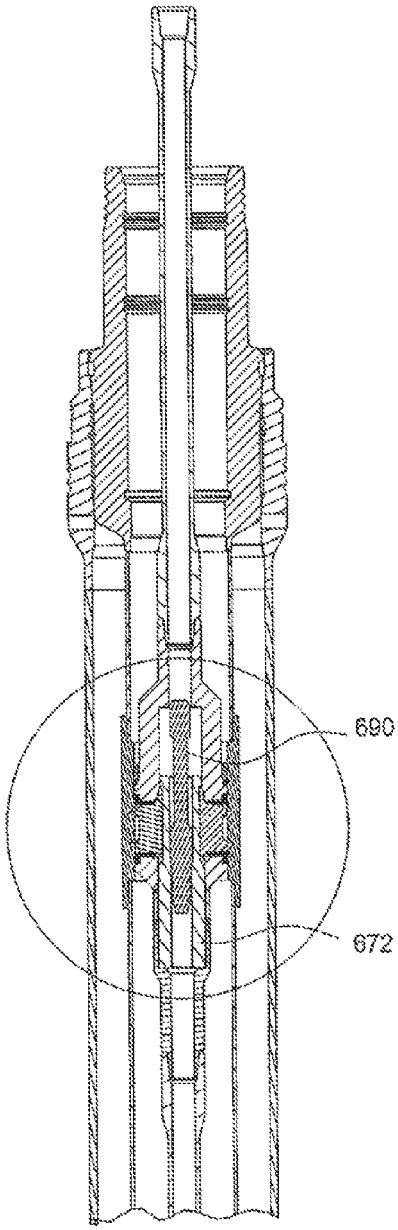

To disengage the running tool 660 after cementing, a standing valve 690 is dropped into the drill string and lands in the valve seat 679, as shown in FIGS. 35A-B. Pressure is increased to shear the pins 673 and allow the inner mandrel 672 to shift downward. The inner mandrel 672 is shifted until the recessed dog seat 678 is adjacent the axial dogs 664 and the torque dogs 665. In this respect, the dogs 664, 665 are allowed to bias inward via the spring, thereby disengaging from the setting sleeve 610. Retraction of the dogs may also be accomplished or aided by axial movement and/or the geometry of the dogs 664 against the setting sleeve 610. After disengagement, the running tool 660, along with any connected components, may be retrieved to surface.

Figure 36A:
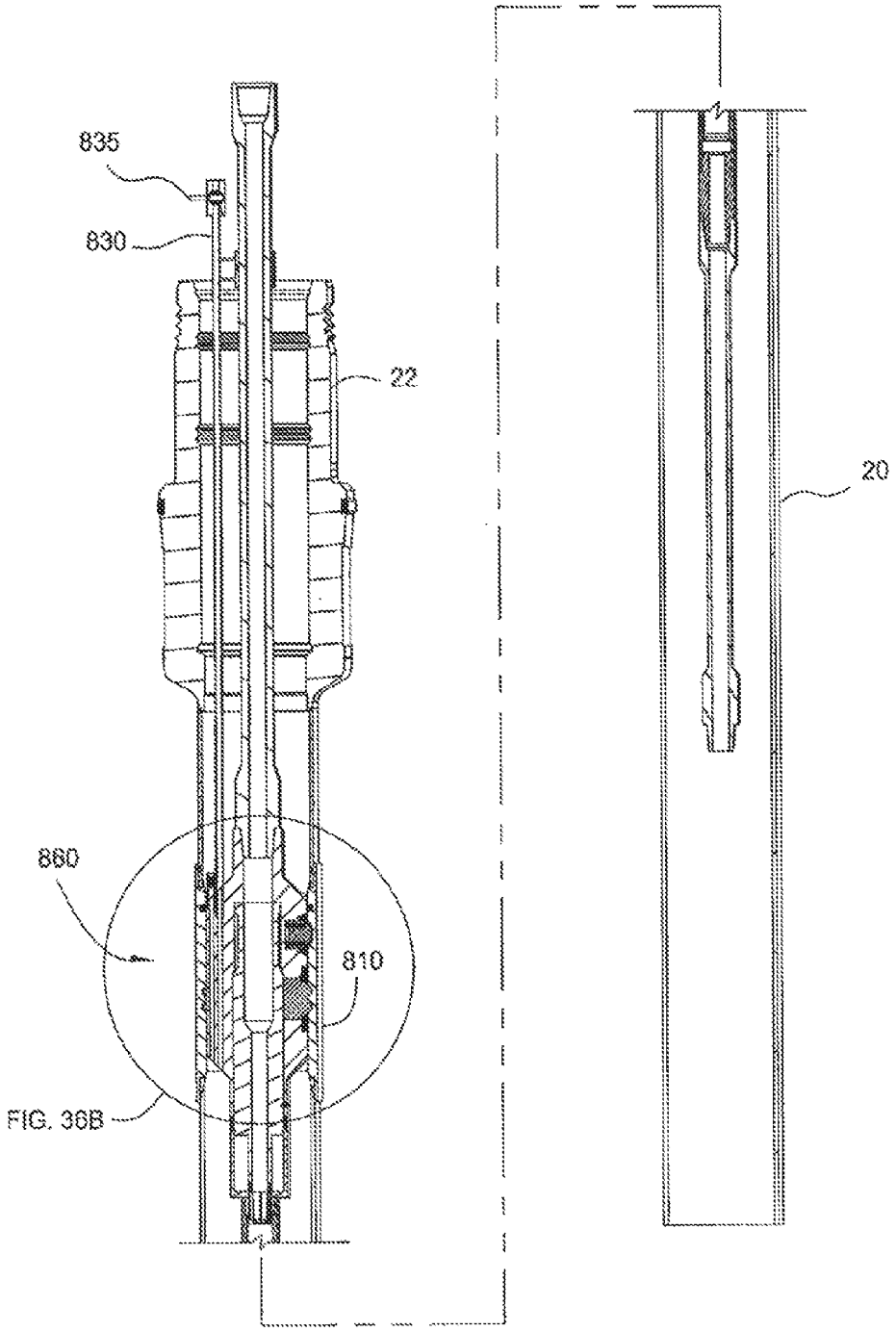
FIGS. 36A-B illustrate another embodiment of a vent system suitable for use with a running tool.
Figure 36B:
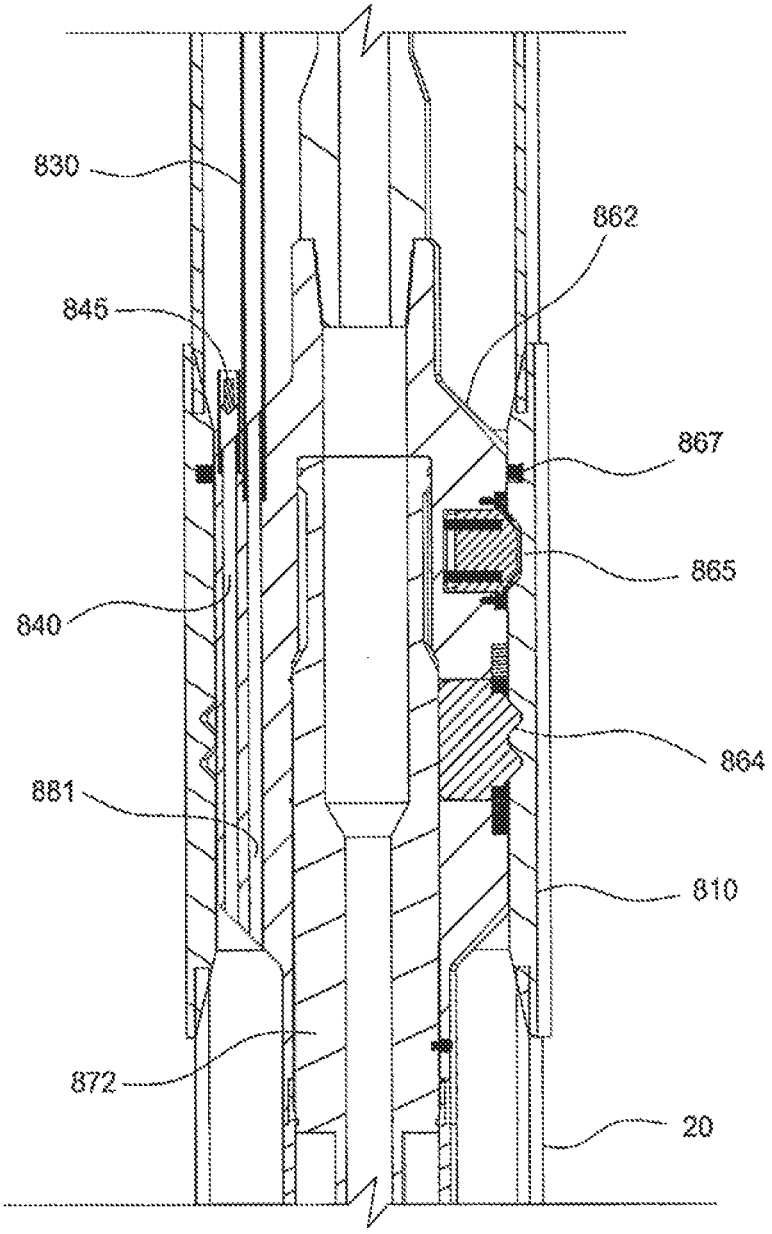

FIGS. 36A-B illustrate another embodiment of a vent system suitable for use with a running tool 860. The running tool 860 is engaged to a setting sleeve 810 connected to a casing string 20. A casing seal 867 is provided on the setting sleeve 810 for sealing contact with the running tool 860. The casing string 20 includes a high pressure wellhead 22 disposed at an upper end. The running tool 860 includes axial dogs 864 and torque dogs 865 for engagement with the setting sleeve 810. An inner mandrel 872 is used to maintain the axial dogs 864 engaged with the setting sleeve 810. In one embodiment, the vent system includes a longitudinal channel 881 extending through the running tool body 862. A vent tube 830 is connected to the upper portion of the channel 881 and extends above the wellhead 22. The vent tube 830 is provided with an air vent valve 835, which, in one embodiment, may be manually operated, or operated by a string, ROV, or buoy. In another embodiment, the vent valve 835 may be used to fill the casing 20. During run-in, the vent valve 835 is opened to relieve the trapped air in the casing string 20 through the vent tube 830. The vent valve 835 may be closed after the casing assembly is lowered below the water line, which typically involves venting of the trapped air and the casing 20 is filled below the running tool 860. The running tool 860 may optionally include a second channel 840 for supplying water or other fluid into the casing 20 below the running tool 860. The second channel may facilitate the filling of the casing 20 and may also assist with venting the trapped air. In one embodiment, the second channel 840 may include a one-way check valve 845 to allow water to enter the casing 20 from above the running tool 860.

Figure 37A:
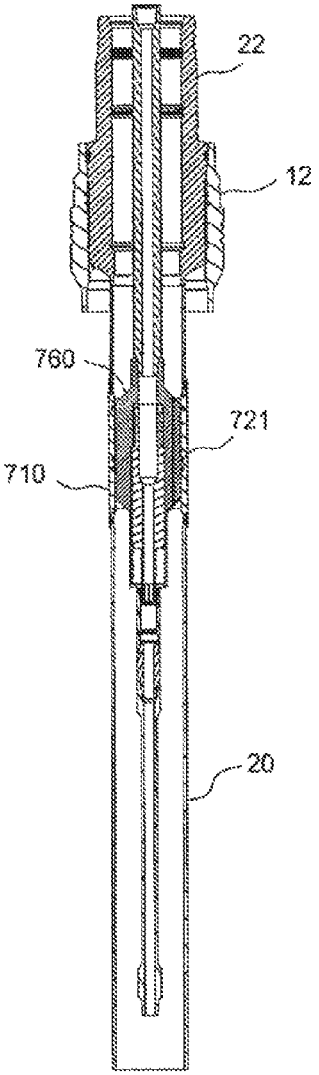
FIGS. 37A-B illustrate an embodiment of a running tool equipped with a hydraulic pressure release system.
Figure 37B:
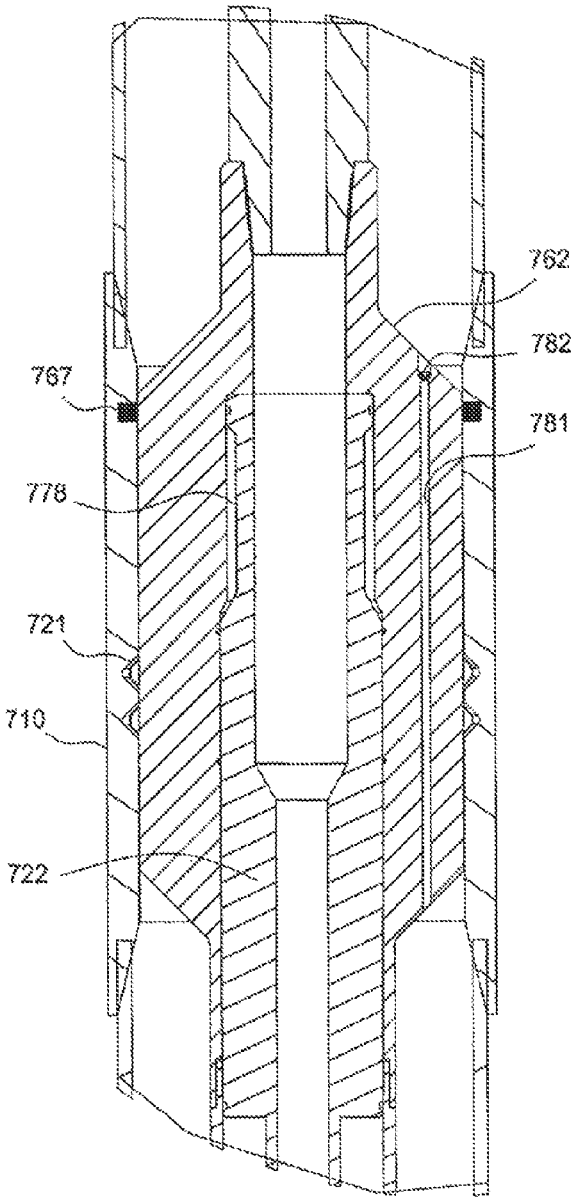

In some completion operations, cementing is performed prior to releasing the running tool. In those situations, the running tool may be provided with a hydraulic pressure release system. FIGS. 37A-B are cross-sectional views of an embodiment of a running tool 760 equipped with a hydraulic pressure release system. The running tool 760 is engaged to a setting sleeve 710 connected to a casing string 20. The casing string 20 includes a high pressure wellhead 22, shown seated in a low pressure wellhead 12. Although not shown in these views, the running tool 760 includes axial dogs, and optionally, torque dogs. To that end, the grooves 721 for receiving the axial dogs are clearly seen in the Figures. The recessed dog seat 778 on the inner mandrel 772 is also shown. A casing seal 767 is provided on the setting sleeve 710 for sealing contact with the running tool 760. In one embodiment of the hydraulic pressure release system, a longitudinal channel 781 may extend through the running tool body 762. A rupture disk 782 may be disposed in the longitudinal channel 781 to control fluid flow through the channel 781. The rupture disk 782 is adapted to shear at a predetermined pressure, thereby opening the channel 781 for fluid communication. In another embodiment, a one-way check valve may be used to control fluid flow through the channel 781. In yet another embodiment, telemetry such as mud pulse telemetry, flow rate modulation, electromagnetic signal, and radio frequency identification tags may be used to transmit a command to operate a valve. For example, a coded pressure signal may be sent down the bore to the running tool, where it is received by a sensor operatively connected to a controller which in turn, opens the valve or a port to provide a fluid path for circulation. Devices operated by pressure telemetry or other suitable remote actuation methods may also be used to activate the running tool, retractable joint, or circulation sub.

In operation, after cementing has occurred, an activating device, such as a ball, standing valve, or dart, is dropped to land in the inner mandrel 772. Pressure is increased to shear the pins holding the inner mandrel 772. In some instances, the pressure below the activating device acts against the breaking of the pins or the downward travel of the inner mandrel 772. When the pressure below the ball reaches the predetermined level, the rupture disk will break, thereby providing a flow path to relieve the pressure. Consequently, the pressure above the ball needed to continue the operation, e.g., move the inner mandrel 772, may be reduced. It is contemplated that embodiments of the running tools described herein may include a combination of a vent system and a hydraulic pressure release system.

Figure 38:
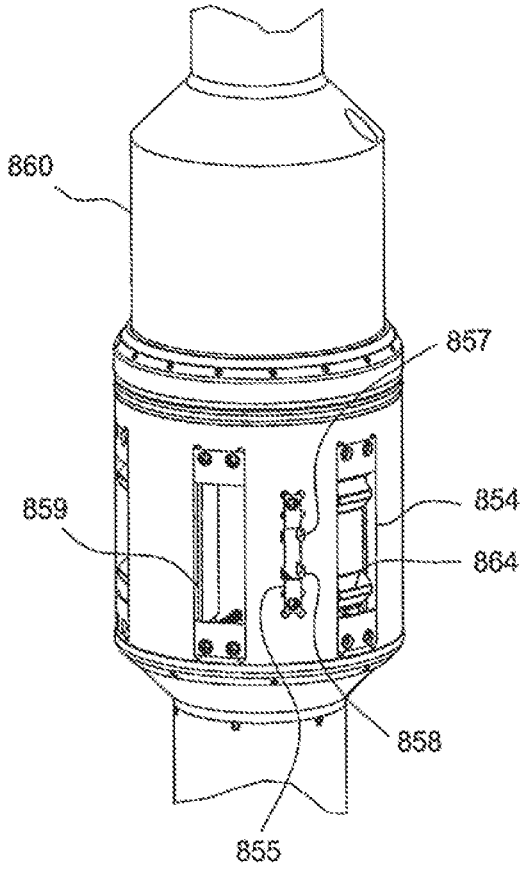
FIG. 38 shows another embodiment of a running tool.

In one or more of the running tool embodiments described herein, the windows on the running tool may be configured to facilitate movement of the dogs, even if the dogs become deformed or damaged in use. FIG. 38 shows a running tool having windows for housing axial dogs and torque dogs. As shown, the dogs are either retracted or removed for clarity. In one embodiment, the windows 854, 855 supporting the dogs may have a relief around at least a portion of the window's perimeter to facilitate movement of the dogs in and out of the windows 854, 855. For example, the upper portion of the longitudinal sides 859 of the axial dog windows 854 may be slightly wider and recessed. In this respect, axial dogs 864 deformed during use may still retract into the window 854. In another example, the portion 857, 858 of the torque dog windows 855 adjacent the ends of the torque dogs may be slightly wider and recessed. It must be noted that other suitable forms of relief are contemplated.

Various embodiments of the running tools described herein include a seal between the running tool and the setting sleeve. For example, the running tool embodiment disclosed in FIG. 31 is provided with a seal 667 on the running tool 660. In another example, the running tool embodiment disclosed in FIG. 37 is provided with a seal 767 on the setting sleeve 710 instead of on the running tool 760. However, it must be noted that the seal may be located on either the running tool or the setting sleeve, or both. For example, referring to the running tool described in FIG. 31 again, the seal 667 may be located on the setting sleeve 610 instead of the running tool 660. Alternatively, seals may be provided on both the setting sleeve 610 and the running tool 660. In yet another embodiment, the seal may be positioned between the running tool and the wellhead, either on the running tool or the wellhead or both.

Figure 39:
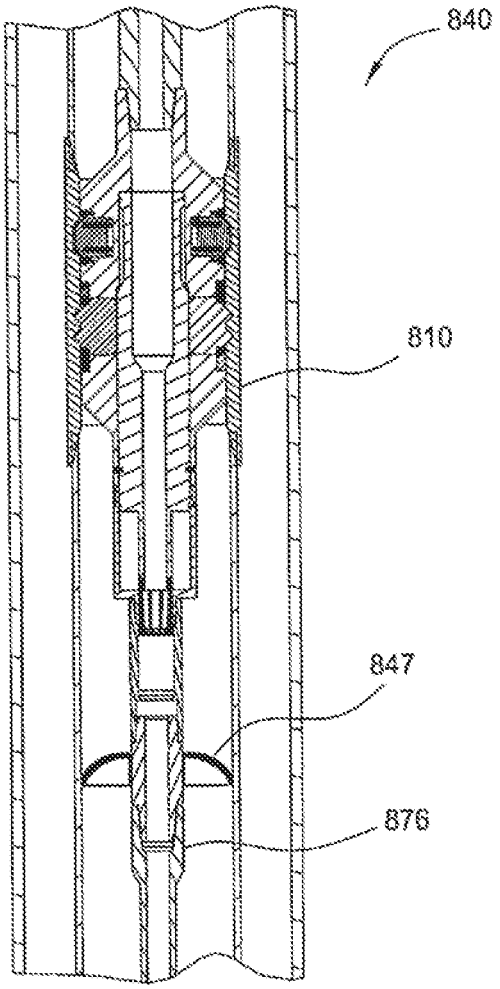
FIG. 39 is a partial view of a drilling system equipped with a cup seal.

In another embodiment, the running tool, inner string, or drill string may be equipped with a seal such as a cup seal. As shown in FIG. 39, the running tool 840 has a cup seal 847 installed on the inner string 876 below the running tool 840. Alternatively, the cup seal 847 may be located above the running tool 840 for sealing engagement with the casing string. In yet another embodiment, the cup seal 847 may be positioned to engage with the wellhead. It is envisaged that a seal such as a cup seal may be placed at any location on the drill string or inner string to form a sealing engagement with the casing string and/or wellhead. In one embodiment, the cup seal 847 may function as a one-way valve. For example, as shown in FIG. 39, the cup seal 847 allows fluid to enter from the top at a lower pressure, e.g., 200 psi, but may prevent fluid flow from the other direction. In this respect, the cup seal may replace the valve or a valve activating mechanism such as a string.

In yet another embodiment, the seal may be molded into the body of the setting sleeve 810. The molding process may allow for use of a seal pocket having larger interior dimensions than the exposed area for the seal, for example, a C-shaped or dovetail-shaped pocket. In this respect, the body of the setting sleeve may assist with the retention of the seal. In yet another embodiment, running tool 840 may include a cup seal 845, a seal on the setting sleeve 810, a seal on the running tool 840, or combinations thereof.

Figure 40:
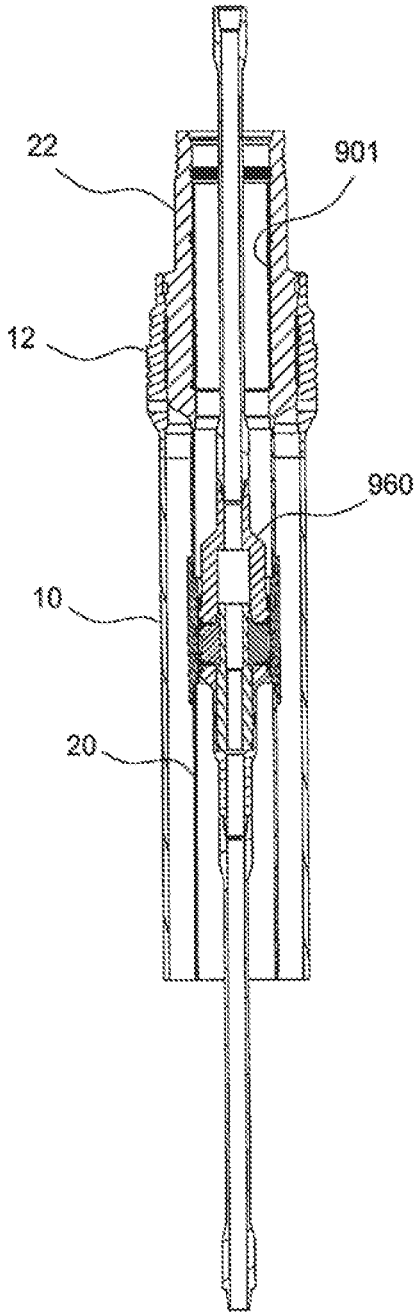
FIG. 40 shows another embodiment of a drilling system equipped with a bore protector.

In another embodiment, the running tool may be configured to reduce frictional contact with a bore protector disposed in a wellhead. Such frictional contact may be minimized, at least in part, by features adapted to facilitate stand-off between the inner surface of the bore protector and the outer surface of the running tool. Referring to FIG. 40, the bore protector 901 is typically used to protect the inner surface of a wellhead, in this case, the high pressure wellhead 22. The high pressure wellhead 22 seats in a low pressure wellhead 12 of the conductor 10. A casing string 20 extends from the high pressure wellhead 22 and is carried by a running tool 960. During retrieval of the running tool 960, there is a potential for the running tool 960 to disturb the bore protector 901.

Figure 41:
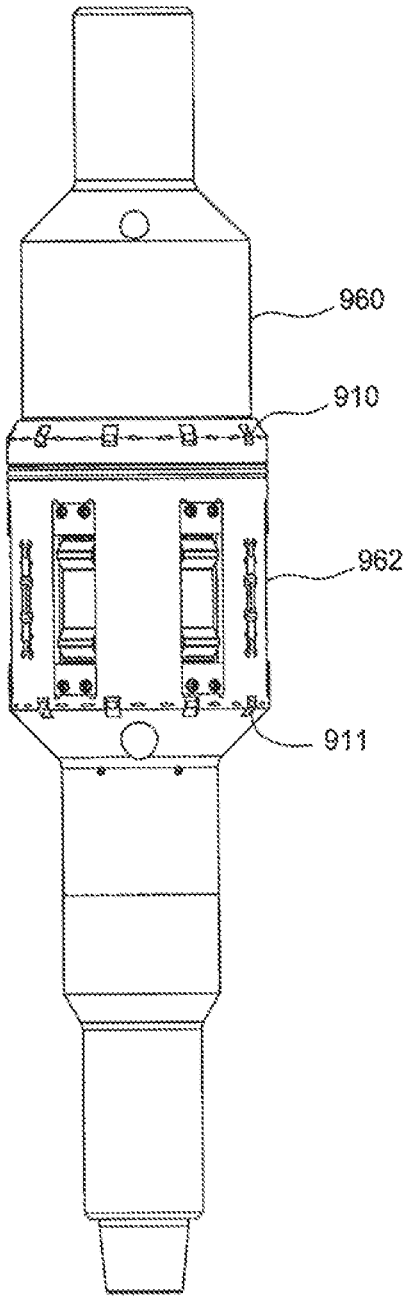
FIG. 41 shows another embodiment of a running tool equipped with rollers.

To minimize frictional contact with the bore protector, the running tool 960 may be equipped with a plurality of rollers 910 on its outer surface, as shown in FIG. 41. The rollers 910 may be arranged around the running tool 960 and positioned to rotate about a horizontal axis. In one embodiment, one row of rollers 910 may be installed on an upper portion of the running tool body 962 and a second row of rollers 911 may be installed on a lower portion of the running tool body 962. It must be noted that any suitable number or arrangement of rollers may be used.

Figure 42:
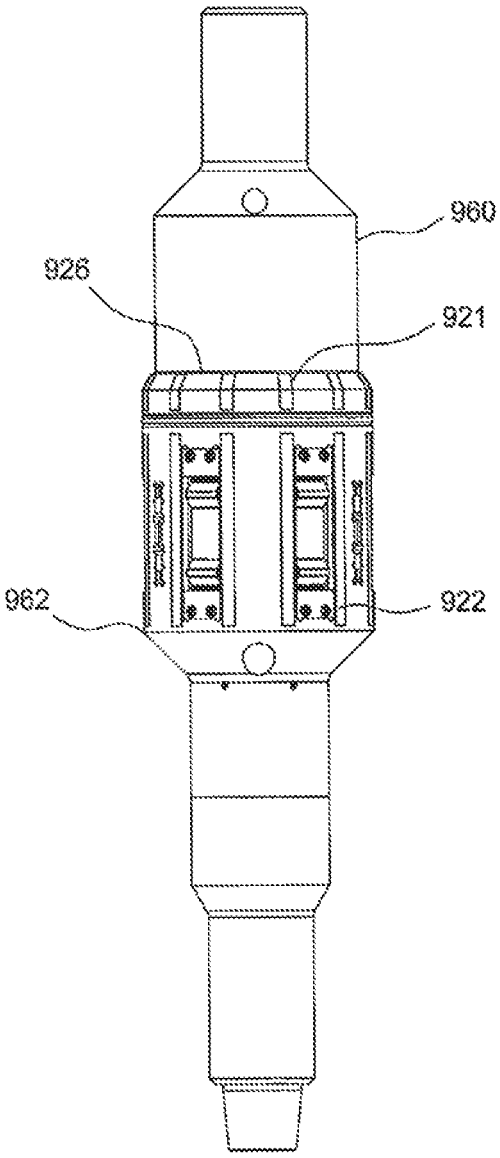
FIG. 42 shows another embodiment of a running tool equipped with low friction materials.
Figure 43:
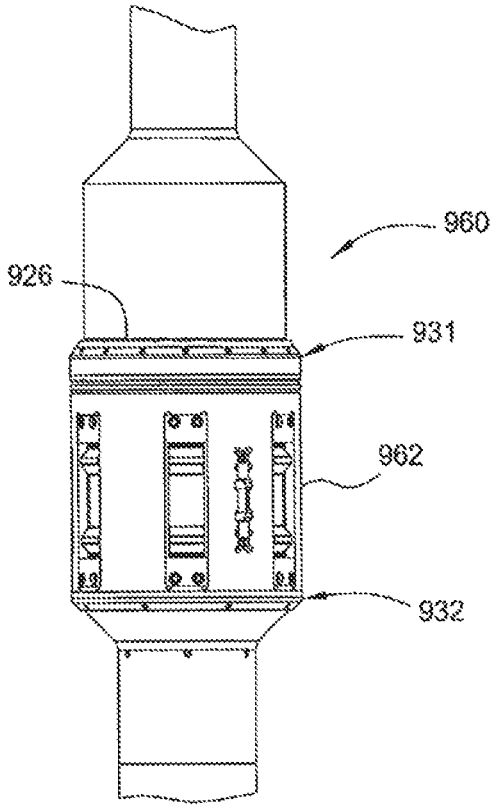
FIG. 43 shows another embodiment of a running tool equipped with a low friction ring.

In another embodiment, the running tool 960 may be provided with a low friction material. Exemplary low friction material include polytetrafluoroethylene, fluoroplastics, Impreglon, fusion bonded epoxy coating, fullerenes, or other suitable low friction material. Referring to FIG. 42, the low friction material may be applied in the form of rails 921, 922 on the running tool 960. For example, low friction rails 921 may be applied to the outer surfaces of the seal cap 926. In addition to or alternatively, low friction rails 922 may be applied to the outer surfaces of the running tool body 962. The low friction material may reduce drag on the bore protector in the event the running tool 960 makes contact therewith. In another embodiment, a low friction ring 931 may be installed on the seal cap 926 of the running tool body 962, as illustrated in FIG. 43. The ring 931 provides 360 degrees low friction contact protection. A second low friction ring 932 may be installed on the lower portion of the running tool body 962. In another embodiment, the low friction material may be applied as a coating on at least a portion or all of the running tool 960.

Figure 44A:
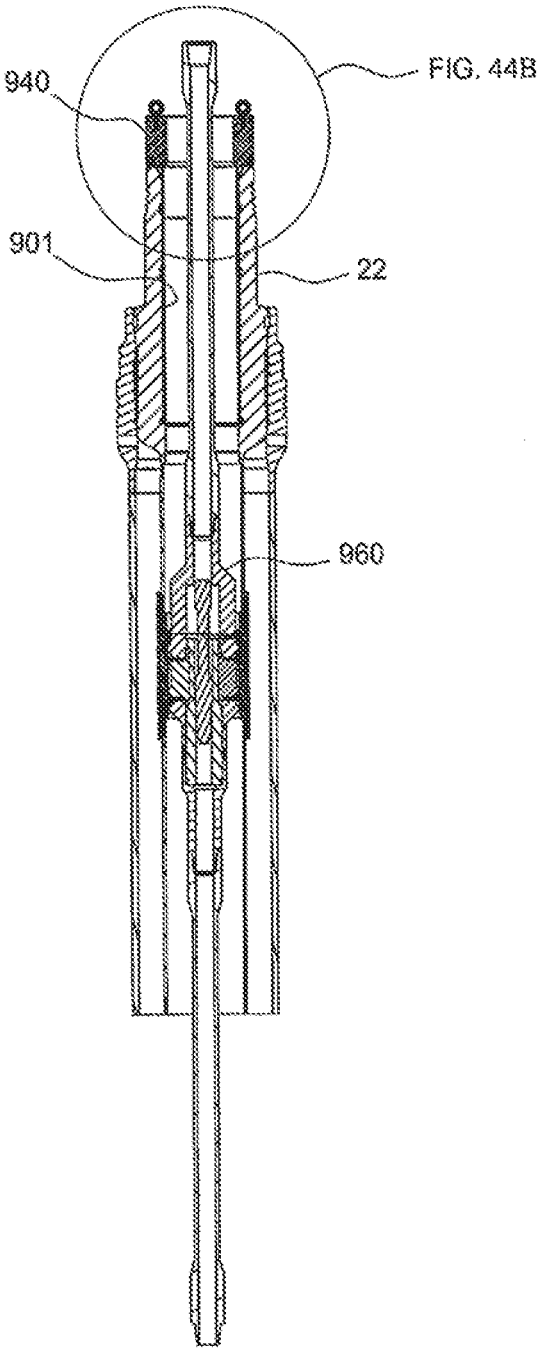
FIGS. 44A-B illustrate an exemplary weight member for retaining a bore protector.
Figure 44B:
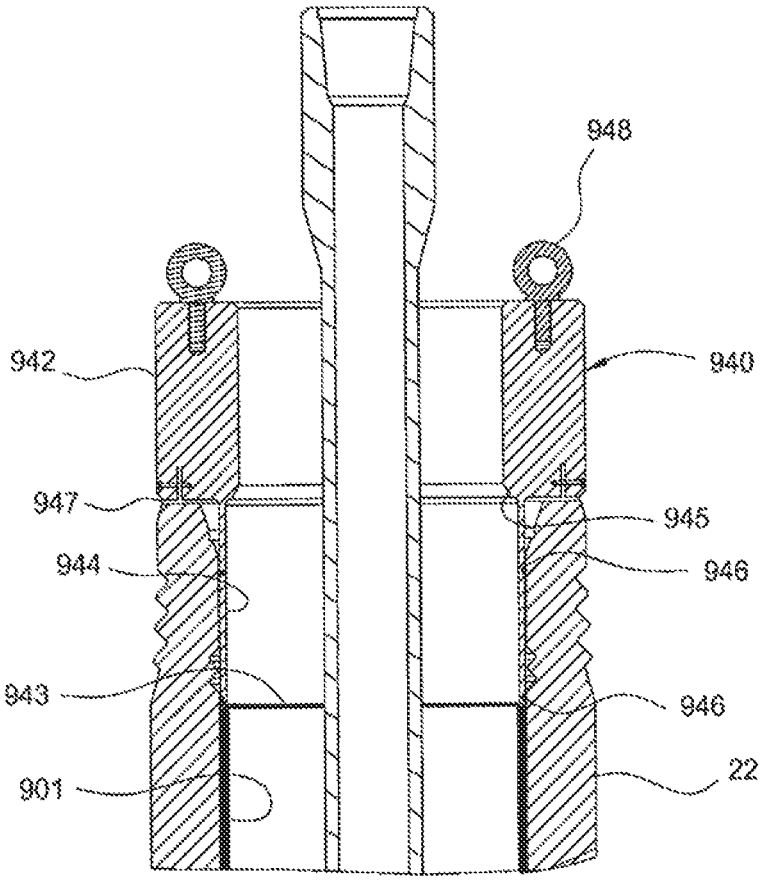

FIGS. 44A-B illustrates a method of maintaining the bore protector in the wellhead 22. In one embodiment, a weight member 940 is positioned above the bore protector 901 to prevent removal of the bore protector 901 during retrieval of the running tool 960. The weight member 940 includes an annular body 942 and a lower sleeve 944 attached therebelow. The annular body 942 has an outer diameter that is larger than the lower sleeve 944. The lower sleeve 944 is configured to be positioned inside the wellhead 22 while the annular body 942 is configured to sit on top of the wellhead 22. The sleeve 944 has an outer diameter that is sufficiently sized to abut against the bore protector 901 if engaged. The length of the lower sleeve 944 is sized to provide a small gap 943 with respect to the bore protector 901. The gap 943 prevents the transfer of the load from the weight member 940 to the bore protector 901. The weight member 940 is provided with sufficient weight to prevent the bore protector 901 from coming out of the wellhead 22 if an upward force such as during retrieval of the running tool is inadvertently applied to bore protector 901. In one embodiment, the inner diameter of the lower sleeve 944 is sized larger than the outer diameter of the running tool 960 to minimize engagement therewith. In addition, the inner diameter of the annular body 942 is sized smaller than the inner diameter of the lower sleeve 944, thereby forming a shoulder 945. The shoulder 945 is adapted to engage the running tool 960 such that the weight member 940 may be removed along with the running tool 960. In another embodiment, an impact absorbing material may optionally be provided on the outer surface of the lower sleeve 944. An exemplary impact absorbing material is an elastomer in the form of an o-ring 946. The impact absorbing material may act as bumpers to cushion the contact between the lower sleeve 944 and the wellhead 22. Similarly, impact absorbing pads 947 may be installed at the bottom of the annular body 942 for engagement with the top of the wellhead 22. The weight member 940 may optionally include lift member 948 to facilitate its installation or removal. In another embodiment, the bore protector may be adapted to include a latch or other feature to engage an inner profile and/or an outer profile of the wellhead.

Figure 45:
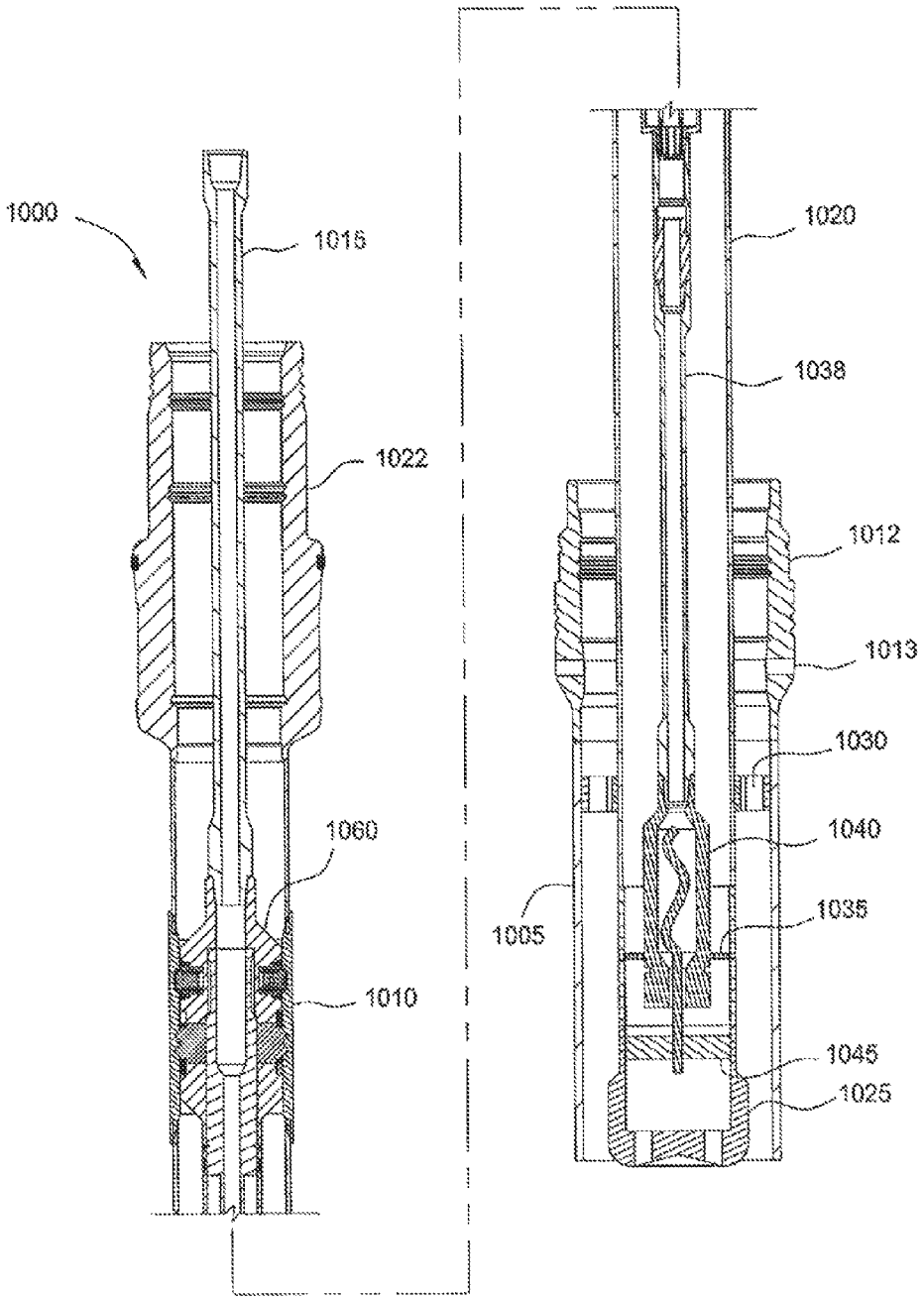
FIG. 45 illustrates another embodiment of a drilling system for subsea drilling with casing.

FIG. 45 illustrates another embodiment of a drilling system 1000 for subsea drilling with casing. The drilling system 1000 includes a casing string 1020 coupled to a drill string 1015 using a running tool 1060. The running tool 1060 may be selected from any suitable running tool described herein, for example, the running tool disclosed in FIGS. 19-22; or known to a person of ordinary skill in the art. The casing string 1020 may include a high pressure wellhead 1022 at its upper end and an earth removal member 1025 at its lower end. A conductor 1005 having a low pressure wellhead 1012 is releasably coupled to the casing string 1020 using a latch 1030 such as a mechanical latch. An exemplary latch is a J-latch. In this respect, the conductor 1005 and the casing string 1020 may be run-in together in a single trip. The conductor 1005 may optionally include a guide base.

The drilling system 1000 includes a downhole drilling motor 1040 to rotate the earth removal member 1025. Exemplary drilling motors includes a mud motor, a positive displacement motor, a hollow shaft drilling motor, a drillable motor, turbine, and other suitable motors known to a person of ordinary skill in the art. An exemplary hollow shaft drilling motor is disclosed in U.S. Pat. No. 7,334,650, issued to Giroux et al., on Feb. 26, 2008. The description with respect to the hollow shaft drilling motor is incorporated herein by reference. A motor coupling 1045 may be used to releasably couple the drilling motor to the earth removal member 1025. The motor coupling 1045 is adapted to transfer torque from the output shaft of the drilling motor to the earth removal member 1025. An exemplary motor coupling 1045 is a latch or a spline connection in which the output shaft may be inserted into the motor coupling 1045. The earth removal member 1025 is rotatably coupled to the casing string 1020 using a swivel 1035 having bearings or a ball joint located above the motor coupling 1045. The bearings or ball joint may be used to transfer drilling loads. In another embodiment, the motor bearings of the drilling motor 1040 are configured to carry the drilling loads. In this respect, the swivel 1035 only needs to provide a rotating sealing function.

Figure 46:
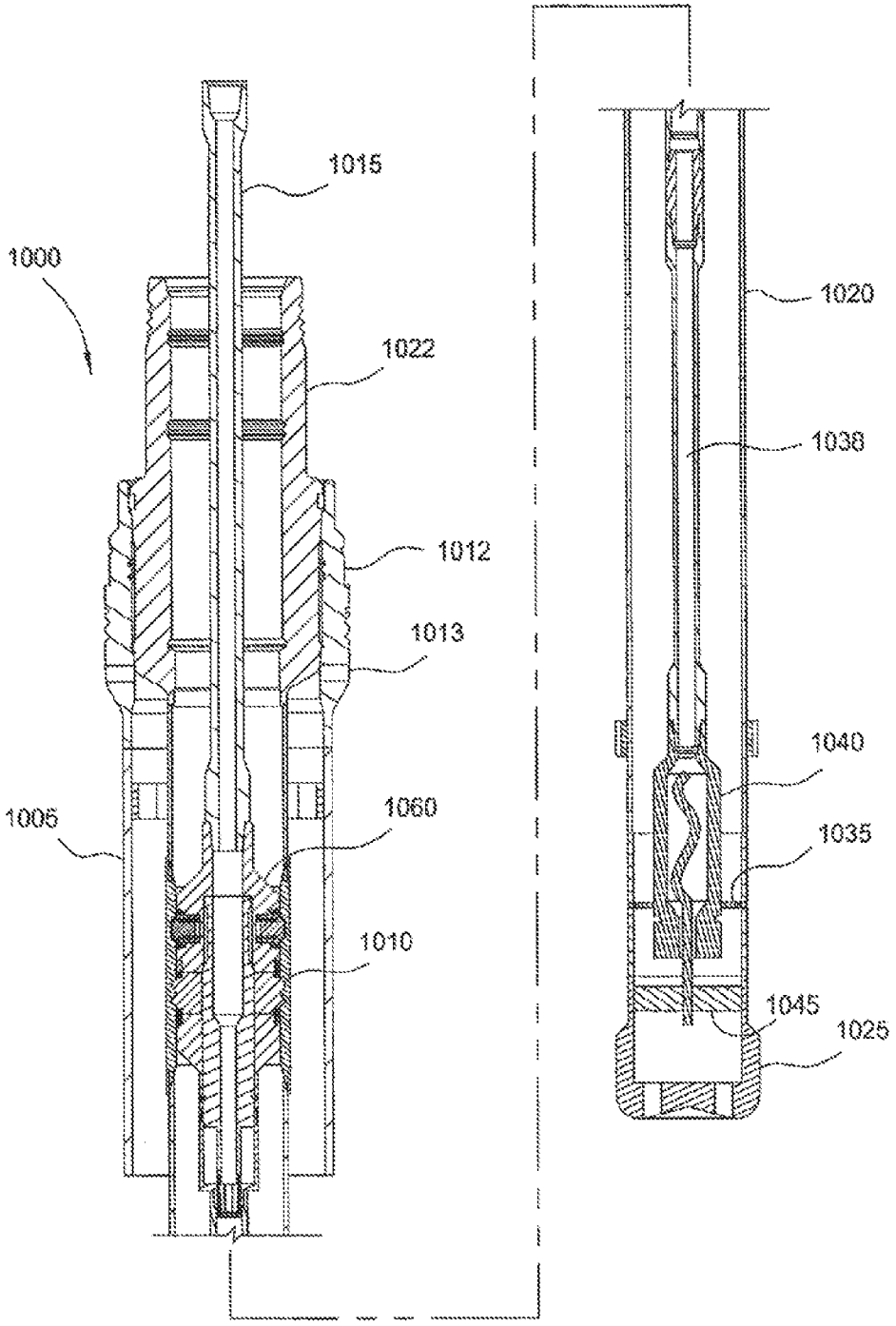
FIG. 46 shows the drilling system of FIG. 45 in operation.
Figure 47:
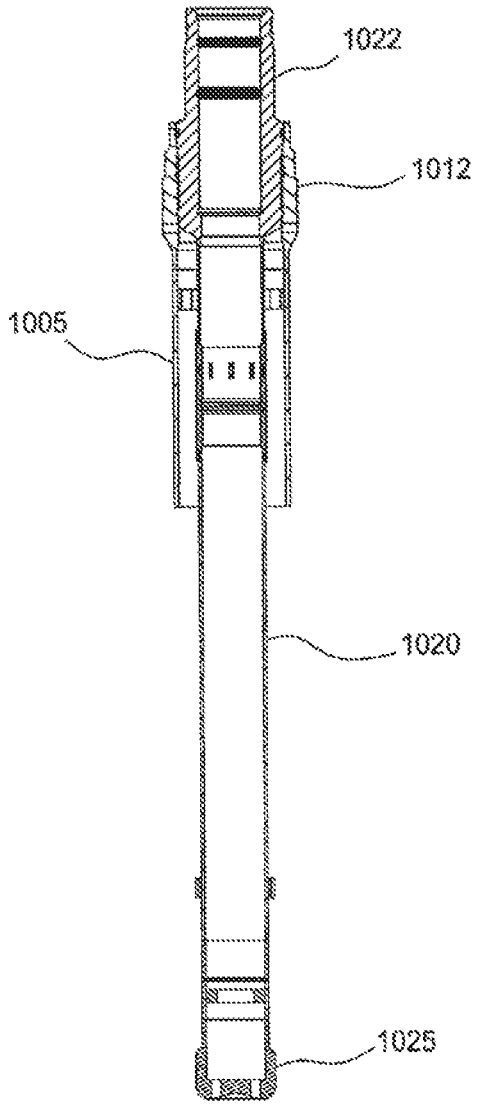
FIG. 47 shows the drilling system of FIG. 45 after the running tool and connected tools have been removed.

In operation, the drilling system 1000 is run-in on the drill string 1015 until it lands on the sea floor. The drilling system 1000 is jetted into the earth to position the conductor 1005. Alternatively, the conductor 1005 may be drilled into position. Then, the drilling system 1000 is allowed to remain in position while the formation re-settles around the conductor 1005 to support the conductor 1005. Alternatively, the conductor 1005 may be cemented in place. The casing string 1020 is then unlatched from the conductor 1005 and is drilled or urged ahead. The earth removal member 1025 is rotated by the downhole drilling motor 1040 to extend the wellbore. The swivel 1035 allows the earth removal member 1025 to rotate relative to the casing string 1020. Because the casing string and the high pressure wellhead 1022 do not necessarily need to rotate, the drilling may continue while the high pressure wellhead 1022 lands in the low pressure wellhead 1012. The casing string and the high pressure wellhead may be rotated at a low RPM during drilling, but cease rotation while landing the wellhead. FIG. 46 shows the high pressure wellhead 1022 landed in the low pressure wellhead 1012. The drilling fluid circulating back up the annulus between the casing 1020 and conductor 1005 may flow out through a side port 1013 in the low pressure wellhead 1012. In another embodiment, the earth removal member 1025 may be rotated by rotating the entire casing string 1020. Optionally, prior to landing the high pressure wellhead 1022, the interior of the low pressure wellhead 1012 may be cleaned by a remotely operated vehicle. Optionally still, a debris barrier such as a wiper or seal may be provided on the exterior surface of the casing string 1020 near the high pressure wellhead 1022. The debris barrier may serve to block the flow of return fluids between the high pressure wellhead 1022 and the low pressure wellhead 1012 during the landing process, thereby facilitating the diversion of return fluid through the side ports 1013. After landing the wellhead 1022, a cementing operation is performed to cement the casing string 1020. In another embodiment, the drilling system may be equipped with sensors to monitor gas kicks in the formation. Upon completion, the running tool 1060 may be released. An activating device such as a ball, standing valve, or dart is dropped to land in the inner mandrel to close fluid communication. Pressure is increase to shift the inner mandrel and retract the dogs, thereby releasing the running tool 1060 from the setting sleeve 1010. Thereafter, the running tool 1060, inner string 1038, drilling motor 1040, and other connected instruments may be retrieved. FIG. 47 shows the drilling system 1000 after the running tool 1060 and connected tools have been removed. It must be noted that the cementing operation may occur by way of reverse circulation, for example, supplied through the side ports 1013 of the low pressure wellhead 1012.

In yet another embodiment, telemetry such as mud pulse telemetry, flow rate modulation, electromagnetic signal, and radio frequency identification tags may be used to transmit a command to operate the running tool. For example, a coded pressure signal may be sent down the bore to the running tool, where it is received by a sensor operatively connected to a controller which in turn, operates a release mechanism to allow the dogs to retract. Devices operated by pressure telemetry or other suitable remote actuation methods may also be used to activate the running tool, retractable joint, or circulation sub.

Figure 48:
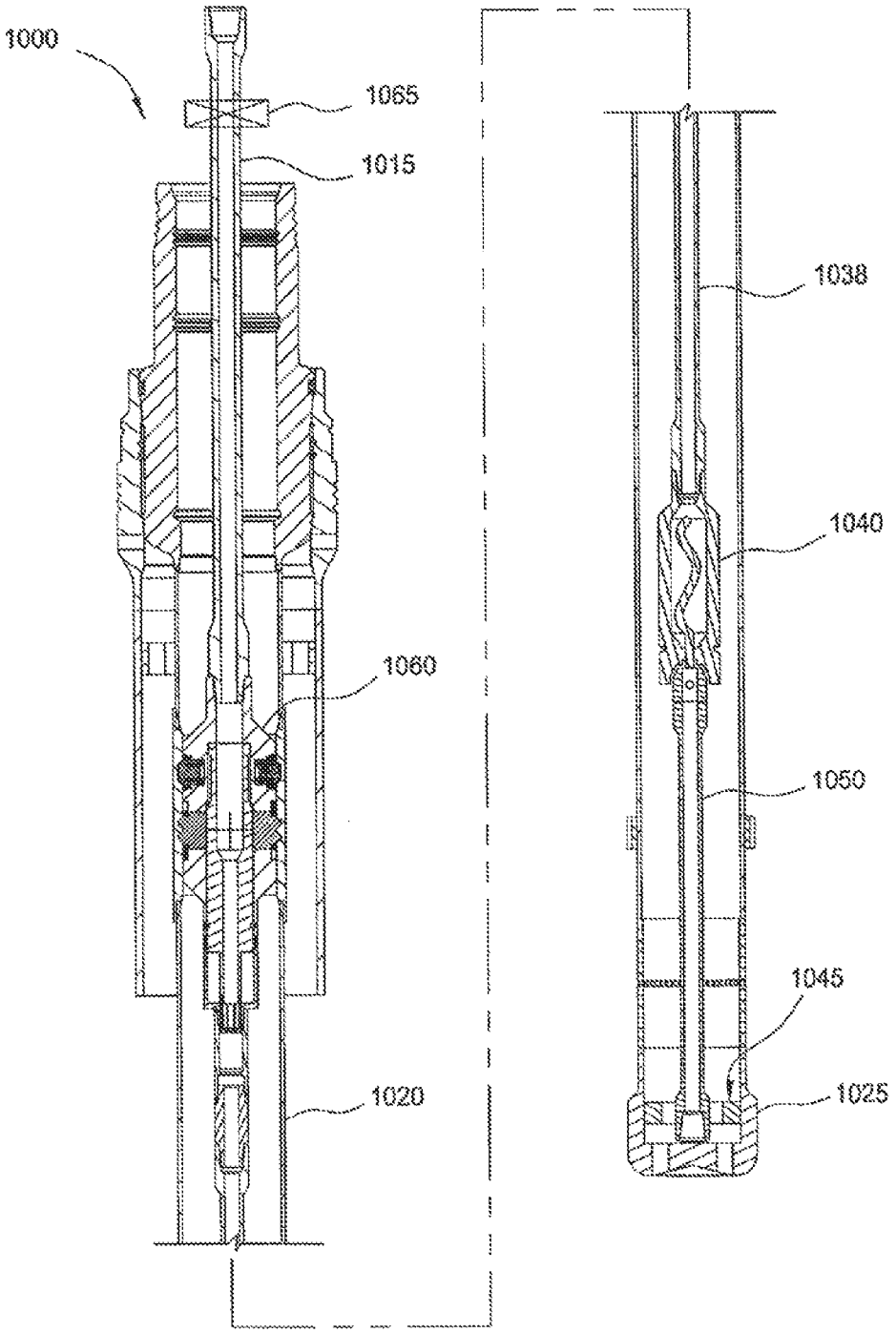
FIG. 48 illustrates another embodiment of a drilling system for subsea drilling with casing.

In another embodiment, the drilling motor 1040 may be positioned higher in the casing string 1020 to minimize the potential of cementing the drilling motor 1040 in place. FIG. 48 illustrates one example in which a suitable length of drill pipe 1050 or other suitable tubular may be disposed between the drilling motor 1040 and the earth removal member 1025. One end of the drill pipe 1050 can be connected to the output shaft of the drilling motor 1040. The other end of the drill pipe 1050 may be attached to the earth removal member through the motor coupling 1045. Additionally, the drill pipe 1050 may be used to convey fluid such as drilling fluid and cement. In one embodiment, the drill pipe 1050 is manufactured from drillable material such as aluminum or a composite material such as fiberglass, resin, carbon, composite, Kevlar, etc. In the event the drill pipe 1050 is cemented in place, the running tool 1060, inner string 1038, and the drilling motor 1040 may still be retrieved by disconnecting from the drill pipe 1050. The drill pipe 1050 that is left behind may be drilled up in a subsequent operation.

In another embodiment, an optional disconnect 1065 may be located on the drill string 1015 above the running tool 1060. The disconnect 1065 may be any suitable release mechanism known to a person of ordinary skill in the art. The disconnect 1065 allows the drilling rig to quickly disconnect from the drilling system 1000 in an emergency situation.

Figure 49:
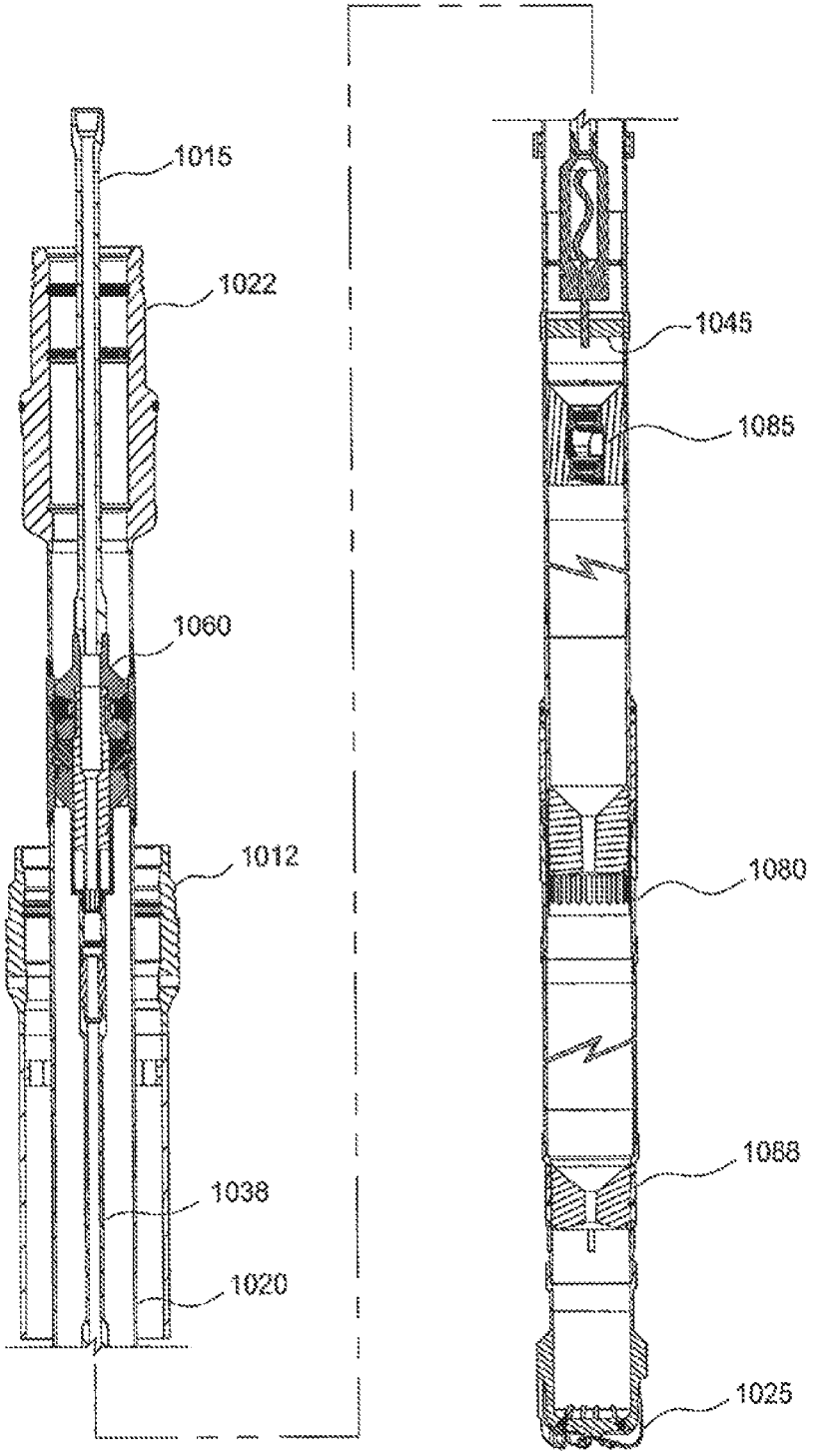
FIG. 49 illustrates another embodiment of a drilling system equipped with a retractable joint for subsea drilling with casing.

In another embodiment, the drilling system 1000 may optionally include a retractable joint. Referring to FIG. 49, the retractable joint 1080 is disposed below the motor coupling 1045. In this respect, the retractable joint 1080 is rotated with the earth removal member 1025 during drilling. The retractable joint 1080 may be a retractable joint described herein, such as the retractable joint described in FIG. 2. In another embodiment, the retractable joint may be a spline connection releasably attached using a shear pins or any suitable retractable connection known to a person of ordinary skill in the art. The drilling system 100 may optionally include a circulation sub 1088 as described herein to facilitate circulation. The drilling system may further include a float sub 1085 to facilitate the cementing operation. In another embodiment, a drill pipe may be provided to further distance the drilling motor from the retractable joint.

Figures 50, 50A:
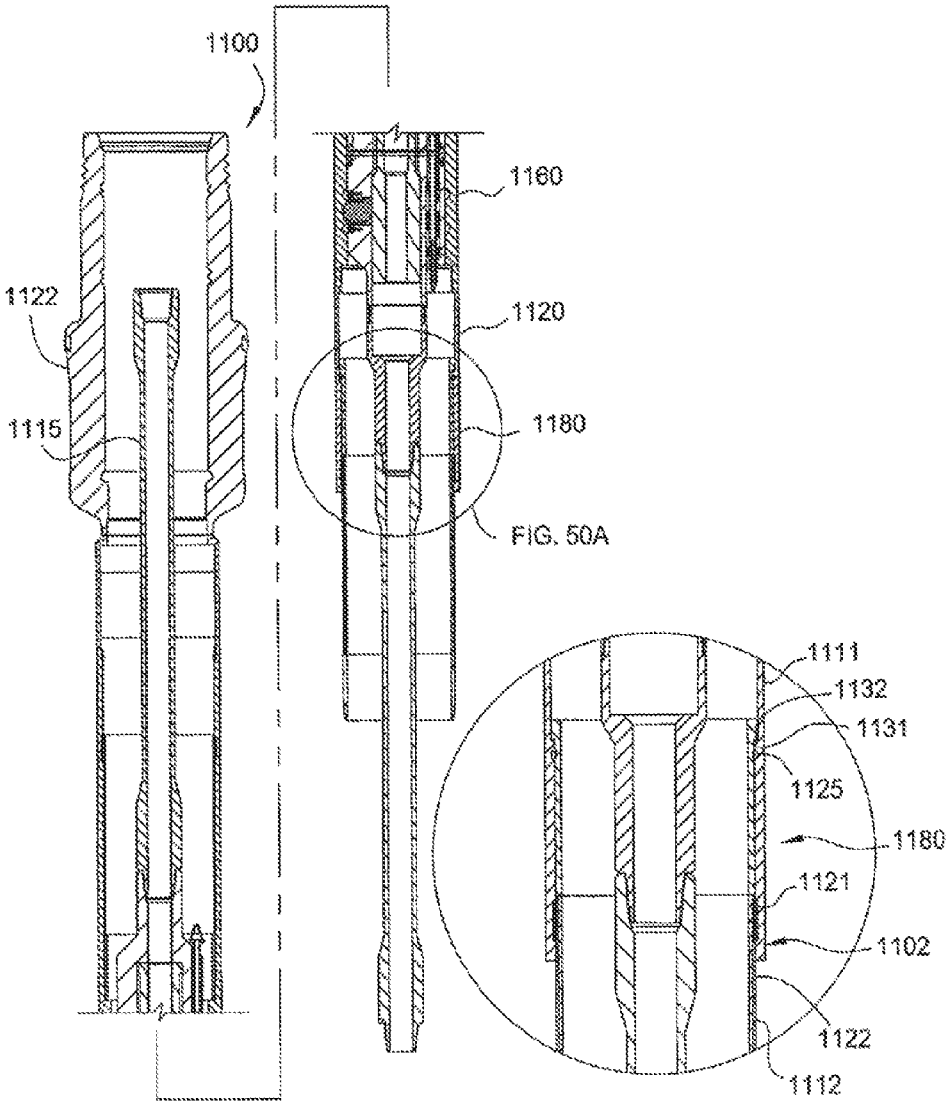
FIGS. 50 and 50A show another embodiment of a retractable joint.

FIG. 50 illustrates another embodiment of a drilling system 1100 having a retractable joint 1180. The drilling system 1100 includes a casing string 1120 coupled to a drill string 1115 using a running tool 1160. The running tool 1160 may be selected from any suitable running tool described herein, for example, the running tool disclosed in FIGS. 19-22; or known to a person of ordinary skill in the art. The casing string 1120 may include a high pressure wellhead 1122 at its upper end and an earth removal member at its lower end. The retractable joint 1180 is disposed below the running tool 1160, near the top of the casing string 1120. In one embodiment, the retractable joint 1180 is positioned sufficiently close to the running tool 1160 such that the retractable joint 1180 is subjected to predominantly tensile axial forces during run-in or drilling. In another embodiment, the retractable joint 1180 may be disposed above the running tool 1160 and/or both.

Referring to FIG. 50A, the retractable joint 1180 is used to couple an upper telescoping casing 1111 to a lower telescoping casing 1112. As shown, the telescoping casings 1111, 1112 are coupled together using a spline connection 1120. Spline keys 1121 on the upper telescoping casing 1111 may move along the spline grooves 1122 formed on the lower telescoping casing 1112. The spline connection allows torque to be transferred between the casings 1111, 1112. A seal 1125 may be placed between the upper and lower telescoping casings 1111, 1112. The seal 1125 may help hold the drilling differential pressure and the subsequent cementing pressure. The upper portion of the lower telescoping casing 1112 may include an outward shoulder 1132 adapted to engage a corresponding inward shoulder 1131 on the upper telescoping casing 1111. The shoulders 1131, 1132 allow transfer of tension forces between the telescoping casings 1111, 1112. During run-in and/or drilling, axial tensile forces keep the telescoping casings 1111, 1112 in the extended position, wherein the shoulders 1131, 1132 are abutted against each other. To reduce the overall length of the casings 1111, 1112, an axial compressive force, such as by slacking off weight, is applied to lower the upper telescoping casing 1111 relative to the lower telescoping casing 1112. After retraction and landing the wellhead or casing hanger, the running tool 1160 may be released either before or after cementing.

It must be noted that embodiments of the running tools described herein may appropriately be interchanged with each other. For example, the running tool of FIG. 28 may replace the running tool of FIG. 19 for use in a drilling system, without any significant modification. In addition, other suitable running tools are contemplated for use with the drilling system. For example, a running tool designed for transmitting torque to a casing drill string is disclosed in U.S. Pat. No. 6,241,018, issued to Eriksen, which patent is assigned to the same assignee of the present application and is incorporated herein by reference in its entirety. An exemplary running tool suitable for such use is manufactured by Weatherford International and sold under the name "R Running Tool." This type of running tool may be released using a pressure event or weight event, e.g., compressive load, coupled with a rotate-to-release mechanism. Another exemplary running tool is disclosed in U.S. Pat. No. 5,425,423, issued to Dobson, et al., which patent is incorporated herein by reference in its entirety. In one embodiment, the running tool includes a mandrel body having a threaded float nut disposed on its lower end to engage a tubular. The running tool also includes a thrusting cap having one or more latch keys disposed thereon which are adapted to engage slots formed on the upper end of the tubular. The thrusting cap is selectively engageable to the mandrel body through a hydraulic assembly and a clutch assembly which is engaged in the run-in position. The hydraulic assembly can be actuated to release the thrusting cap from rotational connection with the mandrel body to allow the threaded float nut to be backed out of the tubular. The clutch assembly is disengaged when the tool is in the weight down position. A torque nut moves down a threaded surface of the thrusting cap to re-engage the thrusting cap and transmit torque imparted by the mandrel body from the drill string to the thrusting cap.

Embodiments of the present invention also provide methods of determining a distance between the high pressure wellhead and the low pressure wellhead in preparation of landing the high pressure wellhead and/or casing hanger. In one embodiment, the drill distance may be determined from tallying the number of drill pipe used. In another embodiment, the ROV may observe the process of the high pressure wellhead toward the lower pressure wellhead. In yet another embodiment, proximity sensors may be used to determine the distance therebetween. It is contemplated that one or more of these techniques and/or other suitable techniques known to a person of ordinary skill in the art may be used.

Additionally, other features described within one embodiment may appropriately be interchanged or added to another embodiment. For example, the vent tube described with respect to FIG. 34 may be added to the running tool described in FIG. 19. In another embodiment, the rupture disk described with respect to FIG. 37 may be added to the running tool described in FIG. 34. In yet another example, low friction material may be added to any suitable embodiments described herein.

In one or more of the embodiments described herein, one or more seals may be located on either the running tool or the setting sleeve, or both.

In one or more of the embodiments described herein, telemetry such as mud pulse telemetry, flow rate modulation, electromagnetic signal, and radio frequency identification tags may be used to transmit a command to operate a valve. For example, a coded pressure signal may be sent down the bore to the running tool, where it is received by a sensor operatively connected to a controller which in turn, opens the valve or a port to provide a fluid path for circulation. Devices operated by pressure telemetry or other suitable remote actuation methods may also be used to activate the running tool, retractable joint, or circulation sub.

In one or more of the embodiments described herein, the cementing operation may occur by way of reverse circulation, for example, supplied through the side ports 1013 of the low pressure wellhead 1012.

In one or more of the embodiments of the running tool described herein, the same dog, either axial or torque, may provide for both axial and torque load transfer.

As used herein, an earth removal member may include a drill shoe, casing shoe, a rotary drill bit, a pilot bit and underreamer combination, jet shoe, a bi-center bit with or without an underreamer, an expandable bit, or any other suitable earth removal member known to a person of ordinary skill in the art. In one embodiment, the earth removal member may include nozzles or jetting orifices for directional drilling.

In one or more of the embodiments described herein, a retractable tubular assembly having a first tubular; a second tubular at least partially disposed in the first tubular; an engagement member for coupling the first tubular to the second tubular, the engagement member having an engaged position to lock the first tubular to the second tubular and a disengaged position to release the first tubular from the second tubular; and a selectively releasable support member disposed in the second tubular for maintaining the engagement member in the engaged position.

In another embodiment, the engagement member is adapted to allow transfer of axial load between the first tubular and the second tubular. In yet another embodiment, the engagement member is adapted to allow transfer of torque between the first tubular and the second tubular. In yet another embodiment, the support member is hydraulically actuated to release the engagement member.

In yet another embodiment, the assembly includes a circulation sub. In yet another embodiment, the circulation sub, in an unactivated position, blocks a side port in the first tubular; and in an activated position, opens the side port. In yet another embodiment, the circulation sub is hydraulically activated between unactivated and activated positions. In yet another embodiment, an activating device activates both the support member and the circulation sub. In yet another embodiment, a first activating device activates the circulation sub and a second activating device activates the support member. In yet another embodiment, the circulation sub is rotationally fixed relative to the first tubular. In yet another embodiment, an earth removal member is disposed at lower end of the first tubular. In yet another embodiment, a running tool is connected to an upper portion of the second tubular.

In another embodiment, a tubular conveying apparatus includes a tubular body having a plurality of windows; one or more gripping members radially movable between an engaged position and a disengaged position in the windows; and a mandrel disposed in the tubular body and selectively movable from a first position, wherein the gripping member is in the engaged position, to a second position, to allow the gripping member to move to the disengaged position.

In yet another embodiment, the mandrel is adapted to receiving a pressure activating device. In yet another embodiment, a valve is disposed in an axial bore extending through the tubular body. In yet another embodiment, a flow tube is adapted to maintain the valve in an open position. In yet another embodiment, a rupturable member is disposed in an axial bore extending through the tubular body. In yet another embodiment, a low friction material is disposed on an exterior surface of the tubular body.

In yet another embodiment, a method of forming a wellbore includes providing a drilling assembly comprising one or more lengths of casing and an axially retracting assembly having a first tubular; a second tubular at least partially disposed in the first tubular and axially fixed thereto; and a support member disposed in the second tubular and movable from a first axial position to a second axial position relative to the second tubular, wherein, in the first axial position, the support member maintains the second tubular axially fixed to the first tubular, and in the second axial position, allows the second tubular to move relative to the first tubular; and an earth removal member disposed below the axially retracting assembly. The method also includes rotating the earth removal member to form the wellbore; moving the support member to the second axial position; and reducing a length of the axially retracting assembly.

In yet another embodiment, further comprising releasably connecting a running tool to the drilling assembly, and conveying the drilling assembly using the running tool. In yet another embodiment, further comprising releasing the running tool after reducing the length of the axially retracting assembly. In yet another embodiment, further comprising connecting the running tool to a drill pipe extending from the surface. In another embodiment, further comprising performing a cementing operation.

In another embodiment, a method of forming a wellbore includes providing a drilling assembly comprising one or more lengths of casing and an axially retracting assembly, wherein the drilling assembly includes a first tubular; a second tubular at least partially disposed in the first tubular and axially fixed thereto; and a support member disposed in the second tubular and movable from a first axial position to a second axial position relative to the second tubular, wherein, in the first axial position, the support member maintains the second tubular axially fixed to the first tubular, and in the second axial position, allows the second tubular to move relative to the first tubular; and an earth removal member disposed below the axially retracting assembly. The method also includes rotating the earth removal member to form the wellbore; moving the support member to the second axial position; and reducing a length of the axially retracting assembly.

In one or more of the embodiments described herein, the method includes applying pressure to move the support member from the first axial position to the second axial position prior to reducing the length of the axially retracting assembly.

In one or more of the embodiments described herein, the method includes providing a high pressure wellhead attached to the one or more lengths of casing.

In one or more of the embodiments described herein, reducing the length of the axially retracting assembly causes the high pressure wellhead to land in a low pressure wellhead.

In one or more of the embodiments described herein, the method includes attaching a centralizing ram on the high pressure wellhead.

In one or more of the embodiments described herein, the method includes releasably connecting a running tool to the drilling assembly, and conveying the drilling assembly using the running tool.

In one or more of the embodiments described herein, the method includes releasing the running tool after reducing the length of the axially retracting assembly.

In one or more of the embodiments described herein, the method includes connecting the running tool to a drill pipe extending from the surface.

In one or more of the embodiments described herein, the method includes performing a cementing operation.

In one or more of the embodiments described herein, the method includes attaching a running tool to the high pressure wellhead and transferring torque loads or axial load via the running tool.

Embodiments of the invention are described herein with terms designating orientation in reference to a vertical wellbore. These terms designating orientation should not be deemed to limit the scope of the invention. Embodiments of the invention may also be used in a non-vertical wellbore, such as a horizontal wellbore.

While the foregoing is directed to embodiments of the present invention, other and further embodiments of the invention may be devised without departing from the basic scope thereof, and the scope thereof is determined by the claims that follow.

The invention claimed is:

1. A tubular conveying apparatus, comprising:

a tubular body having a plurality of windows;

one or more gripping members radially movable between an engaged position and a disengaged position in the windows;

a seal disposed in a setting sleeve and around the tubular body, the seal being configured to sealingly engage the tubular body;

a mandrel disposed in the tubular body and selectively movable from a first position, wherein the gripping member is in the engaged position, to a second position, to allow the gripping member to move to the disengaged position, wherein the mandrel includes a collet having a seat for receiving a pressure activating device for moving the mandrel from the first position to the second position; and wherein the mandrel includes a recess to receive the gripping member in the disengaged position.

2. The apparatus of claim 1, further comprising a channel for fluid communication from below the seal to above the seal.

3. The apparatus of claim 2, further comprising a vent tube for fluid communication from the tubular body to above a wellhead.

4. The apparatus of claim 3, further comprising a vent valve attached to the vent tube.

5. The apparatus of claim 2, wherein the seat is formed by collet fingers.

* * * * *